US006185401B1

(12) United States Patent
Kanamori et al.

(10) Patent No.: US 6,185,401 B1
(45) **Date of Patent: *Feb. 6, 2001**

(54) TONER BOTTLE, TONER SUPPLY SYSTEM AND IMAGE FORMING APPARATUS USING SAME

(75) Inventors: Akihito Kanamori, Numazu; Kazuyuki Miyano, Mishima; Hideki Goto, Shizuoka-ken; Tatsuya Goto, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/161,715

(22) Filed: Sep. 29, 1998

(30) Foreign Application Priority Data

Sep. 30, 1997 (JP) ..... 9-283041
Sep. 22, 1998 (JP) ..... 10-286014

(51) Int. Cl.[7] ..... G03G 15/08
(52) U.S. Cl. ..... 399/262; 399/119
(58) Field of Search ..... 399/110, 119, 399/222, 252, 258, 262, 263, 106

(56) References Cited

U.S. PATENT DOCUMENTS

| | | | | |
|---|---|---|---|---|
| 4,827,307 | * | 5/1989 | Zoltner | 399/106 |
| 4,878,603 | | 11/1989 | Ikesue et al. | 222/167 |
| 4,937,628 | * | 6/1990 | Cipolla et al. | 399/106 |
| 5,385,181 | * | 1/1995 | Bhagwat et al. | 399/262 X |
| 5,526,101 | | 6/1996 | Weed . | |
| 5,548,384 | | 8/1996 | Weed . | |
| 5,579,101 | | 11/1996 | Omata et al. . | |
| 5,669,044 | * | 9/1997 | Cuthbert | 399/262 X |

FOREIGN PATENT DOCUMENTS

| | | |
|---|---|---|
| 0 616 268 A1 | 9/1994 | (EP) . |
| 0 613 206 A2 | 12/1994 | (EP) . |
| 0 668 546 | 8/1995 | (EP) . |
| 1-108581 | 4/1989 | (JP) . |
| 05-241443 | 9/1993 | (JP) . |
| 6-035321 | 2/1994 | (JP) . |
| 7-306578 | 11/1995 | (JP) . |
| 08-234552 | 9/1996 | (JP) . |
| 09-179363 | 7/1997 | (JP) . |

OTHER PUBLICATIONS

Patent Abstracts of Japan, vol. 13, No. 349 (P–911), Aug. 7, 1989.

Patent Abstracts of Japan, vol. 18, No. 256 (P–1738), May 16, 1994.

(List continued on next page.)

*Primary Examiner*—Sandra L. Brase
(74) *Attorney, Agent, or Firm*—Fitzpatrick, Cella, Harper & Scinto

(57) ABSTRACT

A toner supply container for supplying toner into a main assembly of an electrophotographic image forming apparatus includes a toner accommodating portion for accommodating toner to be supplied into a main assembly of the electrophotographic image forming apparatus; a toner discharging opening for discharging the toner accommodated in the toner accommodating portion, the toner discharging opening being provided in the toner accommodating portion; a sealing member for openably sealing the toner discharging opening; an openable member for openably sealing the toner discharging opening; a rotatable member which is rotatable relative to the toner accommodating portion; a rotating force receiving portion for receiving rotating force produced by rotation of the rotatable member through a rotating force transmission member provided in the main assembly of the electrophotographic image forming apparatus to unseal the toner discharging opening by the rotation of the rotatable member when the toner supply container is mounted to the main assembly of the electrophotographic image forming apparatus.

58 Claims, 36 Drawing Sheets

U.S. PATENT DOCUMENTS

| | | | | |
|---|---|---|---|---|
| 5,708,925 | | 1/1998 | Kobayashi et al. | 399/120 |
| 5,722,014 | * | 2/1998 | Fike | 399/119 |
| 5,722,019 | * | 2/1998 | Nakajima | 399/262 |
| 5,771,427 | * | 6/1998 | Makino | 399/262 X |
| 5,809,384 | * | 9/1998 | Johroku et al. | 399/262 |
| 5,842,092 | * | 11/1998 | Jyoroku | 399/262 |
| 5,870,652 | | 2/1999 | Kanamori et al. | 399/106 |

* cited by examiner

TONER BOTTLE, TONER SUPPLY SYSTEM AND IMAGE FORMING APPARATUS USING SAME

FIELD OF THE INVENTION AND RELATED ART

The present invention relates to a toner supply container for supplying toner into an electrophotographic image forming apparatus for forming an image on a recording material with toner and an electrophotographic image forming apparatus using the same.

Here, the electrophotographic image forming apparatus is an apparatus wherein an image is formed on a recording material through an electrophotographic image formation type. Examples of the electrophotographic image forming apparatus include an electrophotographic copying machine, an electrophotographic printer (e.g. laser beam printer, LED printer), a facsimile machine, a word processor or the like.

In an electrophotographic image forming apparatus such as an electrophotographic copying machine, a laser beam printer, a photosensitive drum uniformly charged is selectively exposed to light. By this, an electrostatic latent image is formed. The electrostatic latent image is developed with toner to form a toner image. Then, the toner image is transferred onto a recording material. In such an apparatus, whenever the toner is used up, it has to be replenished or supplied. The toner supply container for supplying the toner to the image forming apparatus is classified into a removing type wherein an entire amount of toner is replenished at once into a toner reception container of the main assembly of the image forming apparatus and a leaving type container wherein the container is mounted and is retained therein. Here, the leaving type container gradually supplies the toner into the developing device until the toner therein is used up.

Recently, the leaving type toner supply container is increasingly used from the standpoint of downsizing of the image forming apparatus. In order to prevent scattering of remaining toner through a toner discharging opening, an openable member for sealing the opening is provided.

For example, Japanese Patent Application Publication No. HEI-7-82268 discloses a mechanism for permitting opening of the discharging opening by rotation of the container after it is mounted to the main assembly. Japanese Laid-open Patent Application No. HEI-7-306578 discloses a use of a handle for opening and closing the discharging opening.

The present invention further develops the mechanism and system.

SUMMARY OF THE INVENTION

Accordingly, it is a principal object of the present invention to provide a toner supply container and an electrophotographic image forming apparatus usable with the toner supply container wherein the toner can be supplied assuredly into the main assembly of the electrophotographic image forming apparatus.

It is another object of the present invention to provide a toner supply container detachably mountable to a main assembly of an electrophotographic image forming apparatus and an electrophotographic image forming apparatus to which the toner supply container is detachably mountable.

It is a further object of the present invention to provide a toner supply container which can supply the toner gradually while it is kept loaded in the main assembly of the electrophotographic image forming apparatus, and an electrophotographic image forming apparatus to which the toner supply container is detachably mountable.

It is a further object of the present invention to provide a toner supply container which can supply the toner gradually in accordance with the consumption of the toner while it is kept loaded in the main assembly of the electrophotographic image forming apparatus and an electrophotographic image forming apparatus to which the toner supply container is detachably mountable.

It is a further object of the present invention to provide a toner supply container having a toner discharging opening which can be opened by mounting it to the main assembly of the electrophotographic image forming apparatus, and an electrophotographic image forming apparatus to which the toner supply container is detachably mountable.

It is a further object of the present invention to provide a toner supply container having a toner discharging opening which can be opened by rotating a rotatable member relative to a toner accommodating portion when it is mounted to the main assembly of an electrophotographic image forming apparatus, and an electrophotographic image forming apparatus to which the toner supply container is detachably mountable.

It is a further object of the present invention to provide a toner supply container having a toner discharging opening which can be opened through a member provided in the main assembly of the electrophotographic image forming apparatus, and an electrophotographic image forming apparatus to which said toner supply container is detachably mountable.

It is a further object of the present invention to provide a toner supply container wherein a toner discharging opening of the toner accommodating portion and a toner receiving opening of a main assembly of the apparatus are interrelatedly opened when the container is mounted to the main assembly of the electrophotographic image forming apparatus, and an electrophotographic image forming apparatus to which the toner supply container is detachably mountable.

It is a further object of the present invention to provide a toner supply container having an improved operativity of supplying the toner to the main assembly of the electrophotographic image forming apparatus, and an electrophotographic image forming apparatus usable with the toner supply container.

It is a further object of the present invention to provide a toner supply container having a rotating force receiving portion for receiving, through a rotating force transmission member provided in the main assembly of the apparatus, the rotating force produced by rotation of the rotatable member to open the toner discharging opening when the container is mounted to the main assembly of the apparatus.

According to an aspect of the present invention, there is provided a toner supply container for supplying toner into a main assembly of an electrophotographic image forming apparatus, comprising:

- a toner accommodating portion for accommodating toner to be supplied into a main assembly of the electrophotographic image forming apparatus;
- a toner discharging opening for discharging the toner accommodated in the toner accommodating portion, said toner discharging opening being provided in said toner accommodating portion;
- a sealing member for openably sealing said toner discharging opening;
- an openable member for openably sealing said toner discharging opening;

a rotatable member which is rotatable relative to said toner accommodating portion;

a rotating force receiving portion for receiving a rotating force produced by rotation of said rotatable member through a rotating force transmission member provided in the main assembly of said electrophotographic image forming apparatus to unseal said toner discharging opening by the rotation of said rotatable member when said toner supply container is mounted to the main assembly of said electrophotographic image forming apparatus.

According to another aspect of the present invention, there is provided a toner supply container for supplying toner into a main assembly of electrophotographic image forming apparatus, comprising:

a toner accommodating portion for accommodating toner to be supplied into a main assembly of the electrophotographic image forming apparatus;

a toner discharging opening for discharging the toner accommodated in the toner accommodating portion, said toner discharging opening being provided in said toner accommodating portion;

a sealing member for openably sealing said toner discharging opening;

a sealing member for openably sealing said toner discharging opening;

a rotatable member which is rotatable relative to said toner accommodating portion;

a rotating force receiving portion for receiving a rotating force produced by rotation of said rotatable member through a rotating force transmission member provided in the main assembly of said electrophotographic image forming apparatus to unseal a main assembly openable member which seals a toner reception opening provided in the main assembly of said electrophotographic image forming apparatus by rotation of said rotatable member, when said toner supply container is mounted to the main assembly of said electrophotographic image forming apparatus.

According to a further aspect of the present invention, there is provided an electrophotographic image forming apparatus for forming an image on a recording material with toner, which electrophotographic image forming apparatus is supplied with the toner from a toner supply container, comprising:

(a) rotating force transmission member;

(b) a toner container mounting portion for mounting said toner container, said toner container including:

a toner accommodating portion for accommodating toner to be supplied into a main assembly of the electrophotographic image forming apparatus;

a toner discharging opening for discharging the toner accommodated in the toner accommodating portion, said toner discharging opening being provided in said toner accommodating portion;

a sealing member for openably sealing said toner discharging opening;

a container openable member for openably sealing said toner discharging opening;

a rotatable member which is rotatable relative to said toner accommodating portion;

a rotating force receiving portion for receiving a rotating force produced by rotation of said rotatable member to unseal said toner discharging opening by rotation of said rotatable member through said rotating force transmission member when said toner supply container is mounted to the main assembly of said electrophotographic image forming apparatus;

(c) a feeding member for feeding the recording material.

These and other objects, features and advantages of the present invention will become more apparent upon a consideration of the following description of the preferred embodiments of the present invention taken in conjunction with the accompanying drawings.

19(*a*) shows that of a screw type, and

19(*b*) shows that of a flexible blade type.

Figure 20:
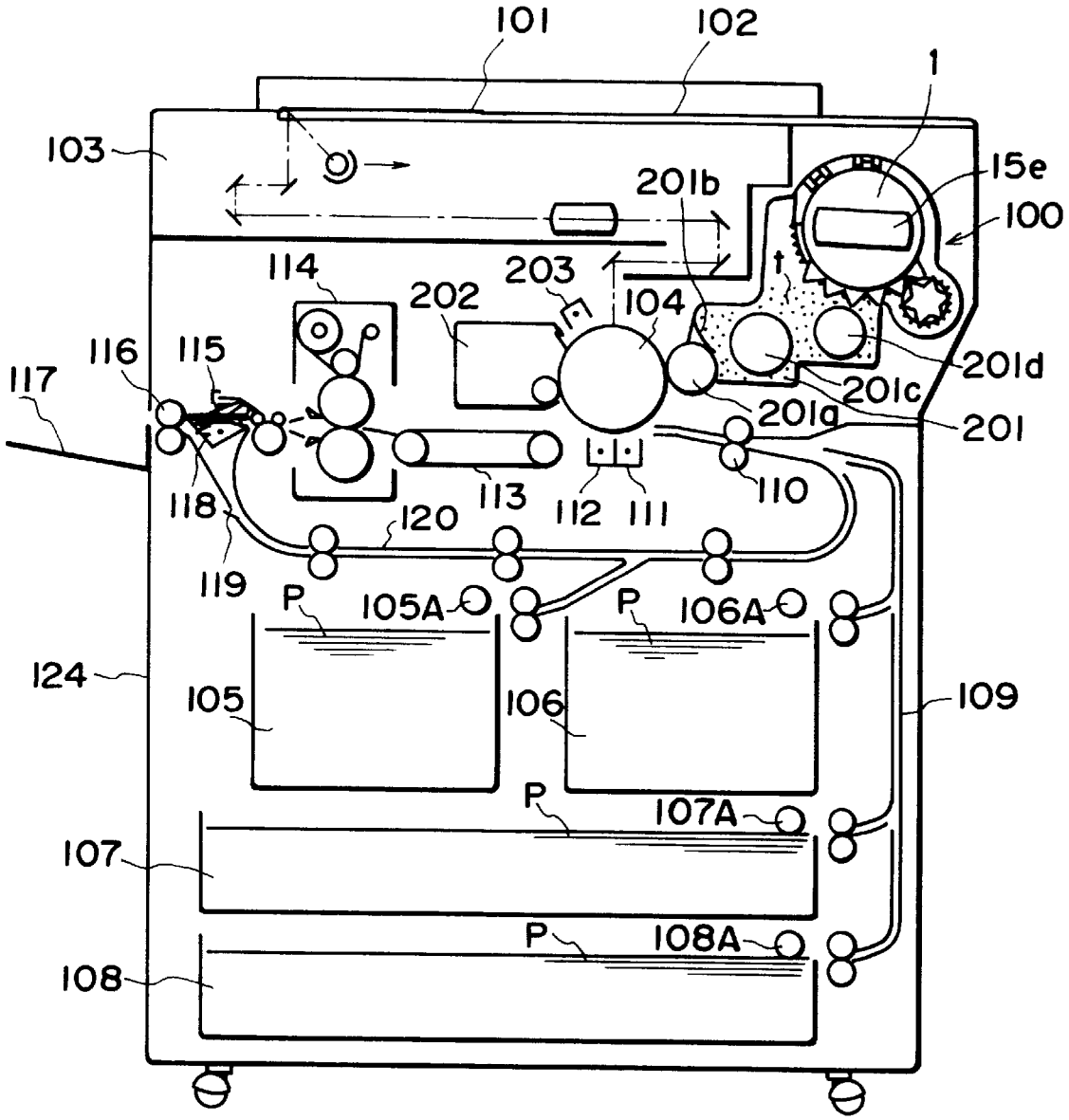

FIG. 20 is a longitudinal sectional view of an image forming apparatus to which the present invention is applicable.

Figure 21:
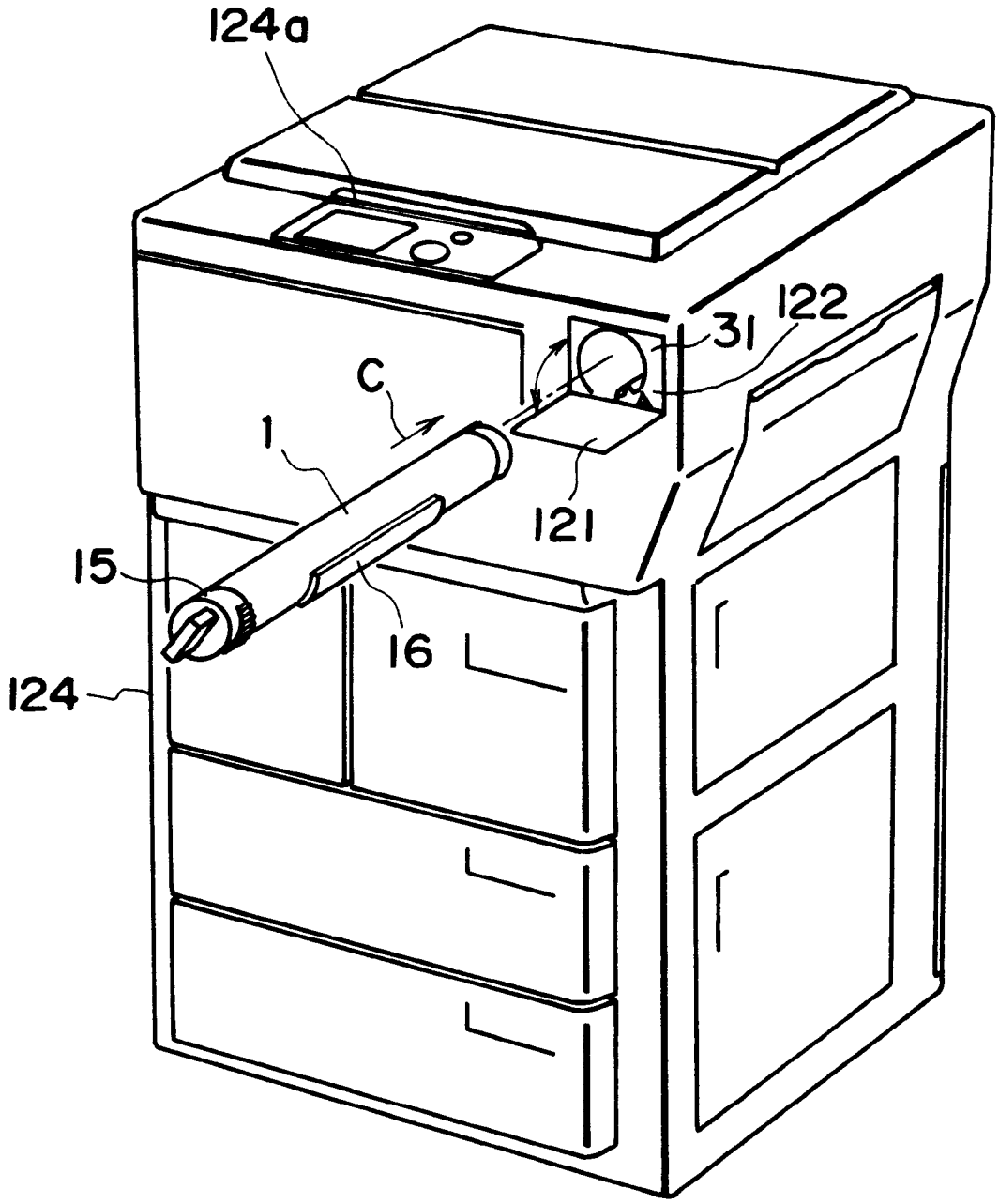

FIG. 21 is a perspective view of an outer appearance of the apparatus of FIG. 20.

Figure 22:
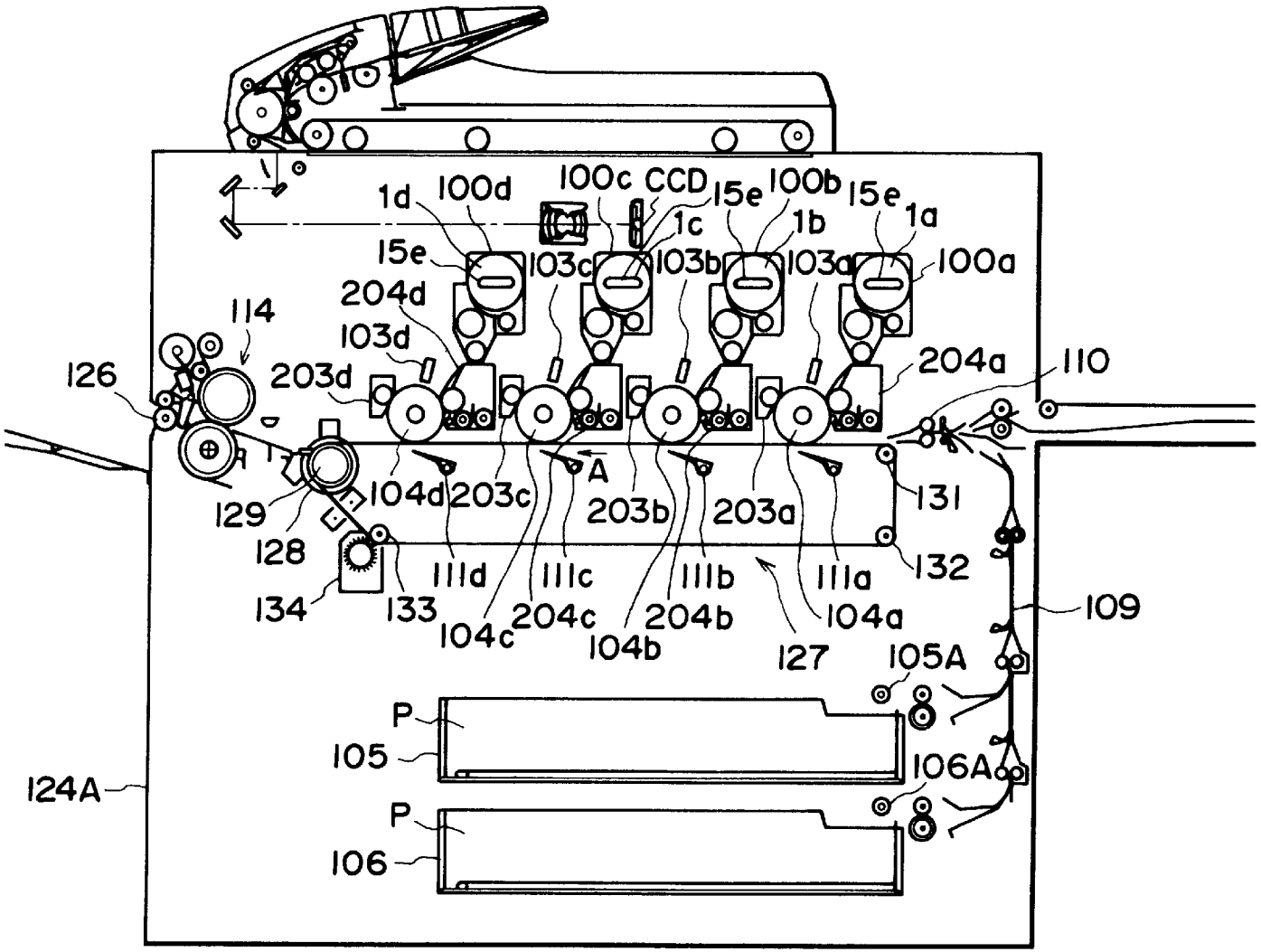

FIG. 22 is a longitudinal sectional view of an image forming apparatus according to Embodiment 4 of the present invention.

Figure 23:
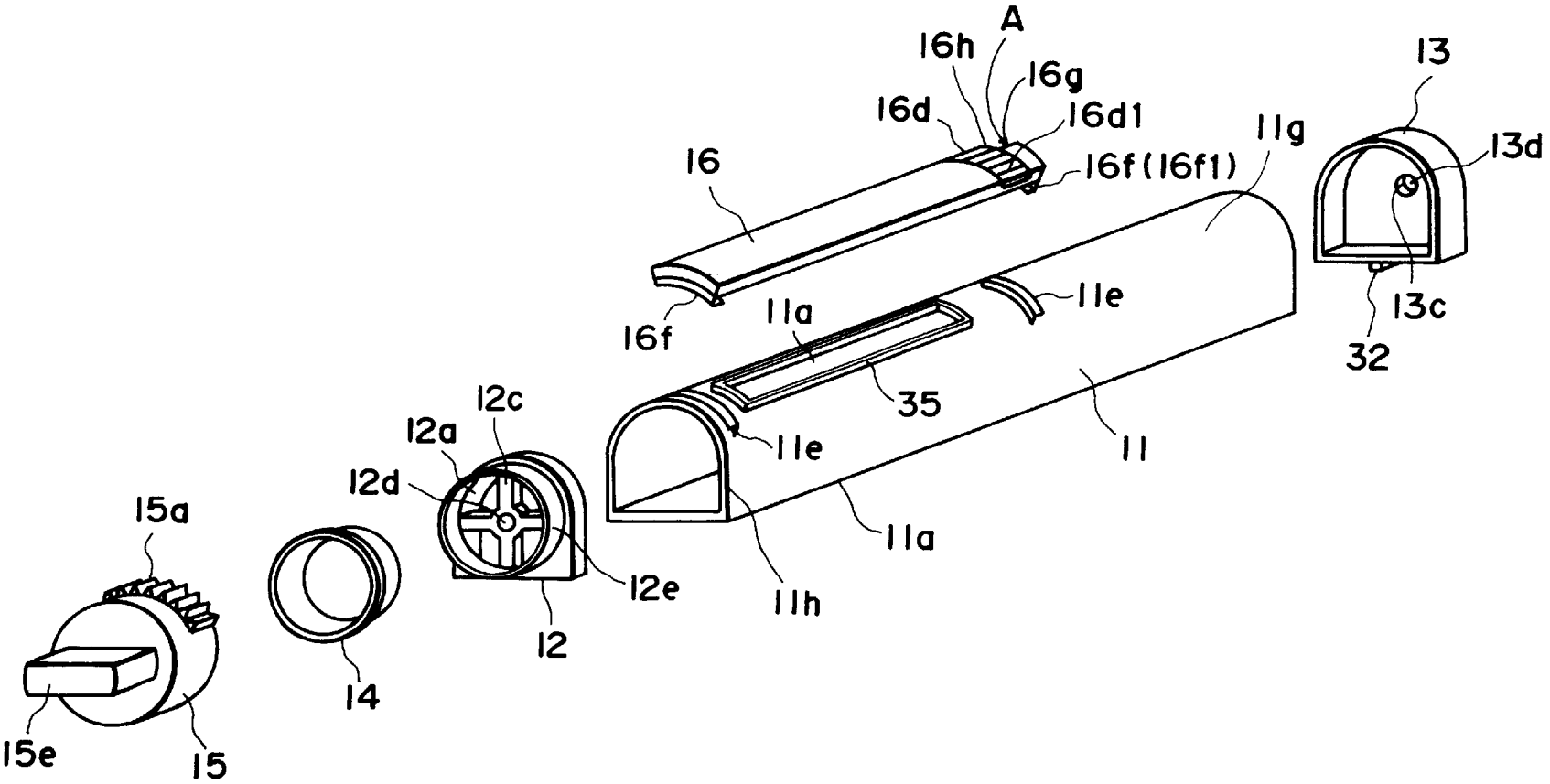

FIG. 23 is an exploded perspective view of a toner supply container according to Embodiment 4 of the present invention.

Figure 24:
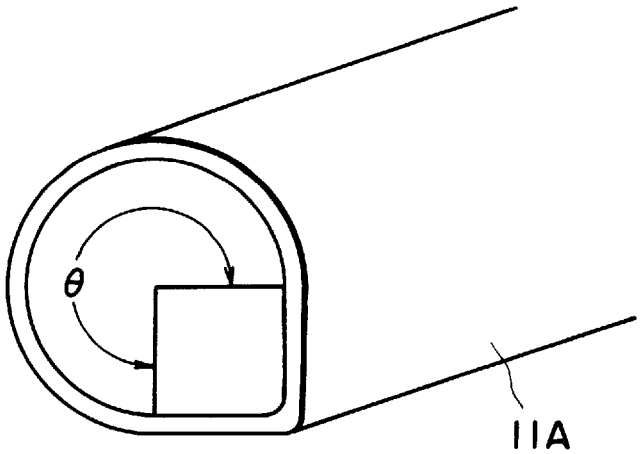

FIG. 24 is a perspective view of a toner supply container of a modified example of Embodiment 4.

Figure 25:
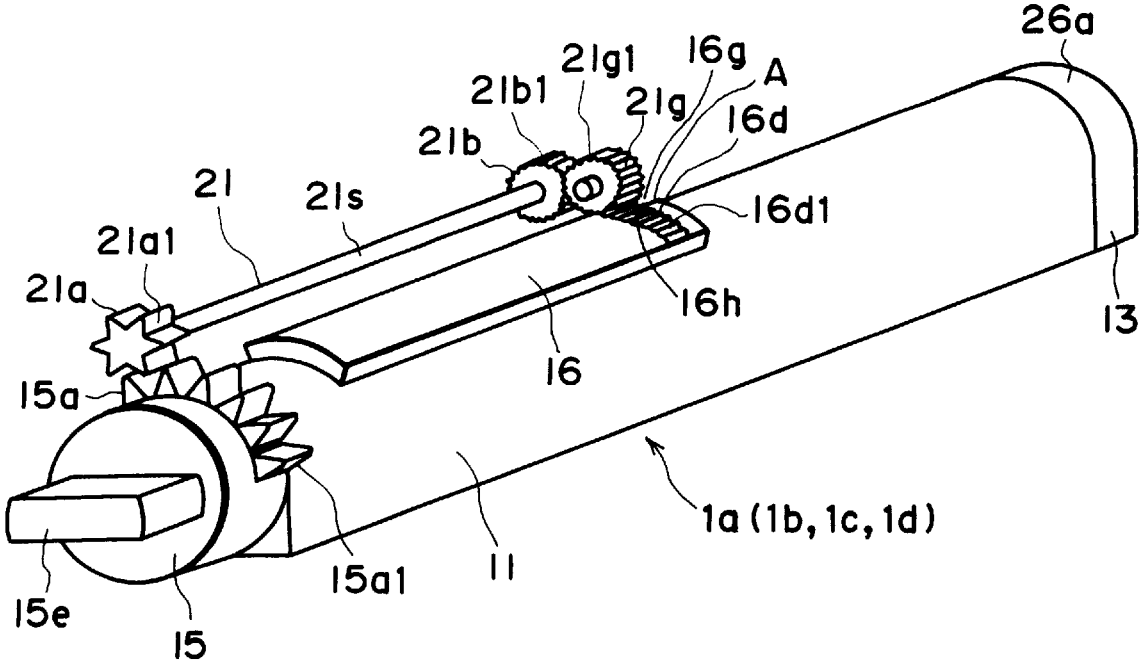

FIG. 25 is a perspective view illustrating an engaging relation between the main assembly of the apparatus and the toner supply container according to Embodiment 4 of the present invention.

Figure 26:
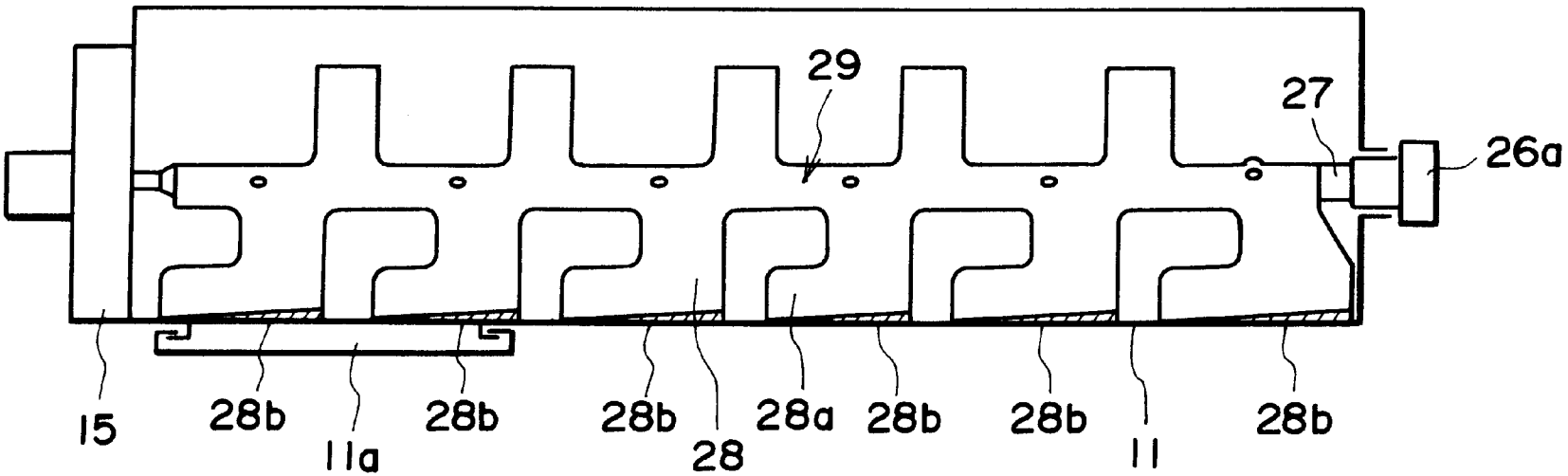

FIG. 26 is a longitudinal sectional view schematically showing a toner feeding apparatus of a flexible blade type.

Figure 27B:
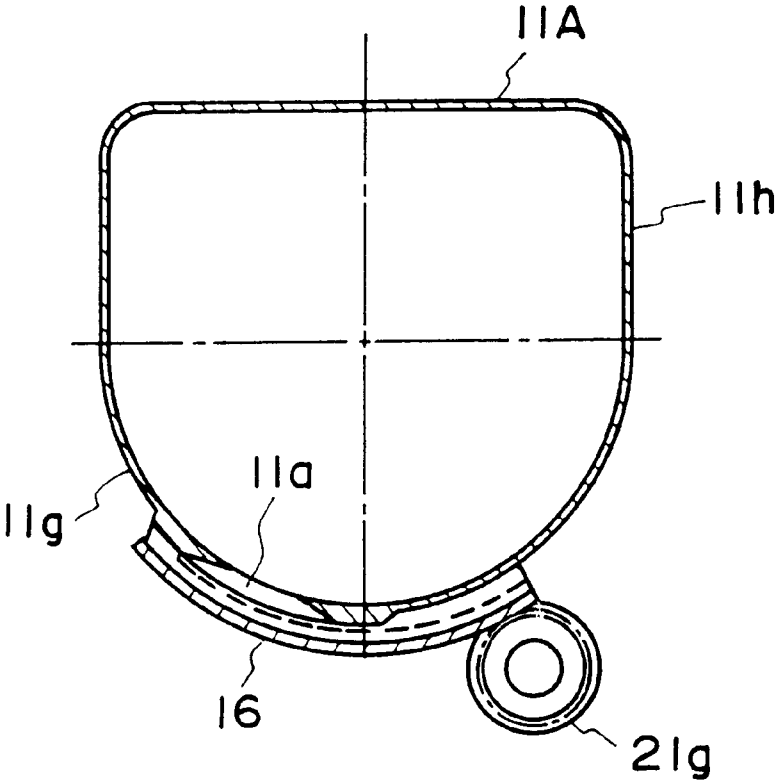
Figure 27A:
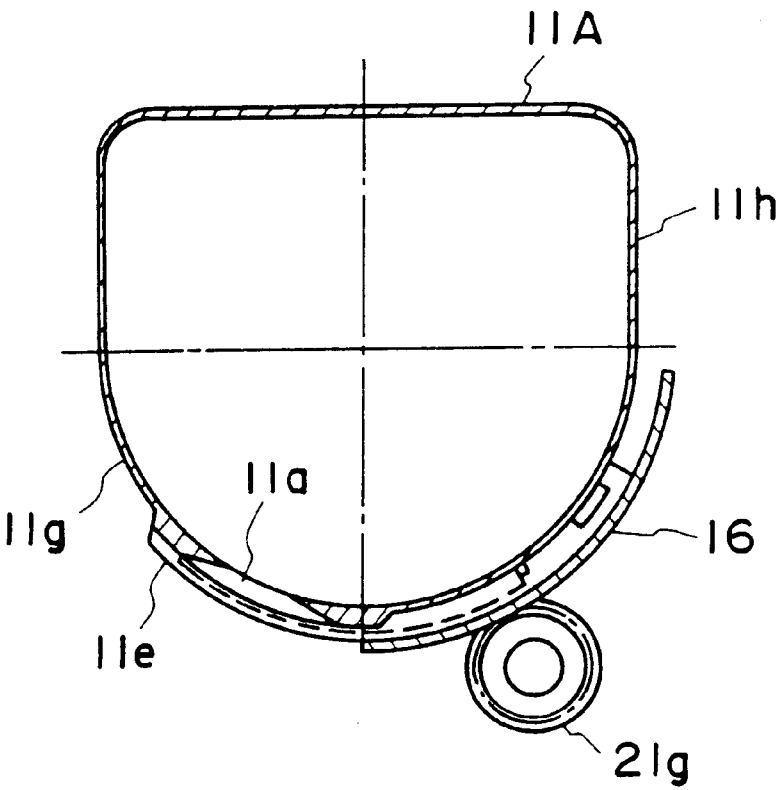

FIG. 27(*a*) and FIG. 27(*b*) are longitudinal sectional view of a toner supply container.

Figure 28:
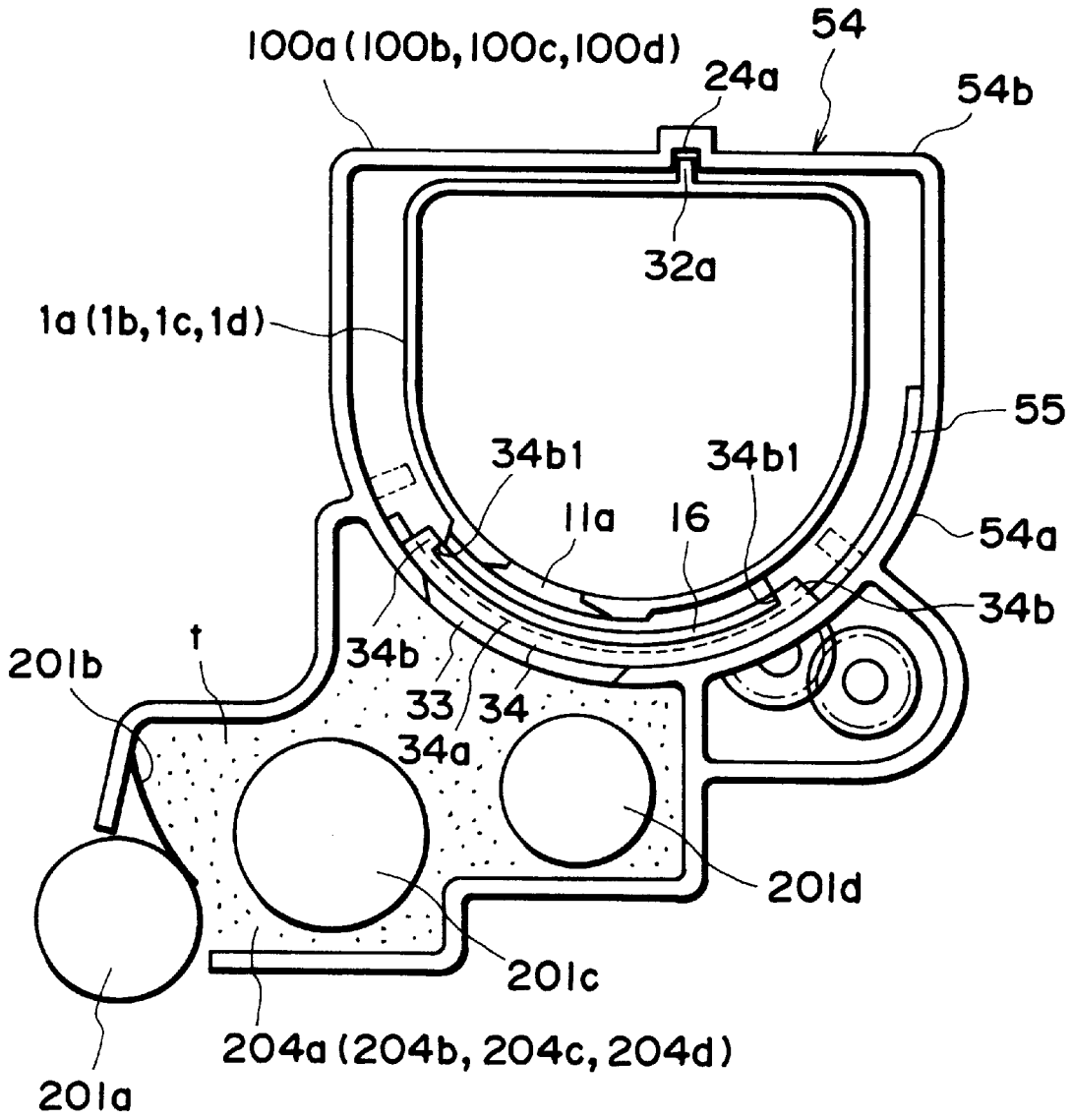

FIG. 28 is a longitudinal sectional view illustrating an engaging relation between the main assembly of the apparatus and the toner supply container according to Embodiment 4 of the present invention.

Figure 29:
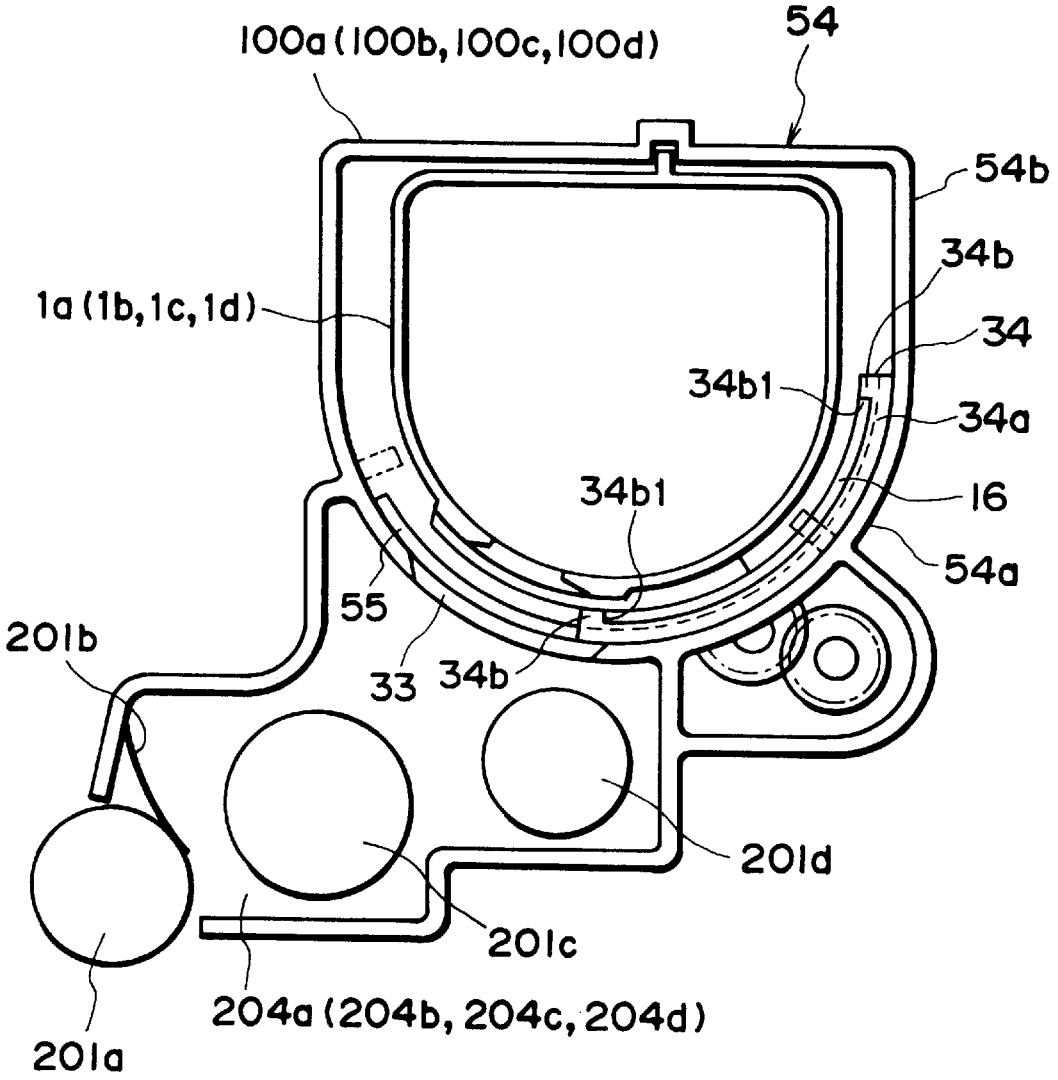

FIG. 29 is a longitudinal sectional view illustrating an engaging relation between the main assembly of the apparatus and the toner supply container of Embodiment 4 in a toner supplying operation.

Figure 30:
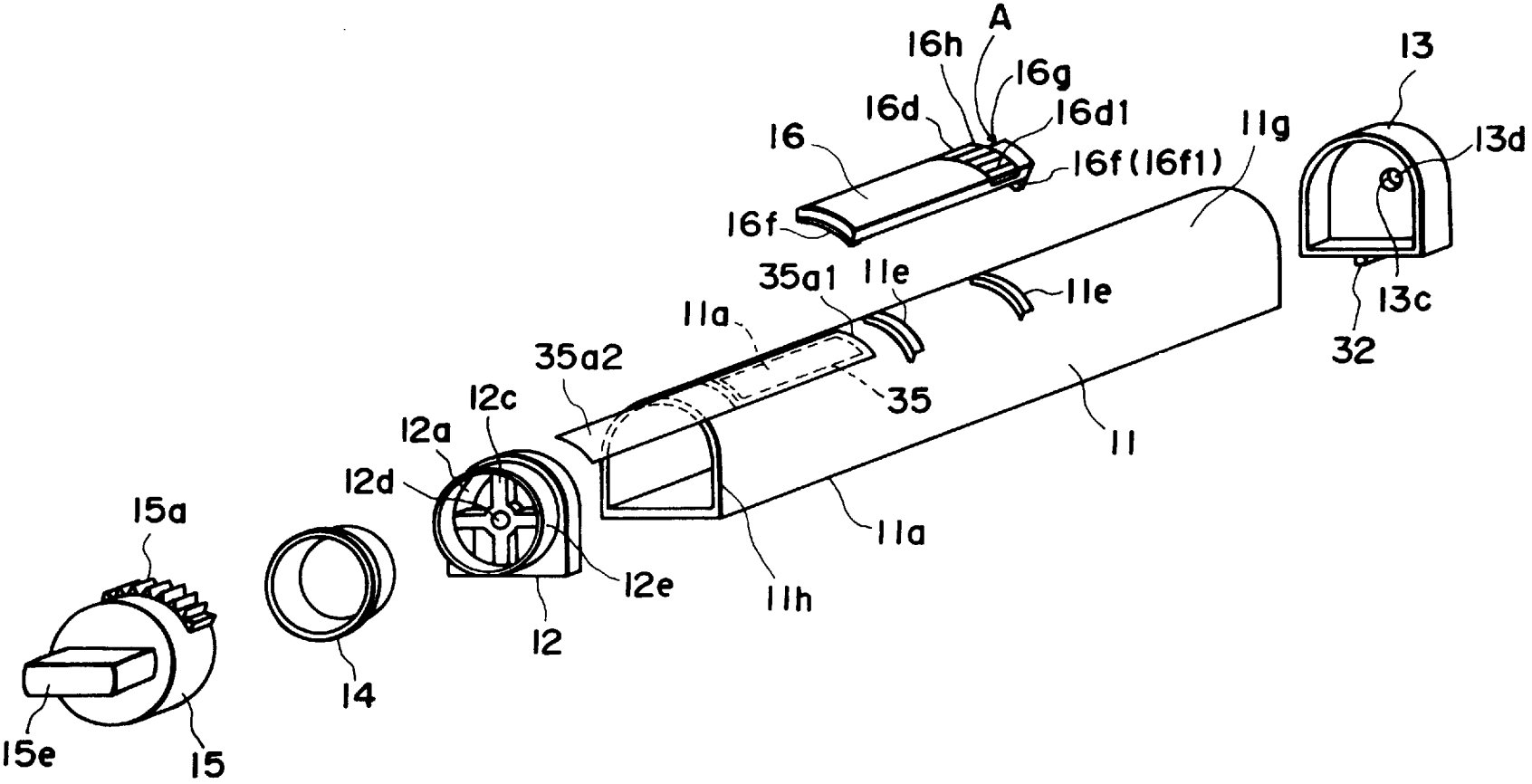

FIG. 30 is a longitudinal sectional view of a container according to a further embodiment using a seal member for sealing a toner discharging opening.

Figure 31:
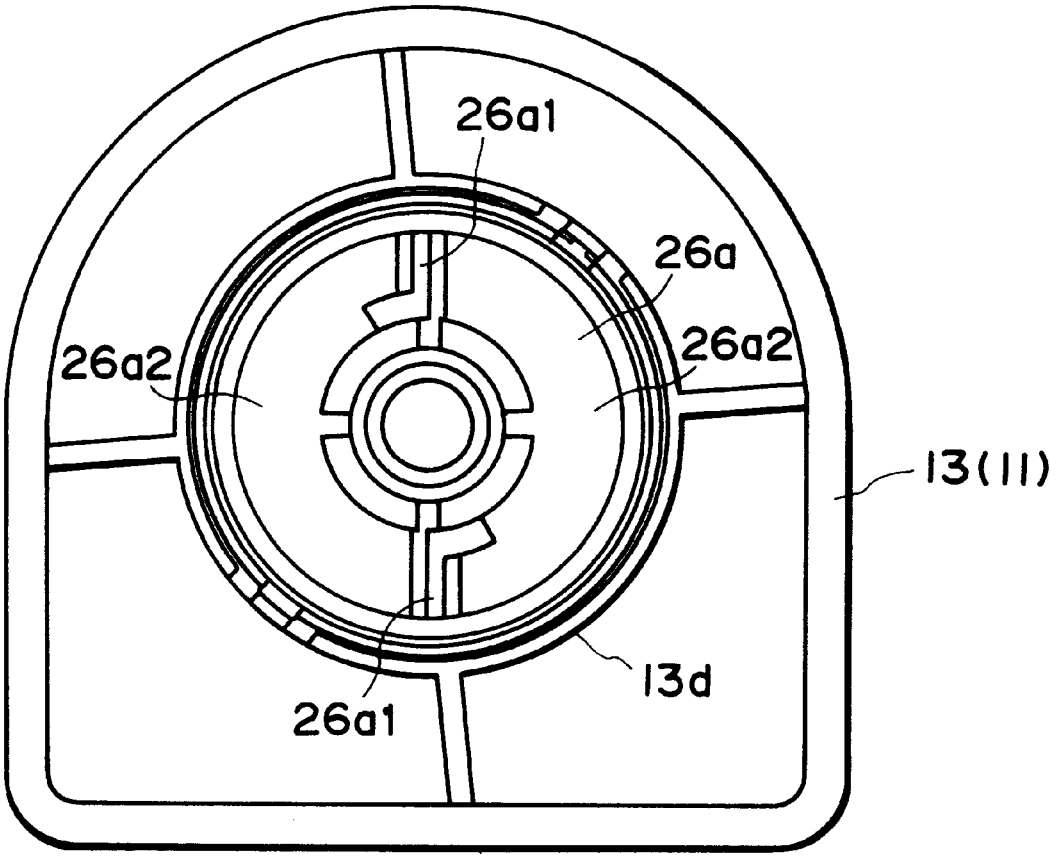

FIG. 31 is a front view of a longitudinal trailing edge of toner supply container of Embodiment 4.

Figure 32:
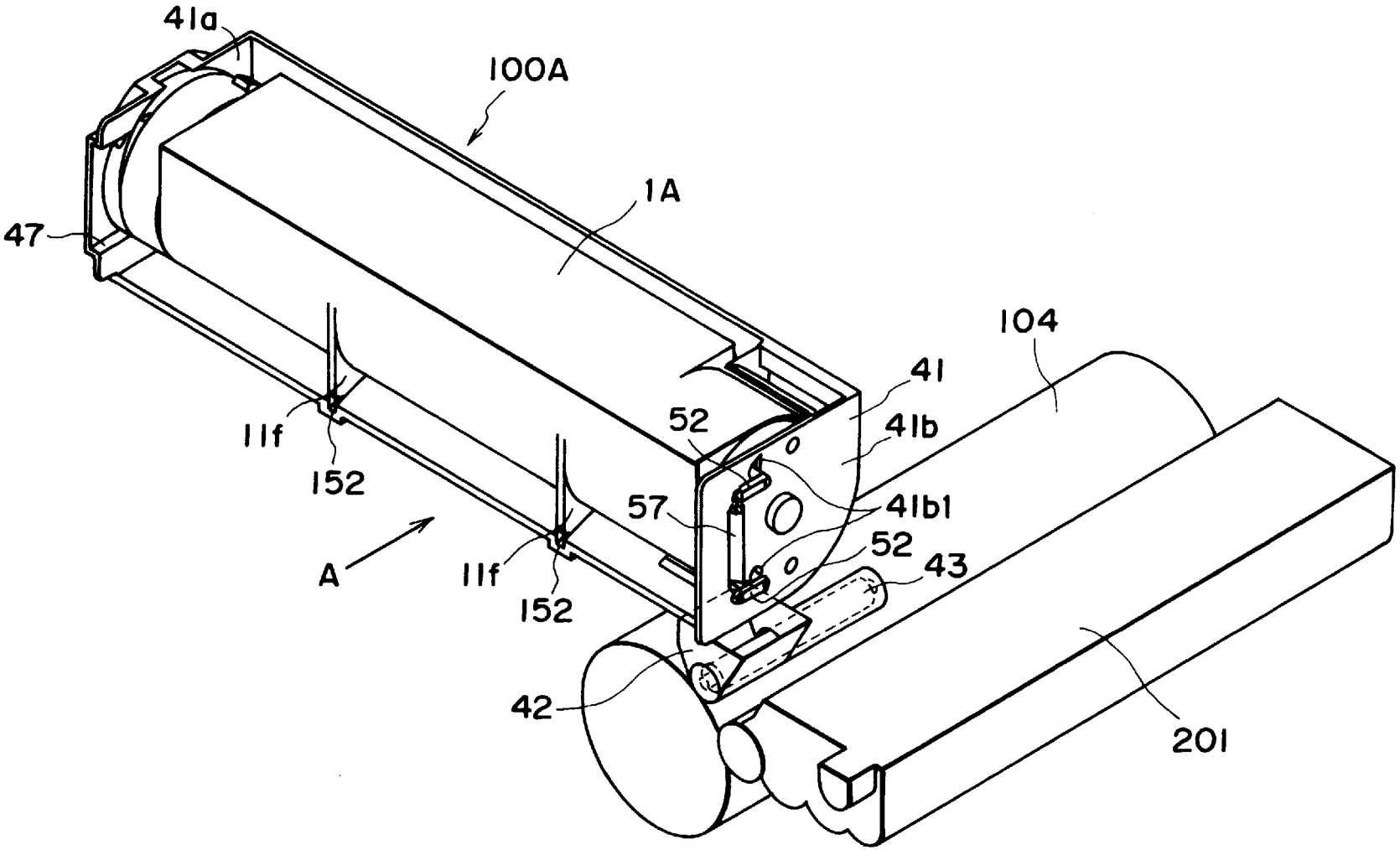

FIG. 32 is a perspective view of a toner supplying apparatus of Embodiment 5 and a developing device.

Figure 33:
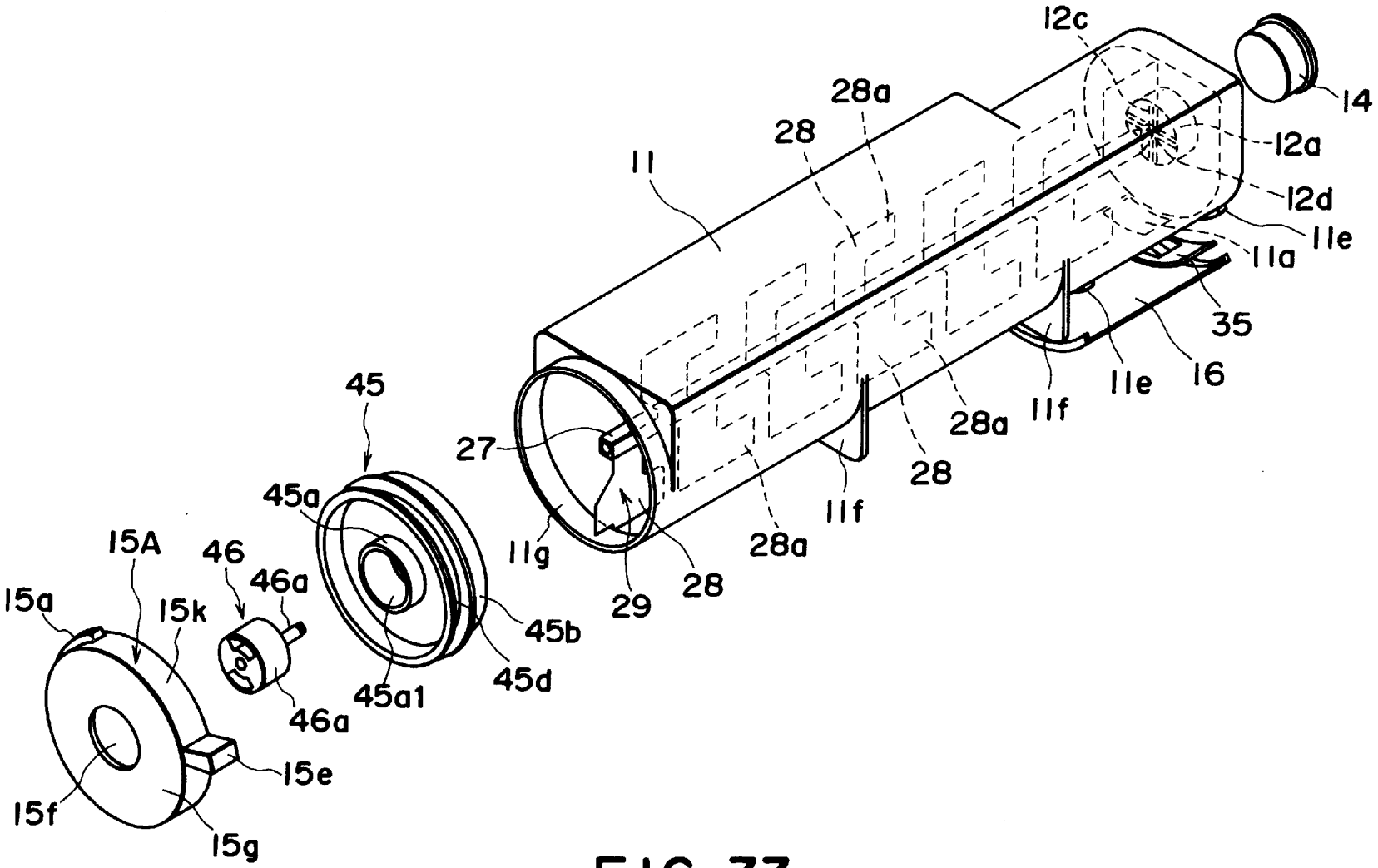

FIG. 33 is an exploded perspective view of a toner supply container according to Embodiment 5 of the present invention.

Figure 34:
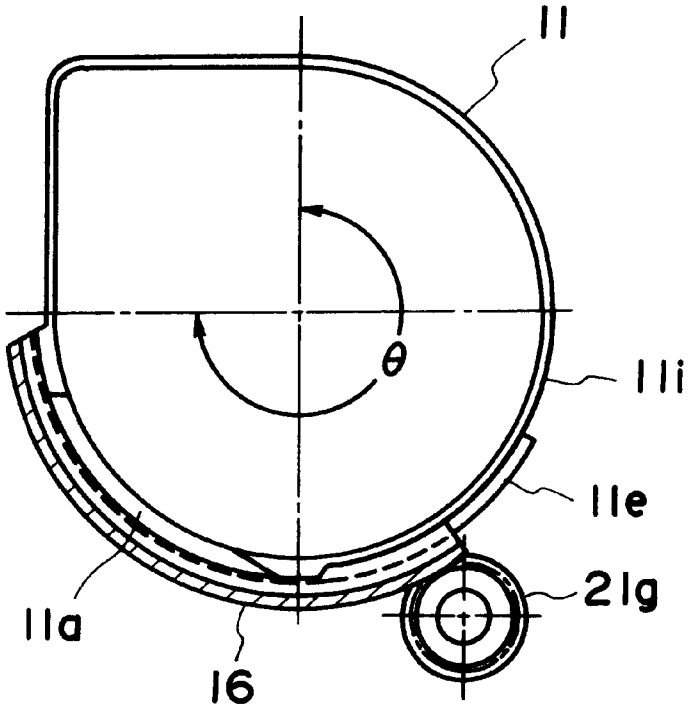

FIG. 34 is a longitudinal sectional view of a toner supply container of Embodiment 5.

Figure 35:
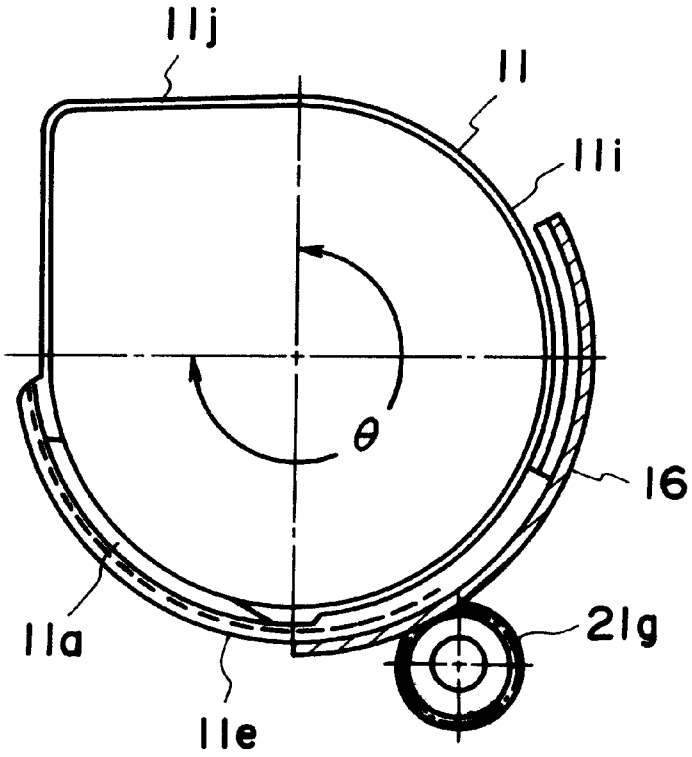

FIG. 35 is a longitudinal sectional view of a toner supply container of Embodiment 5.

Figure 36:
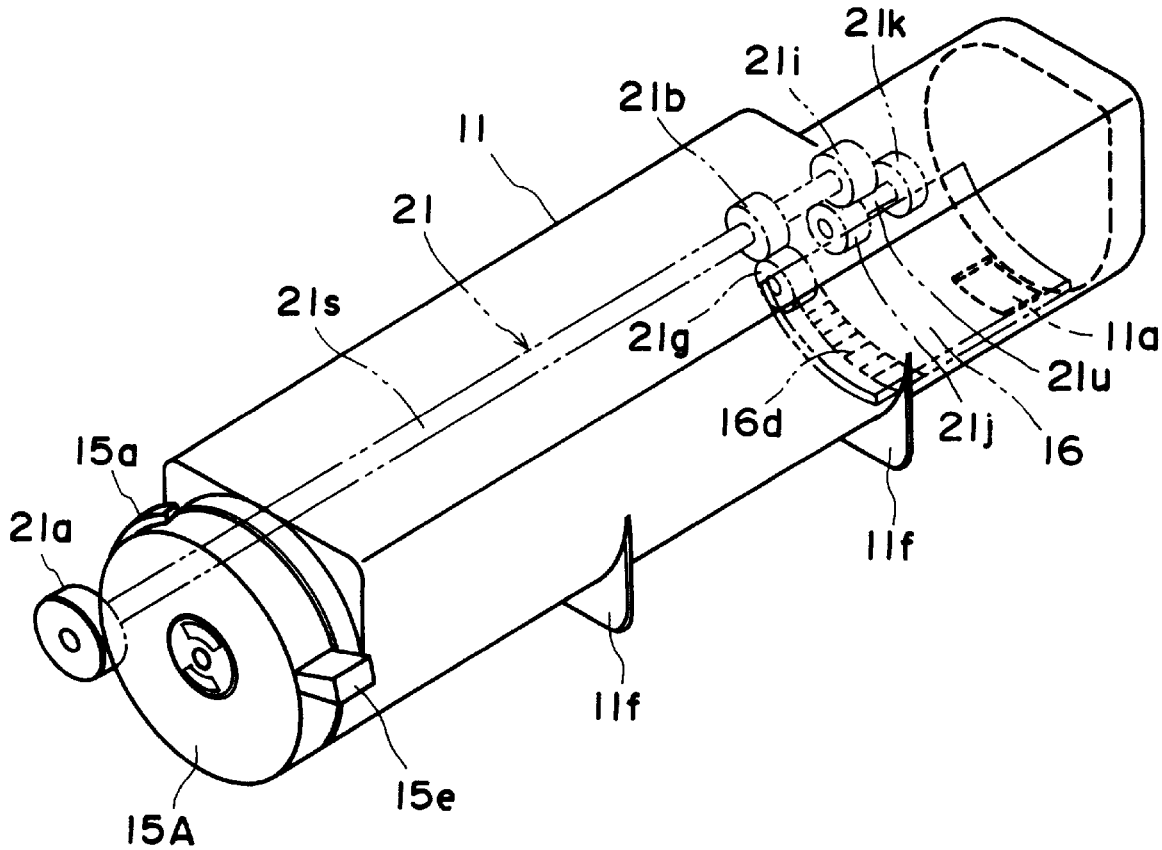

FIG. 36 is a perspective view illustrating an engaging relation between the main assembly of the apparatus and the toner supply container according to Embodiment 5 of the present invention.

Figure 37:
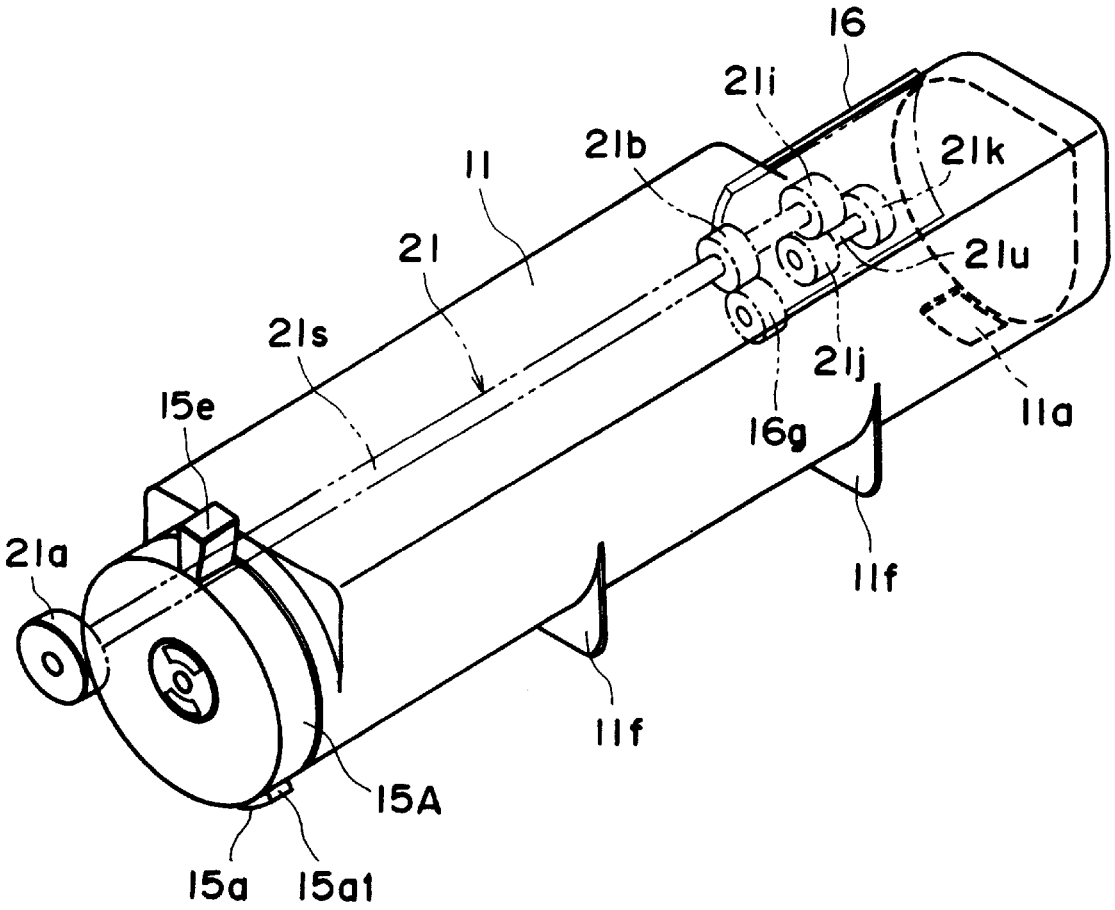

FIG. 37 is a perspective view illustrating an engaging relation between the main assembly of the apparatus and the toner supply container according to Embodiment 5 of the present invention.

Figure 38:
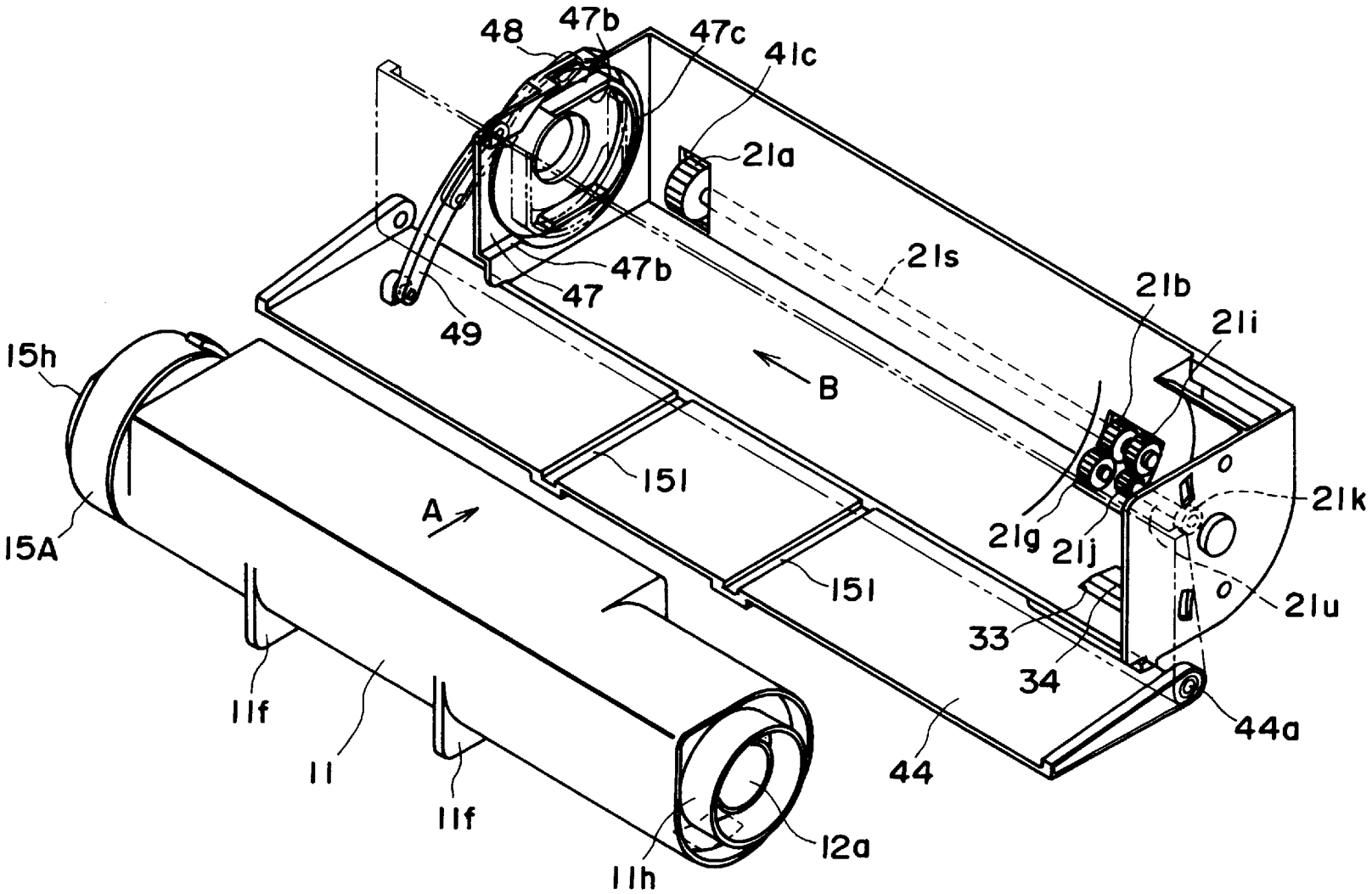

FIG. 38 is a perspective view of a toner supplying apparatus according to Embodiment 5 of the present invention.

Figure 39:
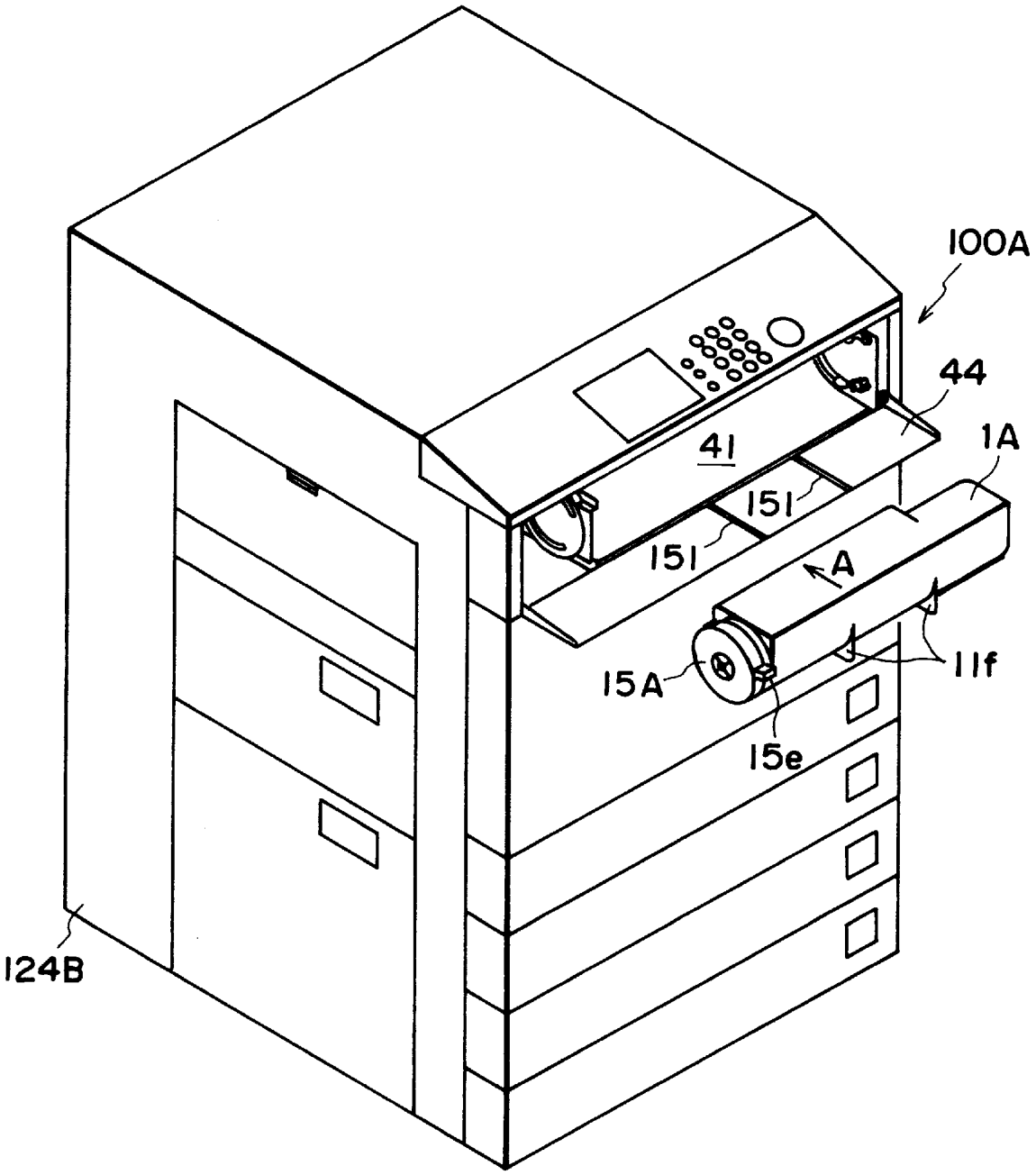

FIG. 39 is a perspective view of an image forming apparatus according to Embodiment 5 of the present invention.

Figure 40:
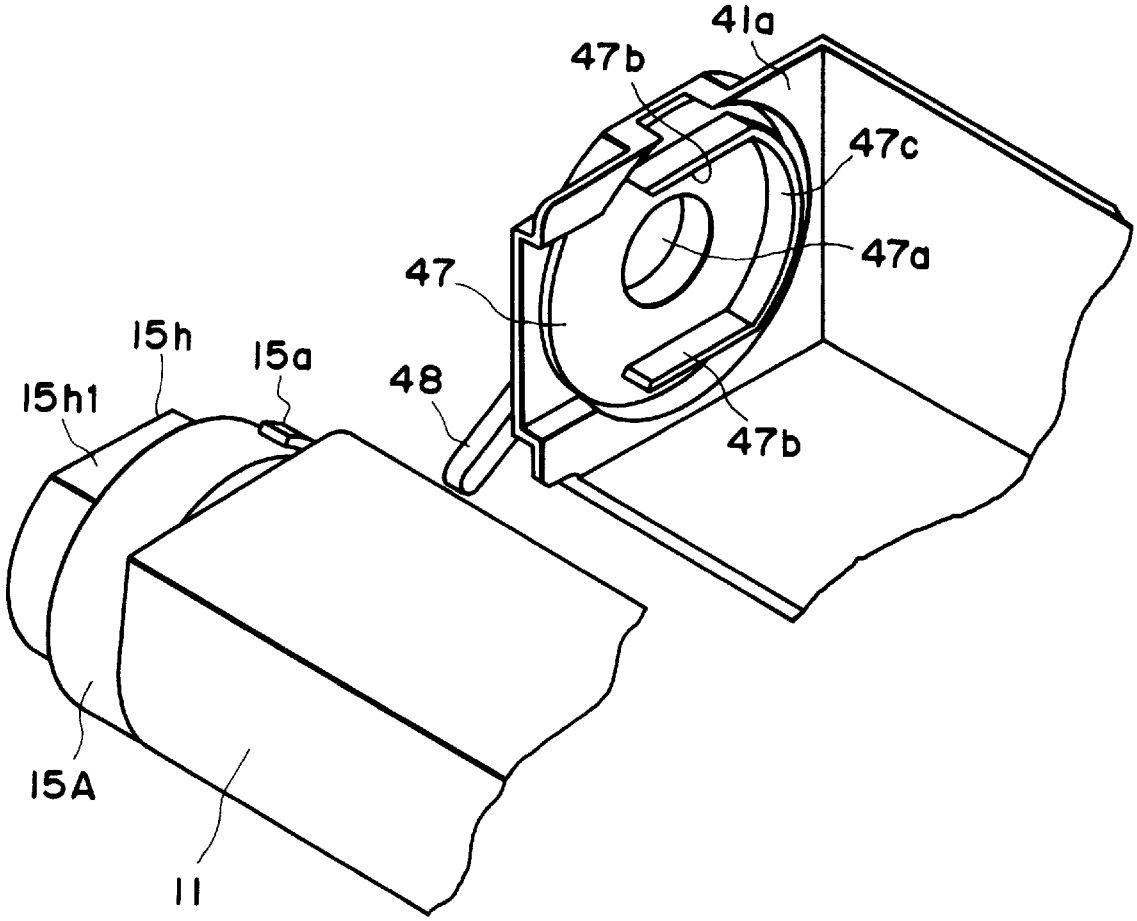

FIG. 40 is a perspective view of a driving side of a toner supplying apparatus according to Embodiment 5 of the present invention.

Figure 41:
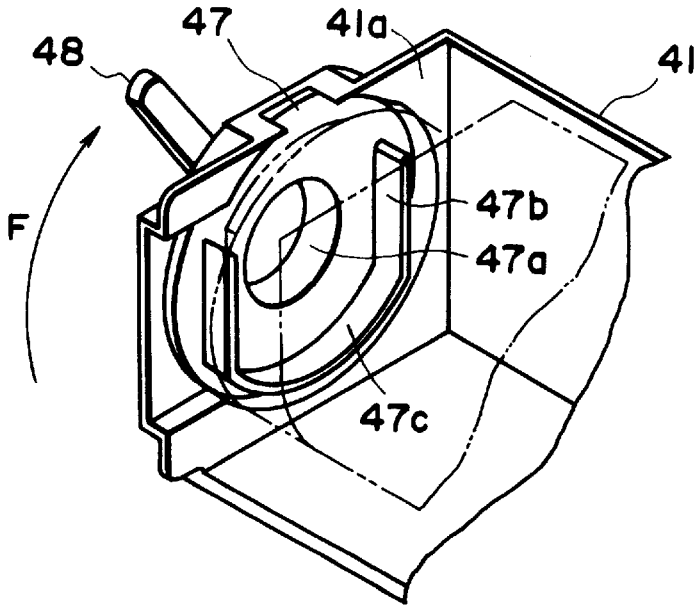

FIG. 41 is a perspective view of a driving side of a toner supplying apparatus according to Embodiment 5 of the present invention.

Figure 42:
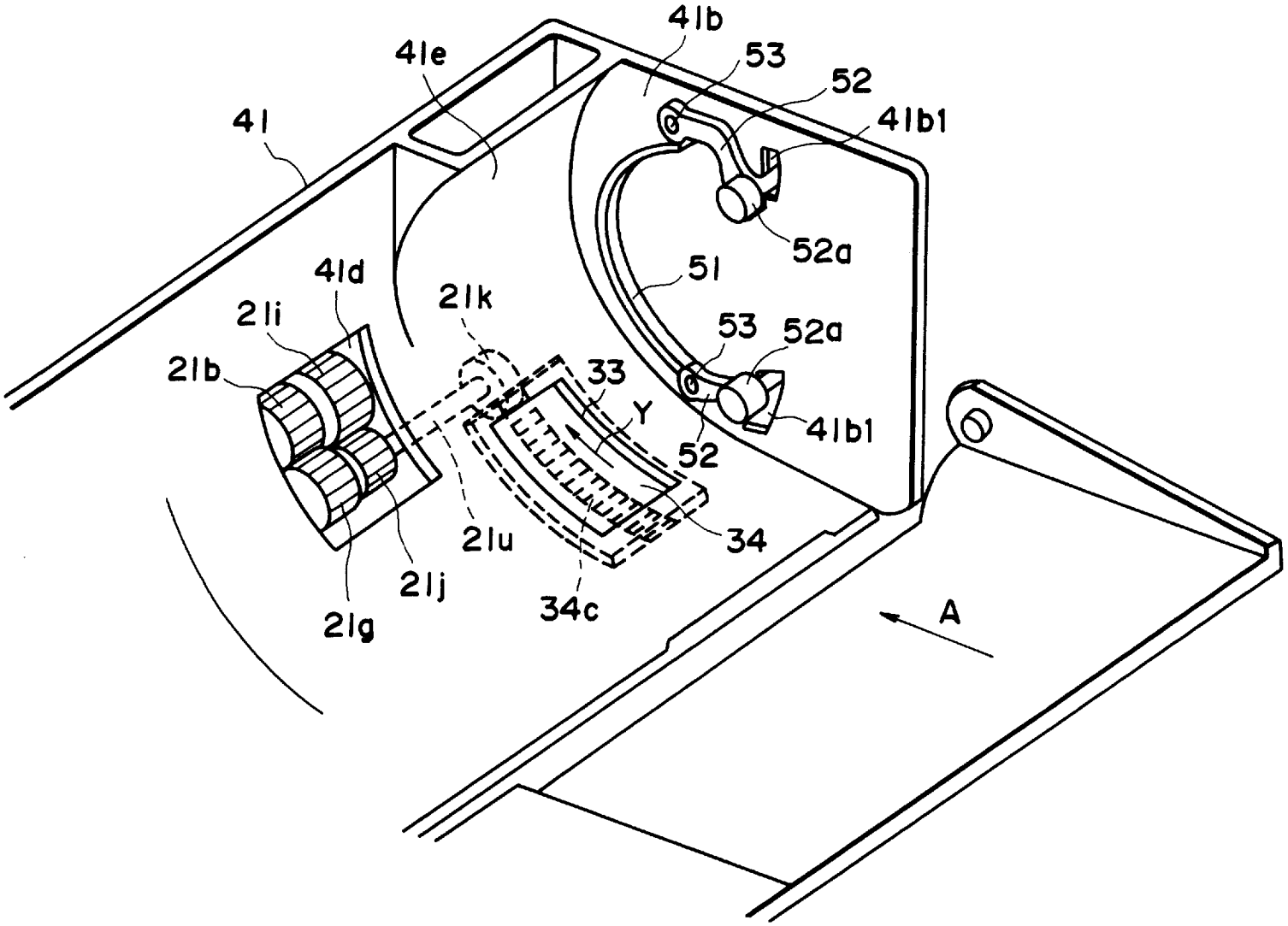

FIG. 42 is a perspective view of a non-driving side of a toner supplying apparatus of Embodiment 5 of the present invention.

Figure 43:
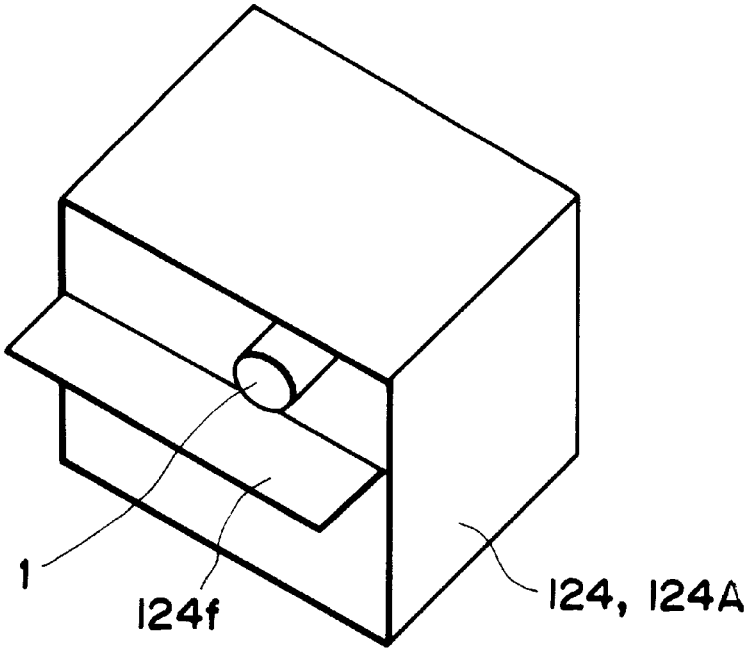

FIG. 43 is a perspective view of an image forming apparatus illustrating an interrelation between the front door and the shutter of the toner supply container.

Figure 44:
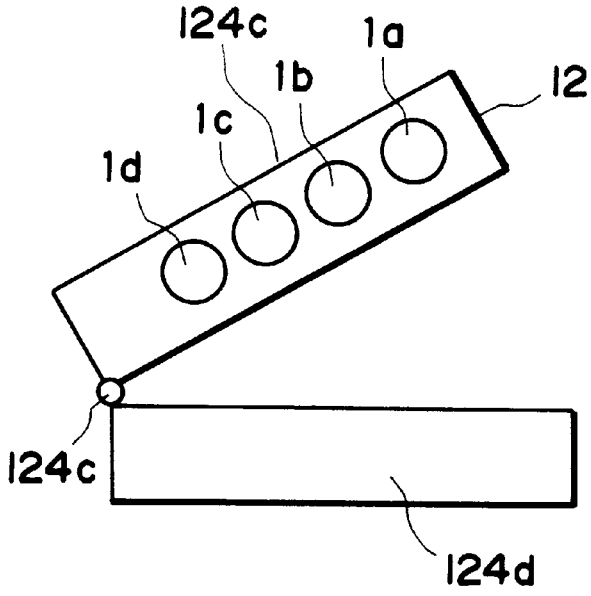

FIG. 44 is a side view of an image forming apparatus including a main assembly of a clam-shell type image forming apparatus.

DESCRIPTION OF THE PREFERRED EMBODIMENTS

First, Embodiment 1 will be described. Then, other embodiments will be described.

The embodiments are directed to a toner supply container for supplying toner to a main assembly of an electrophotographic image forming apparatus, comprising:

a toner accommodating portion of accommodating toner;

toner discharging opening, provided in the toner accommodating portion, for discharging the accommodated toner;

an openable member for openably sealing the toner discharging opening and;

a driving force receiving portion for receiving driving force for moving the openable member to open the toner discharging opening when it is mounted to the main assembly of the electrophotographic image forming apparatus.

Embodiment 1

Electrophotographic Image Forming Apparatus

FIG. 20 is a longitudinal sectional view of an electrophotographic image forming apparatus (image forming apparatus) loaded with a toner supply container according to an embodiment of the present invention.

An original 101 is placed on an original supporting platen glass 102 by an operator. A light image of the original is formed on a photosensitive drum 104 by a plurality of mirrors and a lens of an optical system 103. On the other hand, a size of the recording material (sheet of paper, OHP sheet or the like) is selected from the recording materials P stored in feeding cassettes 105–108 on the basis of the information inputted by the operator. One of the rollers is selected from the pick-up rollers 105A–108A which corresponds to the selected feeding cassette, is rotated. The sheet is fed to a registration roller 110. The registration roller 110 feeds the sheet P to the photosensitive drum 104 in synchronism with the timing of scanning operation of the optical portion 103 and with the rotation of the photosensitive drum 104. Onto the sheet P, a toner image is transferred from the photosensitive drum 104 by transferring means 111. Thereafter, the sheet P is separated from the photosensitive drum 104 by separating means 112. Then, the sheet P is fed to a fixing portion 114 by a feeding portion 113. The toner image is fixed on the sheet P by heat and pressure in the fixing portion 114. Thereafter, 1) in the case of a one-sided copy (copy only on one side of the sheet), the sheet P is passed through a sheet reversing portion 115 and is then discharged to a tray 117 by discharging rollers 116.

2) in the case of a superimposed copy mode, the sheet P is fed to feeding paths 119, 120 by a flapper 118 in the reversing portion 115. The sheet reaches the registration roller 110. Thereafter, similarly to the operation described above, the sheet is fed through the image formation station, the feeding portion and the fixing portion, and then is discharged to the tray 117.

3) in the case of a duplex copy, the sheet P is fed through the reversing portion 115 and is partly discharged by the discharging roller 116 tentatively. Then, the terminal end of the sheet P is passed through the flapper 118, and then, the discharging roller 116 is rotated in the opposite direction. The sheet P is fed into the apparatus, again. The sheet P is fed to feeding portions 119, 120 and is fed to the registration roller 110. Similarly to the operation described above, the sheet is fed through the image formation station, the feeding portion and the fixing portion, and is then discharged to the tray 117.

In the electrophotographic image forming apparatus having the structures described above, there are provided, around the photosensitive drum 104, a developing device 201, a cleaning means 202 and a primary charging means 203. The developing device 201 functions to develop an electrostatic latent image formed on the photosensitive drum 104 with toner. A toner supply container 1 for supplying the toner to the developing device 201 is demountably mounted to the main assembly 124 of the apparatus.

Here, the developing device 201 includes a developing roller 201*a* which is spaced from the photosensitive drum 104 by a small gap (approx. 300 μm). Upon the developing operation, a thin toner layer is formed on a peripheral surface of the developing roller 201*a* by a developing blade 201*b*. The electrostatic latent image formed on the photosensitive drum 104 is developed by application of a developing bias to the developing roller 201*a*. The charging means 202 functions to charge the photosensitive drum 104. The cleaning means functions to remove the toner remaining on the photosensitive drum 104.

The amount of the toner decreases with the developing operation executed, and the toner is gradually supplied from the toner supply apparatus 100.

The description will be made as to exchange of the toner supply container 1.

First, shortage of the toner in the toner supply apparatus 100 is notified to a notification portion 124*a*. Then, the operator, as shown in FIG. 21, opens an openable member 121 for closing the opening 122, formed in the main assembly 124 of the apparatus. At a rear portion of the opening 122, a holder 31 (mounting means) is provided to permit the toner supply container 1 to be demountably mounted. The toner supply container 1 is inserted into the holder 31 in a longitudinal direction thereof. At this time, the container 1 is guided by a guide extended along the longitudinal direction of the holder 31, and is inserted to a predetermined position. After the insertion, the operator rotates the handle 15 of the toner supply container 1, by which the toner is supplied from the toner supply container 1 into the developing device 201. When the openable member 121 is closed by the operator, a main switch is actuated so that image forming apparatus is made operable.

When a sensor (unshown) generates a signal indicative of the toner t decrease in the developing device 201, the toner feeding member 29 rotates. By this, the toner is gradually supplied into the developing device 201 from the container 11. When the amount of the toner reaches a predetermined level, the feeding member 29 is stopped. This operation is repeated. When the toner is not supplied even when the sensor produces the signal, the display is made on the notification portion 124*a* to promote the operator to exchange the toner supply container. Designated by 201*c* and 201*d* are toner feeding members in the developing device.

Toner Supply Container

Figure 1:
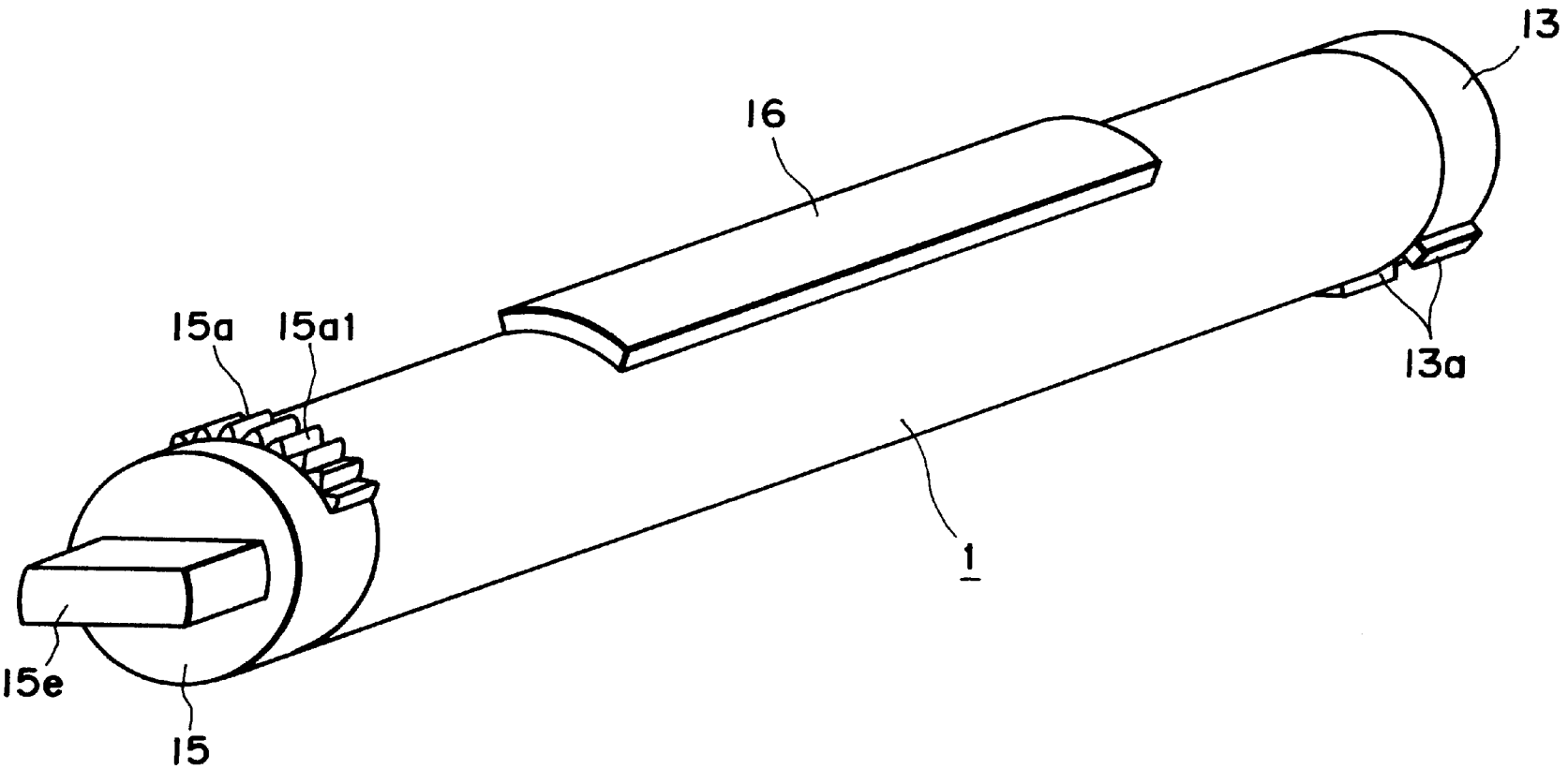
FIG. 1 is a perspective view of a toner supply container according to Embodiment 1 of the present invention.

The toner supply container 1 (FIG. 1) of this embodiment is mounted to the toner supply apparatus 100 of the image forming apparatus. It is kept placed in the image forming apparatus, and supplies the toner into the developing device gradually until the toner accommodated therein is used up. It is a so-called leaving (built-in) type. However, the present invention is not limited to the leaving type but is usable with a so-called removing type.

Figure 2:
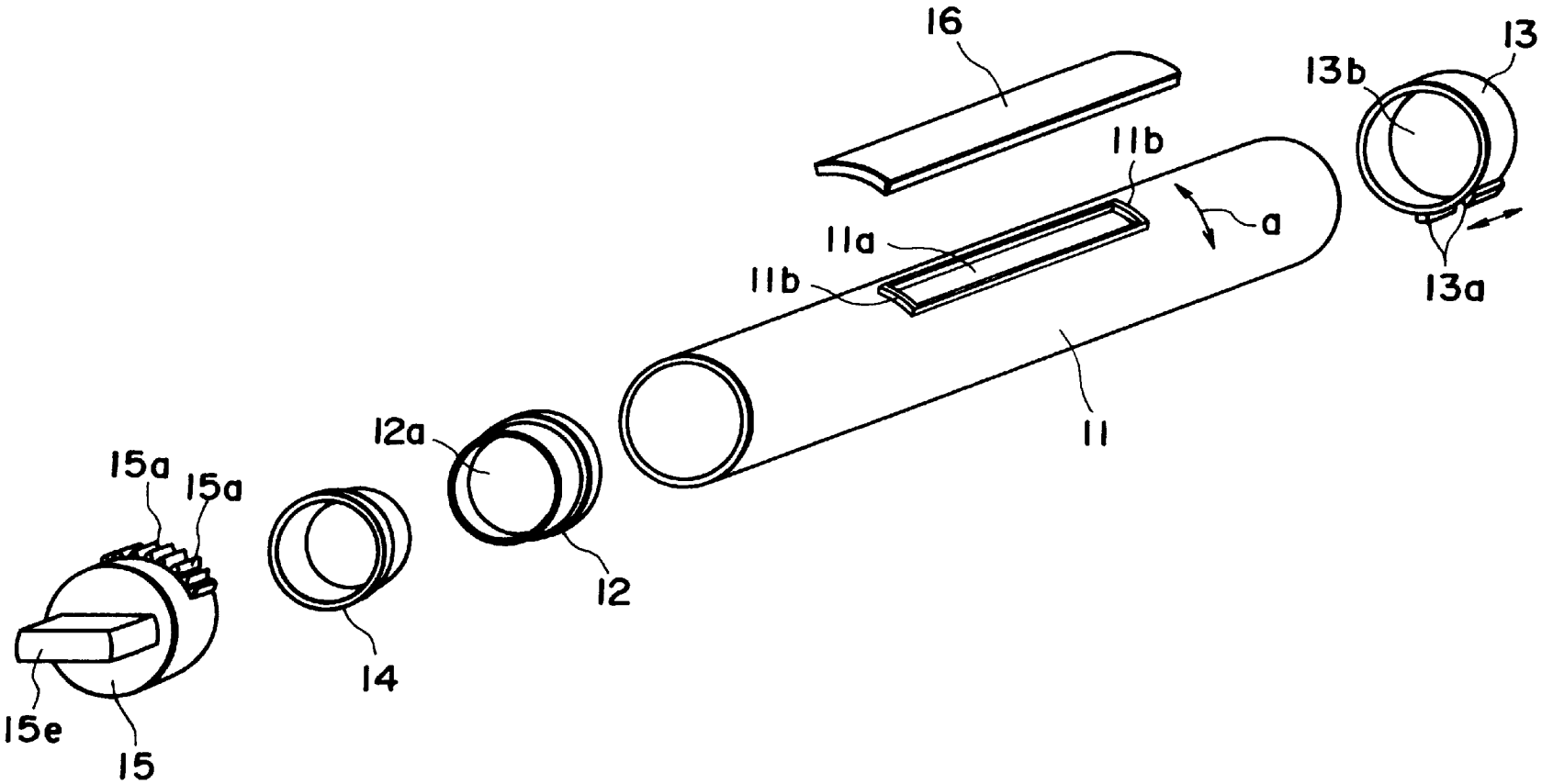
FIG. 2 is an exploded perspective view of a toner supply container of Embodiment 1.
Figure 3:
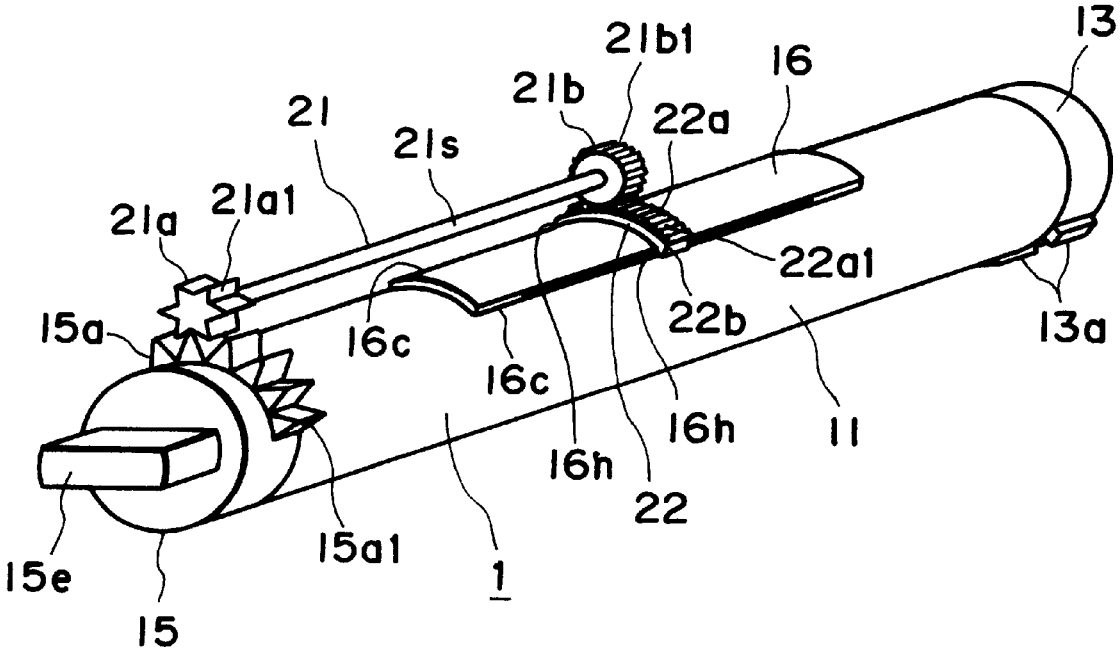
FIG. 3 is a perspective view illustrating an engaging relation between the main assembly of the apparatus and the toner supply container of Embodiment 1.

The toner supply container 1, as shown in FIG. 2 (exploded view), comprises a toner container 11 (toner accommodating portion), a first flange 12 and a second flange 13 mounted to the respective longitudinal ends of the toner container 11. It further comprises a cap 14 engaged into the first flange 12 and a handle 15 engaged rotatably with the first flange 12. Furthermore, it comprises a shutter 16 for opening and closing the toner discharging opening 11*a* of the toner container 11. A toner stirring member may be provided in the toner container 11 to feed the toner.

Structure of Toner Accommodating Portion

The toner container 11 is a hollow cylindrical member. A toner discharging opening 11*a* is formed in a circumference thereof. Engaging portions 11*b* a provided at lateral end portions of the toner discharging opening 11*a*. The engaging portions 111*b* are engaged with a shutter 16 to open and close the shutter 16 in the circumferential direction (direction indicated by an arrow).

In this embodiment, the configuration is cylindrical, but it is not inevitable. For example, the cross-section may be elliptical, or a configuration having a corner of corners. The structure of the toner container 11 and the number of parts in this embodiment are not inevitable, either. The toner container 11 is filled with powdery toner. The toner may be black chromatic toner, chromatic toner which may be one component magnetic toner, one component non-magnetic toner or the like.

Structure of First and Second Flanges 12, 13

The first flange 12 and the second flange 13 are hollow cylindrical members. They are engaged with and bonded to the respective longitudinal ends of the toner container 11. They seal the toner container 11. The first flange 12 is provided with an opening 12*a* for filling the toner. The opening 12*a* is sealed by a cap 14 after the container 11 is filled with the toner. The second flange 13 has an end plate 13*b*. The second flange 13 is provided with a projection 13*a* extended in the longitudinal direction on the outer surface. The projection 13*a* functions to position the container 1 in the circumferential direction when it is inserted into the main assembly of the image forming apparatus. It also functions to prevent rotation of the container 11 in the main assembly of the apparatus. The position of the projection 13*a* may be changed depending on the color of the toner accommodated in the container 1 to prevent mounting at an erroneous position.

The projection 13*a* may be provided on the first flange 12 or on the toner container 11. However, from the standpoint of operativity, it is preferably provided on the second flange 13. When the projection 13*a* is provided on the second flange 13, the positioning can be easily controlled by the operator when it is inserted. In addition, the event of the erroneous mounting can be quickly recognized.

The first flange 12 or the second flange 13 may be formed integrally with the toner container 11 or a part of the toner container 11. If the second flange 13 has a particular noncylindrical cross-section, the projection 13*a* may not be provided.

Structure of the Rotatable Member

The rotatable handle 15 is a cylindrical member. One end thereof is provided with a rectangular grip 15*e*. The other end is hollow and cylindrical, and is open. The handle 15 is rotatably connected with the first flange 12. The handle 15 is provided with an engaging portion 15*a* for transmitting a driving force along a part of the outer periphery thereof. The engaging portion 15*a* has a gear. The engaging portion 15*a* is engaged with a gear as a driving force reception side engaging portion 21*a* provided in a driving force transmission member 21 (rotating force transmission member) in the main assembly 124 of the apparatus, when the toner supply container 1 is mounted to the main assembly 124 of the image forming apparatus. The engaging portion 15*a* is engageable with a driving force reception side engaging portion 21*a* in a series of operations for mounting the toner supply container 1 to the main assembly 124 of the apparatus. Therefore, the engaging portion 15*a* is preferably provided on the outer surface of the handle 15. The driving force transmission member 21 includes a driving force reception side engaging portion 21*a* and a driving force transmission side engaging portion 21*b* at the opposite ends of the shaft 21*s* rotatably supported on the main assembly 124 of the apparatus. The shaft 21*s* is mounted to the main assembly 124 of the apparatus by a bearing (unshown).

The engaging portion 15*a* and the engaging portion 21*a* provided at one end of the driving force transmission member 21, the engaging portion 21*b* provided at the other end of the driving force transmission member 21 and the driving force reception side engaging portion 22*a* of the shutter 16, are gears engageable with each other. The gear has teeth arranged along a circumferential direction of the container. It is not limited to a gear, but may be a friction wheel, a pin wheel, or may be a gear having one teeth (projection) when the angle of rotation required for the opening and closing of the shutter 16 is small (this applies to the other embodiments).

Figure 7:
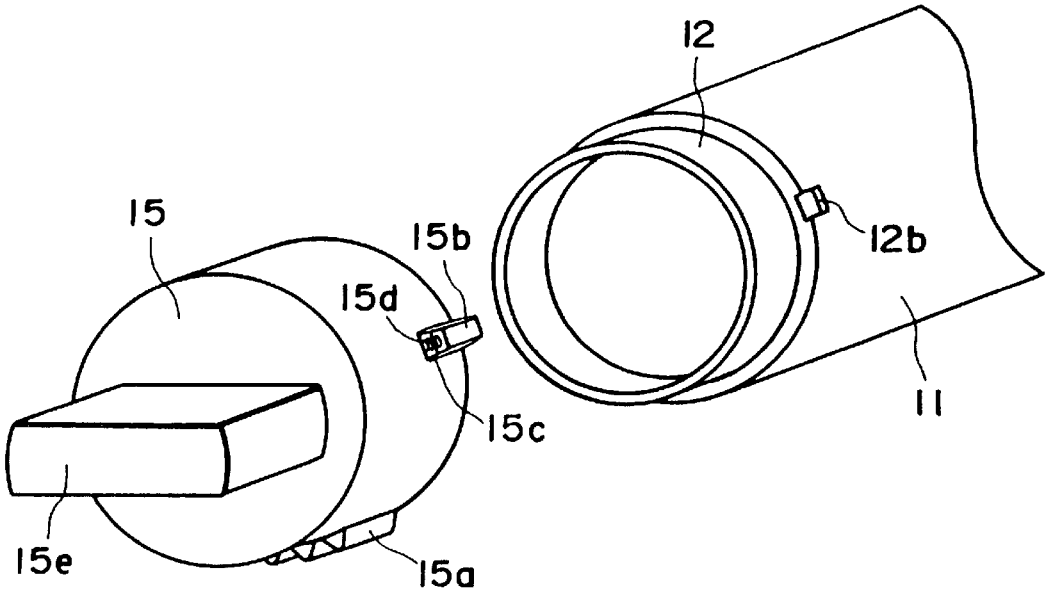
FIG. 7 is a perspective view of a locking mechanism of a toner container and a handle in Embodiment 1.

A locking member 15*b* is provided (FIGS. 7, 8) to lock the handle 15 to the toner container 11 before the toner supply container 1 is mounted to the main assembly 124 of the image forming apparatus and after it is demounted therefrom. The locking member 15*b* is engaged with an elongated groove 15*c* formed in the outer periphery of the cylindrical of the handle 15, for movement in the longitudinal direction. A compression coil spring 15*d* is provided between the end of the groove 15*c* and the locking member 15*b*. When the toner supply container 1 is out of the main assembly 124 of the apparatus, the locking member 15*b* is engaged with the hole portion 12*b* of the toner container 11 by the spring force of the spring 15*d*. Therefore, the handle 15 is not rotatable. Structure of the locking mechanism is not limited to this, if it is engageable with the toner container 11 and is releasable upon the mounting of the container. The locking mechanism may be omitted, if not necessary.

On the other hand, a main assembly projection 23 is fixed to a toner supplying apparatus 100 of the main assembly 124 of the apparatus. The main assembly projection 23 prevents movement of the locking member 15*b* in the process of mounting the toner supply container 1 to the toner supplying apparatus 100. Therefore, the locking member 15*b* retracts and disengages from the hole portion 12*b*. Then, the handle 15 becomes rotatable.

Toner Feeding Member

Figure 19A:
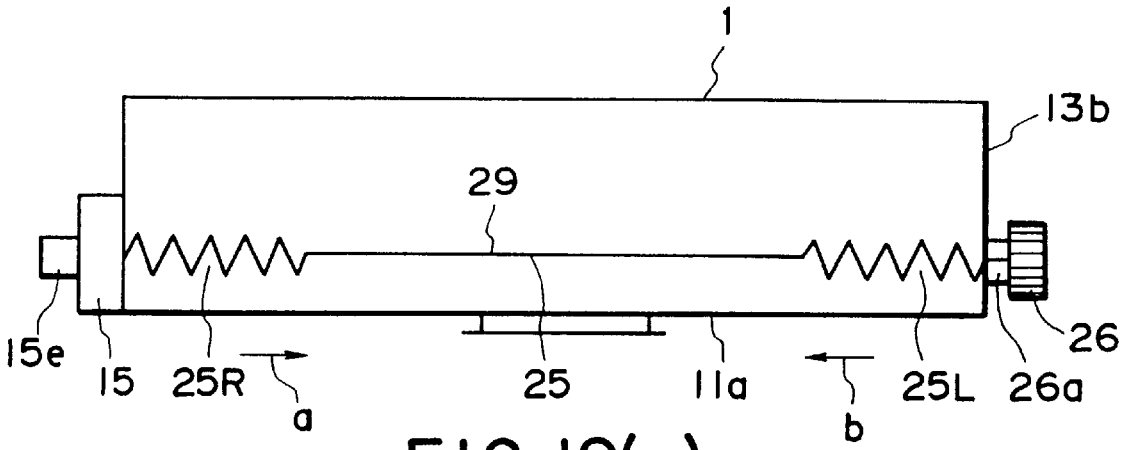
FIG. 19(*a*) and FIG. 19(*b*) are longitudinal sectional views schematically showing a toner feeding apparatus.
Figure 19B:
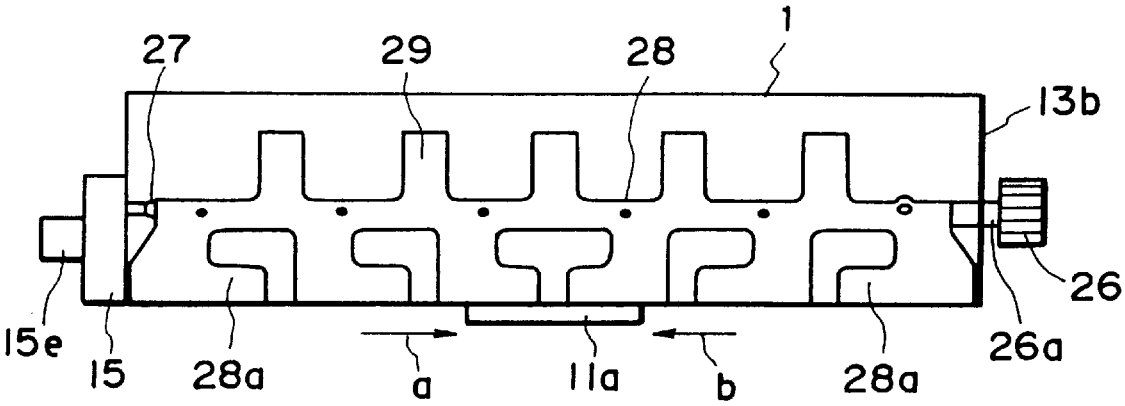

As shown in FIG. 19, a screw 25 is provided in the toner supply container 1. The screw 25 is provided with screw blades 25R, 25L which are twisted in different directions. As indicated by arrows a and b, they feed the toner in the toner container 11 toward the toner discharging opening 11*a*. The screw 25 is supported rotatably on the end plate 13*b* of the second flange 13. The gear 26 is fixed to the shaft of the screw 25 outside the end plate 13*b*. When the toner supply container 1 is mounted to the main assembly 124 of the apparatus, the gear 26 is brought into meshing engagement with a gear (unshown) which is eventually engaged with the driving source in the main assembly 124 of the apparatus.

As shown in FIG. 19(*b*) the toner feeding member may be a feeding blade 28. The feeding blade 28 is rotatably supported on the end plate 13*b* of the second flange 13. It is fixed to a feeding shaft 27 fixed to the gear 26 outside the end plate 13*b*. It is made of a flexible material such as a plastic resin material or the like. The feeding blade 28 is provided with a plurality of blades each having a claw portion 28*a* inclined toward the toner discharging opening 11*a*. Therefore, as shown in Figure indicated by the arrows a, b, it can feed the toner in the toner container 11 toward the toner discharging opening 11*a*.

Structure of the Shutter 16

The shutter 16 which is an openable member, is engaged with an engaging portion 11*b* provided around the toner discharging opening 11*a*. It slides along the circumference to open and close the toner discharging opening 11*a*. The cross-section (taken along a line perpendicular to the longitudinal direction of the toner supply container 1) of the shutter 16 is arcuated so as to be extended along the outer surface of the toner container 11.

When the toner supply container 1 is mounted to the main assembly 124 of the apparatus, the shutter 16 is brought into engagement with a shutter engageable member 22 which is provided in the main assembly 124 of the apparatus and which is interrelated with the engaging portion 21*b*. In other words, the engaging portion 21*b* and the engageable member 22 are provided in the main assembly of the apparatus. When the container 1 is mounted to the main assembly 1 of the apparatus in the longitudinal direction, the engageable member 22 is engaged with the shutter 16.

Figure 4A:
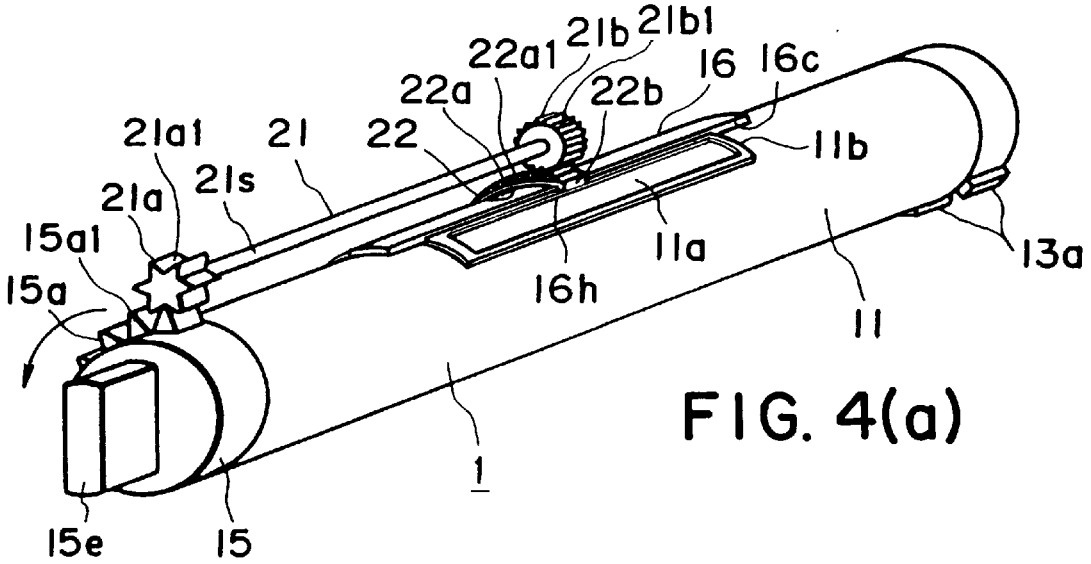
FIG. 4(*a*) is a perspective view of the toner supply container of Embodiment 1 in a toner supplying operation, and 4(*b*) is a sectional view of an engageable member shown in (*a*), 4(*c*) is a perspective view of an engageable member of another example.
Figure 4B:
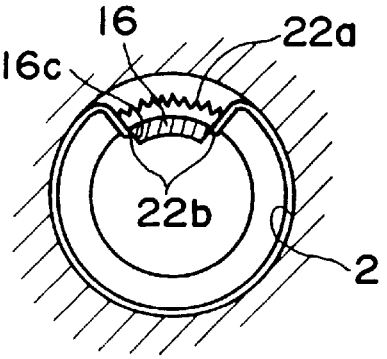
Figure 4C:
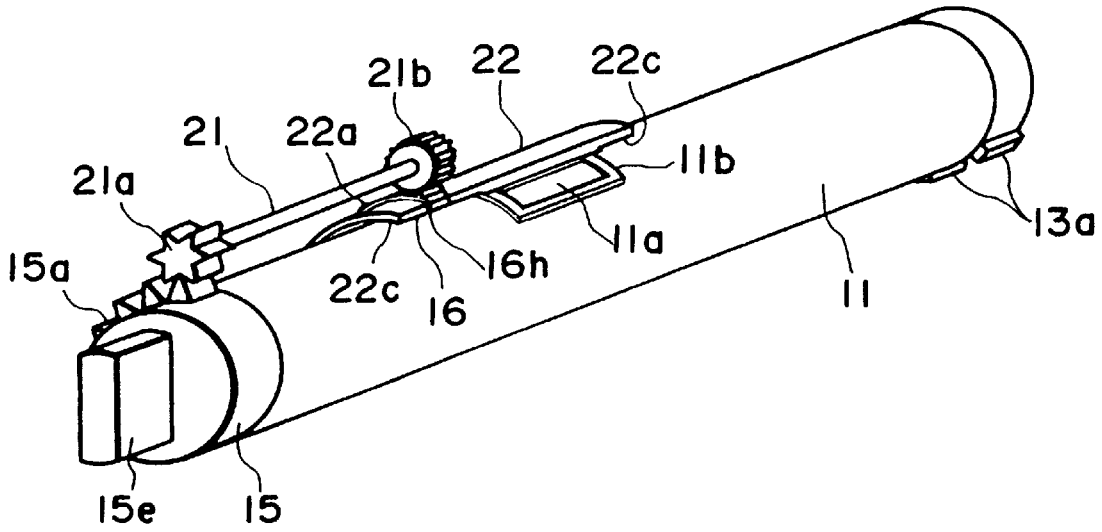
Figure 5:
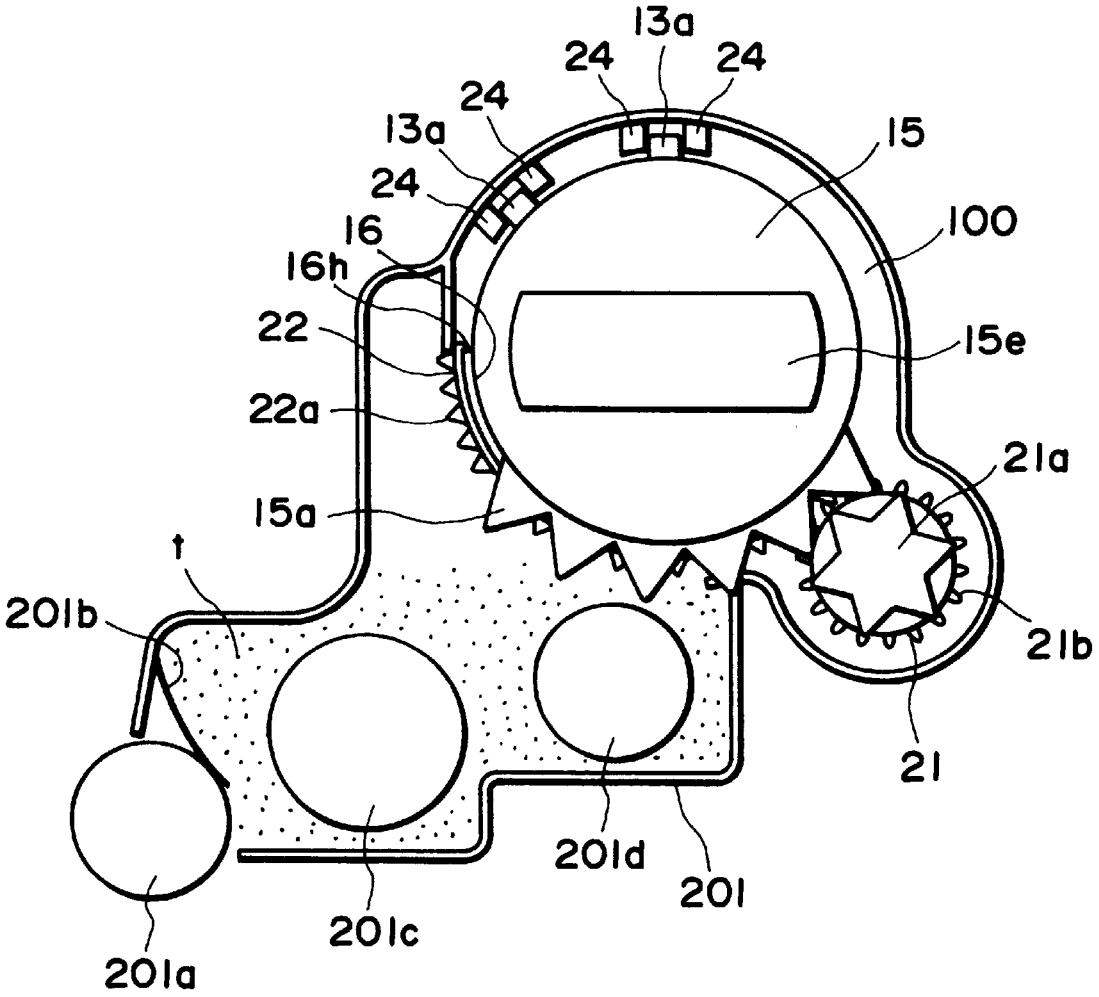
FIG. 5 is a longitudinal sectional view illustrating an engaging relation between the main assembly of the apparatus and the toner supply container of Embodiment 1.

As shown in FIG. 4(*b*), the shutter engageable member 22 is supported to the bearing portion 2 provided in the main assembly 124 of the apparatus such that it is rotatable but not movable in the axial direction. The outer periphery is provided with a driving force reception side engaging portion 22*a* (rotating force receiving portion) for receiving the rotating force from the handle 15. The engageable member 22 is provided with an engaging portion 22*b* for engagement with the both edges 16*c* (in the container inserting direction of the shutter 16). The engaging portion 22*a* has a plurality of teeth. The shutter 16. receives the rotating force by the contact portion 16h contacted to the engaging portion 22*b*. Thus, portion 16*h* is a rotating force receiving portion.

FIG. 4(*c*) shows another embodiment. In this embodiment, the engageable member 22 is engaged with a rail portion (unshown) provided in the toner supplying apparatus 100 and moves in the circumferential direction, by the provision of the sliding portion 22*c* at the opposite axial ends. It also functions as a shutter mechanism for opening and closing the toner supply opening communicating to the developing device 201 from the toner supplying apparatus 100.

Toner Supplying Operation

The description will be made as to a toner supplying operation using the toner supply container 1 according to this embodiment of the present invention.

(1) mounting of the toner supply container 1

Figure 8A:
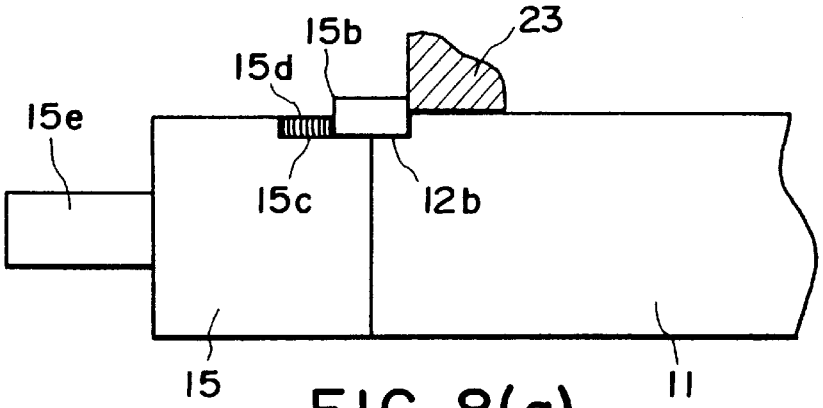
FIG. 8(*a*) and FIG. 8(*b*) are sectional views of a locking mechanism of the toner container and the handle of Embodiment 1.
Figure 8B:
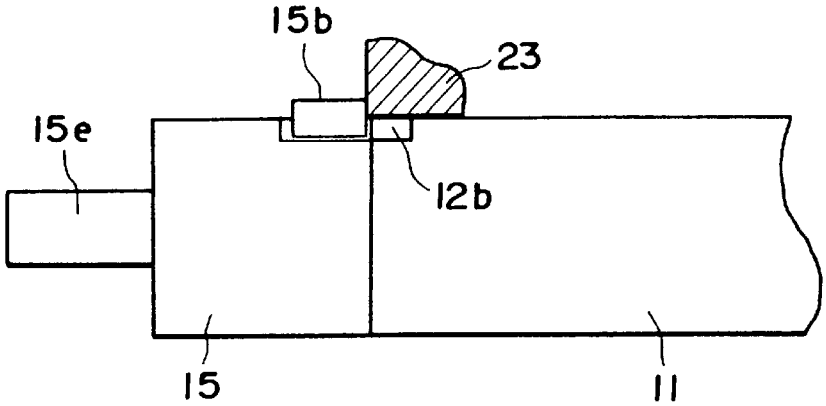

The toner supply container 1 having the structures described above, is inserted into the toner supplying apparatus 100 of the main assembly 124 of the apparatus in the direction of arrow c (FIG. 21). At this time, the projection 13*a* of the toner supply container 1 is engaged with the engaging portion 24 of the main assembly 124 of the apparatus. First, the engaging portion 22*b* of the engageable member 22 is engaged with the shutter 16. The shutter 16 moves sliding on the engaging portion 22*b*. The engaging portion 21*a* provided in the main assembly 124 of the apparatus is brought into engagement with the engaging portion 15*a* of the handle 15, and the engageable member 22 provided in the main assembly is brought into engagement with the shutter 16. As shown in FIG. 8(*a*) and FIG. 8(*b*), the locking member 15*b* is stopped by the projection 23. Therefore, the locking member 15*b* enters the groove 15*c* while compressing the compression coil spring 15*d*, and the locking member 15*b* is disengaged from the hole portion 12*b*. By this, the locking between the handle 15 and the toner container 11 is released. Then, the handle 15 becomes manually rotatable relative to the toner container 11.

(2) Toner Supply

Figure 6:
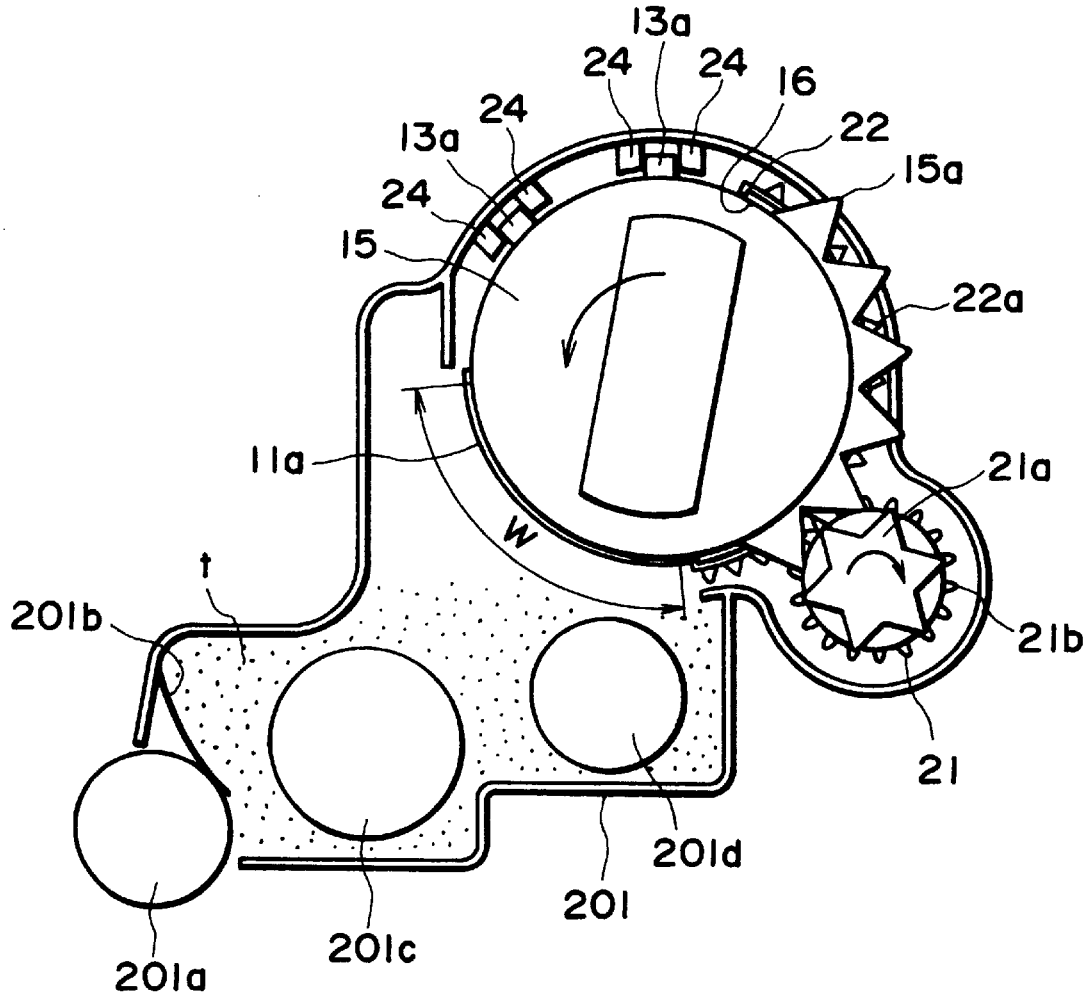
FIG. 6 is a longitudinal sectional view illustrating a relation between the main assembly of the apparatus and the toner supply container of Embodiment 1 in a toner supplying operation.

Referring to FIG. 4(*a*) and FIG. 6, the toner supply will be described. The operator manually rotates the handle 15 in the counterclockwise direction while the toner supply container 1 is in the main assembly 124. By this rotation, the rotational driving force is transmitted to the transmission member 21 provided in the main assembly 124 of the apparatus through the engaging portion 21*a* from the engaging portion 15*a* of the handle 15. The driving force is transmitted to the engageable member 22 through the engaging portion 22*a* interrelated with the engaging portion 21*b*. By the driving force thus transmitted, the shutter 16 slides in the circumferential direction of the container 11. This opened the toner discharging opening 11*a* (width of W) to enable the toner supply. At this time, the projection 13*a* of the container 1 is engaged with the engaging portion 24 provided in the main assembly 124. Therefore, the container 11 is not moved with the rotation of the handle 15.

(3) Dismounting of the Toner Supply Container 1

By the operator rotating the handle 15 in the clockwise direction, the driving force in the opposite direction is transmitted to the shutter 16 in the order similar to operation (2). The shutter 16 closes the toner discharging opening 11*a* (width W). Then, the operator draws the container 1 out of the toner supplying apparatus 100. By this, the locking member 15*b* is engaged with the hole portion 12*b* of the first flange. The handle 15 is locked to the container 11. Thus, a series of the toner supplying operations is completed. In the operations, the container 11 is immovable. Therefore, no limitation is imposed on the configuration of the container 11 (cylindrical is not inevitable). Since the shutter 16 and the handle 15 are separate members from each other, the position of the toner discharging opening 11*a* is not necessarily adjacent to the handle, thus increasing the design latitude of the toner supply container 1. The shutter 16 is permitted to be opened when the container 1 is mounted to the mounting position in the main assembly 124 of the apparatus. Therefore, when the container 1 is out of the main assembly of the apparatus, the shutter 16 is prevented from being opened inadvertently.

The description will be made as to a toner supplying operation.

The container 1 of this embodiment, the rotating force of the handle 15 is transmitted to the shutter 16 through a plurality of engaging portions, namely, the engaging portion 15*a*, the engaging portion 21*a*, the engaging portion 21*b* and the engaging portion 22*a*. Therefore, it is possible to freely use the engagement ratios (gear ratios) in the design of the engaging portions.

When the sliding movement distance of the shutter 16 is long, the engagement ratio of the handle 15 (gear ratio) is made large, so that operation(rotation) distance of the handle 15 can be shortened. When the opening and closing torque of the shutter 16 is large, the engagement ratio (gear ratio) of the handle 15 is made small, so that torque required for the operation (rotation) of the handle 15 can be decreased. Thus, the angle of rotation and/or the operation torque of the handle 15 can be properly selected.

The configuration, the structure and the number of parts of each of the drive transmission member 21, the engageable member 22, the handle 15 and the shutter 16, can be properly selected. The rotational direction of the handle 15 is not limited (this applies to the other embodiments).

Embodiment 2

Referring to FIGS. 9 through 15, Embodiment 2 will be described. The same reference numerals as in Embodiment 1 are assigned to the elements having the corresponding functions, and detailed descriptions thereof are omitted for simplicity.

Figure 9:
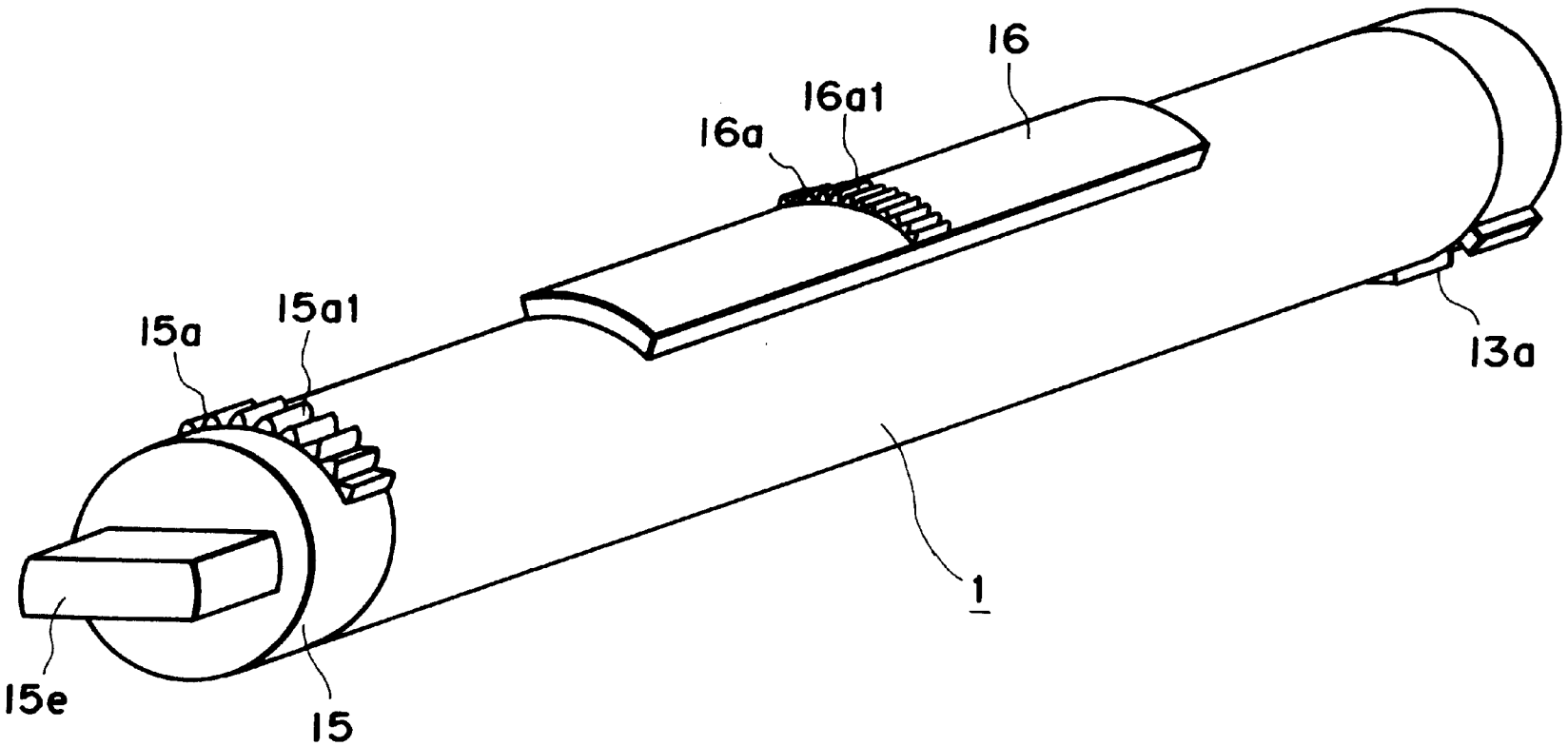
FIG. 9 is a perspective view of a toner supply container according to Embodiment 1 of the present invention.
Figure 10:
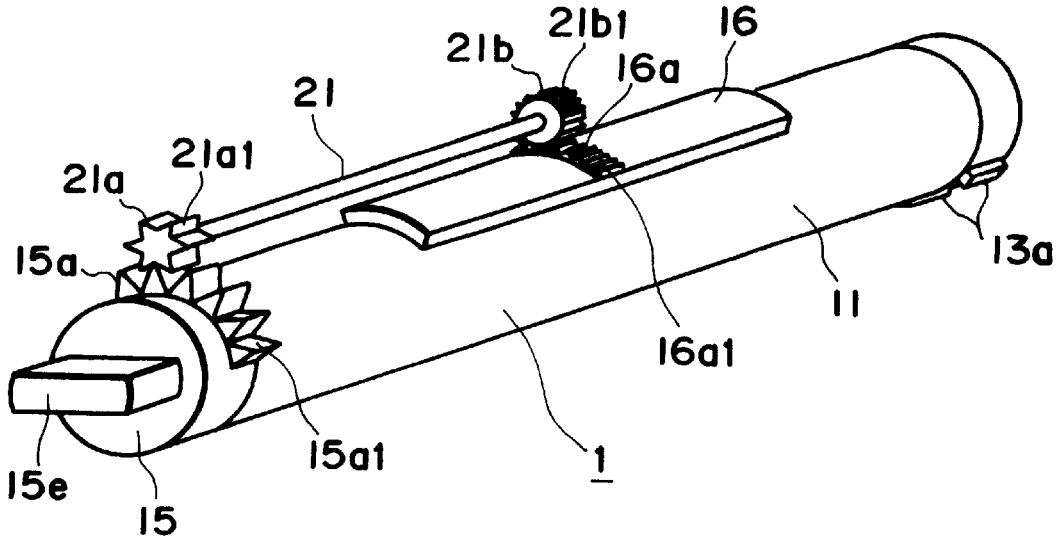
FIG. 10 is a perspective view illustrating an engaging relation between a main assembly of an apparatus and the toner supply container of Embodiment 2.

Embodiment 2 shown in FIG. 9 is different from Embodiment 1 in that driving force reception side engaging portion 22*a* is provided in the toner supply container 1. In other words, the driving force reception side engaging portion 16*a* is provided in the shutter 16 of the toner supply container 1. The engaging portion 16*a* provided in the shutter 16 is engaged with the engaging portion 21*b* in the series of the container 1 inserting operations into the main assembly 124 of the apparatus. The engaging portion 16*a* is provided on the outer surface of the shutter 16. The number thereof is not limited. The engaging portion 16*a* has teeth engaged with the gear of the engaging portion 21*b*.

The engaging portion 16*a* is inserted into the toner supplying apparatus 100 of the main assembly 124 of the apparatus while the projection 13*a* of the container 1 is engaged with the engaging portion 24 of the main assembly 124 of the apparatus. By this, the engaging portion 16*a* is engaged with the driving force transmission side engaging portion 21*b* of the drive transmission member 21 provided in the main assembly 124 of the apparatus.

Figure 11:
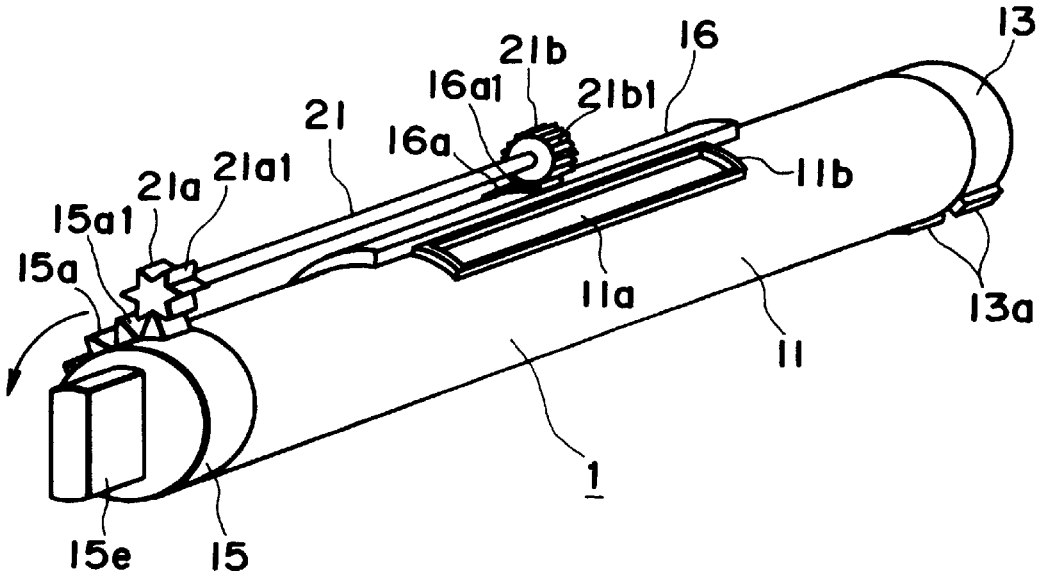
FIG. 11 is a perspective view illustrating a perspective view between the main assembly of the apparatus and the toner supply container of Embodiment 2 in a toner supplying operation.
Figure 12:
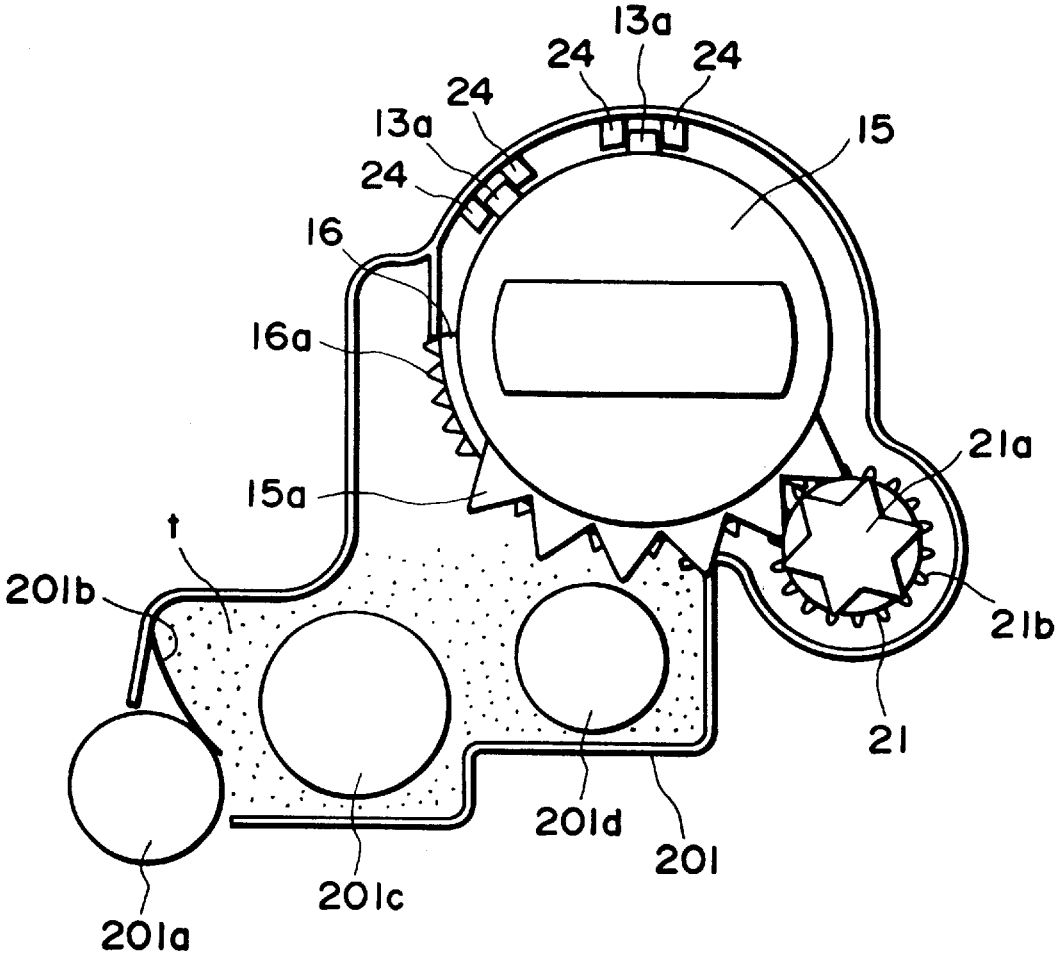
FIG. 12 is a sectional view illustrating an engaging relation between the main assembly of the apparatus and the toner supply container of Embodiment 2.
Figure 13:
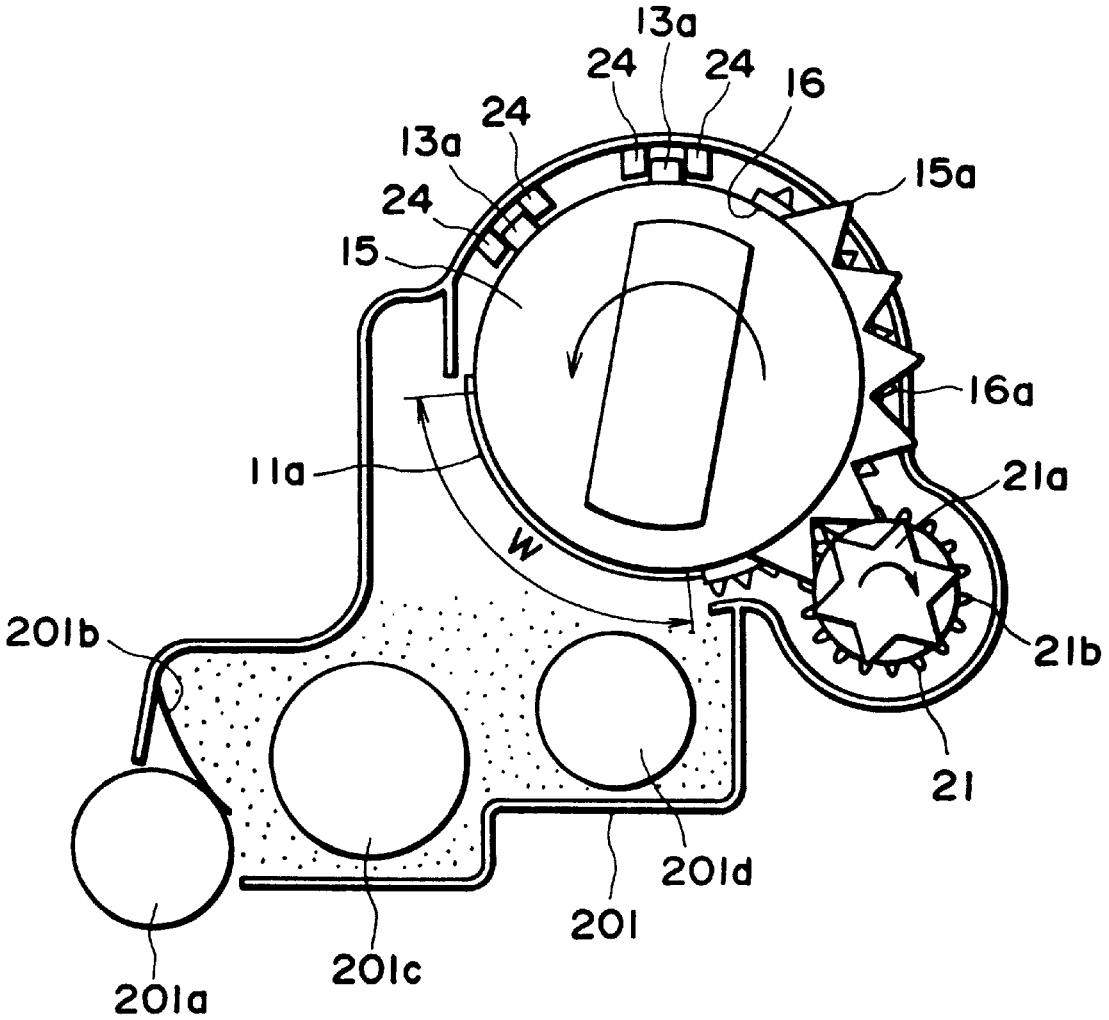
FIG. 13 is a longitudinal sectional view illustrating an engaging relation between the main assembly of the apparatus and the toner supply container of Embodiment 2 in a toner supplying operation.
Figure 14:
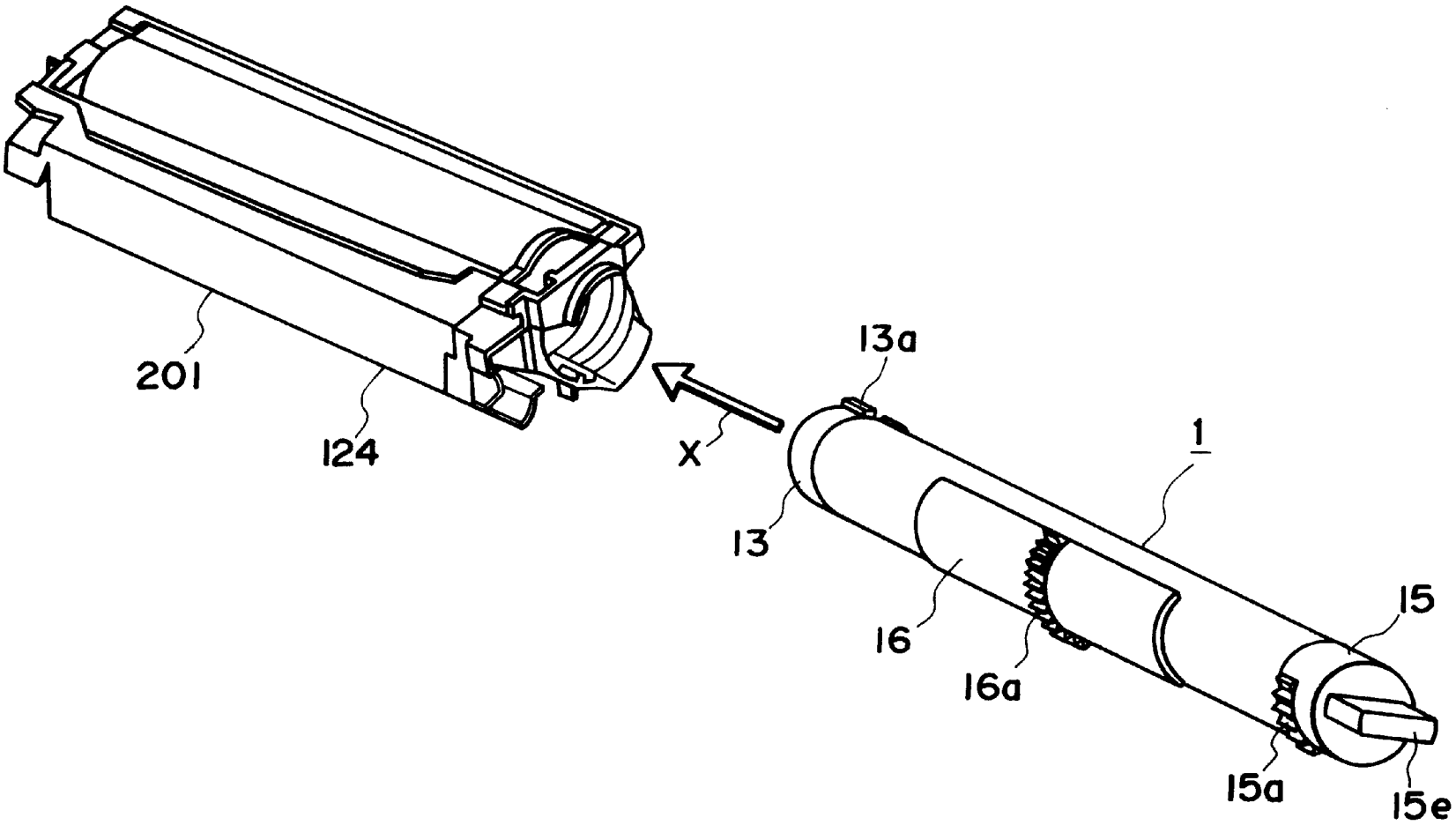
FIG. 14 is a perspective view showing a mounting direction of the toner supply container relative to the main assembly of the apparatus in Embodiment 2 of the present invention.

When the operator rotates the handle 15, the driving force is transmitted to the transmission member 21 through the engaging portion 21*a* from the engaging portion 15*a* provided in the handle 15. Further, it is transmitted to the engaging portion 16*a* provided in the shutter 16 from the engaging portion 21*b*. By the driving force thus transmitted, the shutter 16 causes to slide the engaging portion 11*b* of the toner container 1 in the circumferential direction. This opens the toner discharging opening 11*a* (width W) (FIGS. 11 and 13). This enables the toner supply. The closing operation of the toner discharging opening 11*a* (width W) is effected by the transmission of the driving force in the opposite direction.

In the series of the toner supplying operations, the projection 13*a* of the container 1 is locked by the engaging portion 24 of the main assembly 124 of the apparatus, similarly to Embodiment 1. Therefore, the toner container 11 is not interrelated with the rotation of the handle 15, but is fixed by the main assembly 124 of the apparatus.

Figure 15A:
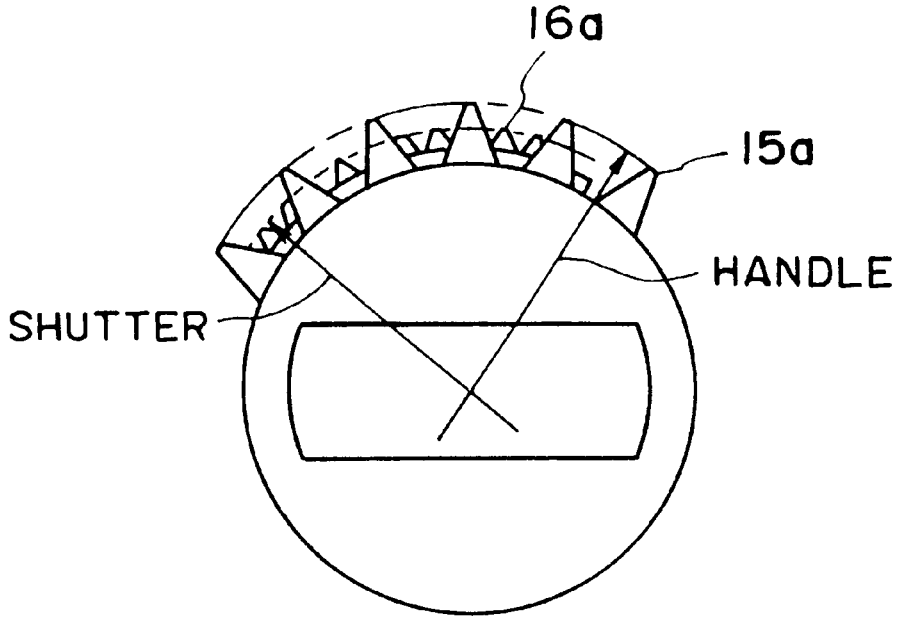
FIGS. 15(*a*) and 15(*b*) are illustrations of an engaging portion of the handle and the shutter.
Figure 15B:
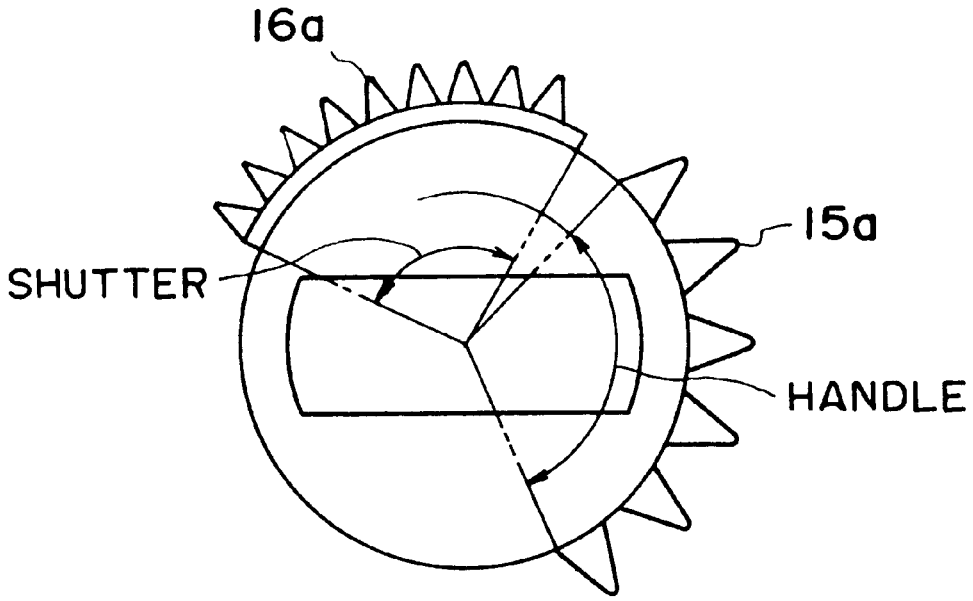

The mounting of the container 1 to the toner supplying apparatus 201 provided in the main assembly 124 of the apparatus, is effected by insertion in the direction of indicated by the arrow X from the second flange 13 side. Therefore, the engaging portion 16*a* passes by the engaging portion 21*a* of the transmission member 21 and is brought into engagement with the engaging portion 21*b* at the rear side. As shown in FIG. 15(*a*), the outer configuration of the engaging portion 16*a* is smaller than that of the engaging portion 15*a*. Or, as shown in FIG. 15(*b*), it is preferable that angles of the engaging portion 16*a* and the engaging portion 15*a* before the mounting, is not overlapped with the other, from the standpoint of mounting operativity.

According to this embodiment, the engageable member 22 is not necessary, and therefore, the structure of the main assembly can be simplified.

Figure 16:
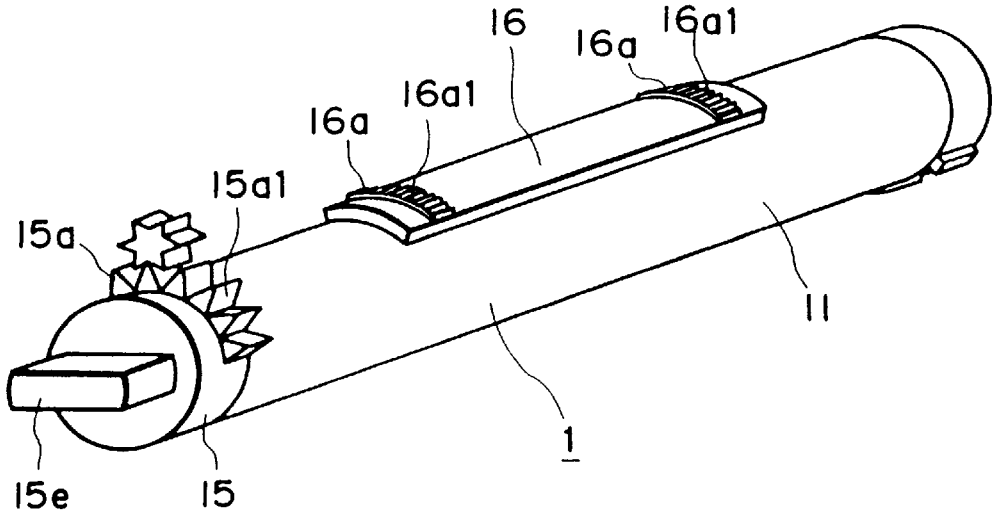
FIG. 16 is a perspective view of a shutter in Embodiment 2 according to another example.

Furthermore, as shown in FIG. 16, the engaging portion 16*a* may be provided at each of the opposite ends of the shutter 16, by which the sliding movement of the shutter 16 is smooth. The engaging portion 16*a* may be provided at one position or at three or more positions.

Figure 17A:
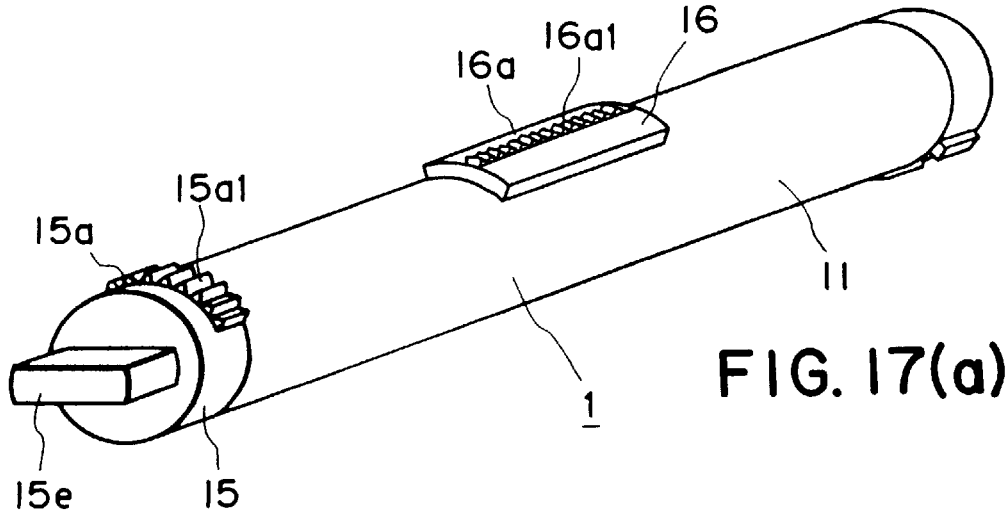
FIG. 17(*a*) is a perspective view of a shutter engaging portion according to another example, and 17(*b*) shows a driving line.
Figure 17B:
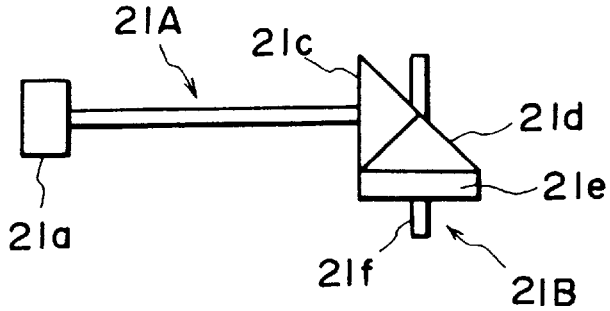

As shown in FIG. 17, the direction of the sliding movement of the shutter 16 is coaxial with the container 11. The engaging portion 16*a* may be in the form of a rack extended in the axial direction of the container 11. In this case, the main assembly of the apparatus is provided with a first drive transmission member 21A having an engaging portion 21*a* engageable with the engaging portion 15*a* and a bevel gear 21*c* at the end. Also, a second drive transmission member 21B is provided which has a pinion 21*e* rotatably supported by a shaft 21*f*. The pinion 21*e* is integral with the bevel gear 21*d* engaged with the gear 21*c*. By doing so, the pinion 21*e* of the second drive transmission member 21B is engaged with the rear side end of the engaging portion 16*a*. Therefore, by the operator rotating the handle 15, the pinion 21*e* is rotated to advance the shutter 16 toward the rear side.

Embodiment 3

Figure 18:
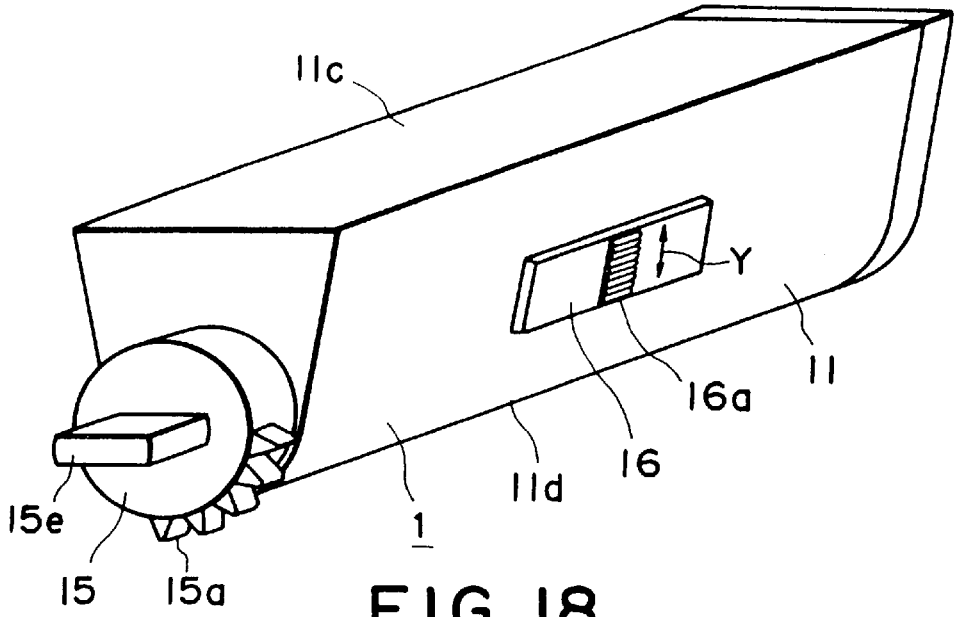
FIG. 18 is a perspective view of a toner supply container shown in Embodiment 3.

Referring to FIG. 18, a toner container 11 according to Embodiment 3 will be described. The same reference numerals as in Embodiment 1 are assigned to the elements having the corresponding functions, and detailed descriptions thereof are omitted for simplicity.

In Embodiment 3 shown in FIG. 18, the engaging portion 22*a* of the engageable member 22 is provided as the engaging portion 16*a* in the shutter 16 of container 1, similarly to Embodiment 2. The configuration of the container 11 is noncylindrical. The cross-section of the container 11 is an arcuated portion 11*d* which is close to semicircle and a trapezoidal portion 11*c* connected thereto. The inside constitutes a single space. The shutter 16 moves along a short side (in the direction perpendicular to the mounting-and-demounting direction of the container 1) along a side surface of the trapezoidal portion 11*c* (direction indicated by the arrow Y). By this, the toner opening 11*a* is opened and closed. The transmission member 21 (not shown in FIG. 18) is similar to that of Embodiment 1, and the engaging portion 21*a* is engaged with the engaging portion 15*a*, and the engaging portion 21*b* is engaged with the engaging portion 16*a*. Here, the engaging portion 16*a* is in the form of a rack extended on the shutter 16 in the moving direction of the shutter 16.

In Embodiment 3, the toner supply is possible without the rotating operation of the container 11 similarly to Embodiment 2. Therefore, the configuration of the container is not limited to any particular shape. Then, the space above the toner container mounting portion which has been a dead space, as shown in FIG. 13, can be utilized as the container 11 capacity.

Using such a configuration, the increase of the volume of the toner container is achieved, and the space efficiency of the toner supply container can be increased. From the standpoint of the discharging property of the toner and the reduction of the remaining toner amount, it is preferable to provide toner feeding means in the container 11.

In the Embodiments 1 through 3, the angle of rotation of the handle 15 is preferably 60° to 120° from the standpoint of operativity.

Embodiment 4

The Embodiment 4 will be described in detail. The description will be made as to (1) general arrangement of the main assembly of the image forming apparatus to which the toner supply container is mounted, (2) structure of the toner supply container and (3) toner supplying operation method.

General Arrangement of the Main Assembly of the Image Forming Apparatus to Which the Toner Supply Container is Mounted FIG. 22 is a longitudinal sectional view of the main assembly 124A of a full color image forming apparatus to which the toner supply container of this embodiment is mounted.

There are provided photosensitive drums 104*a*, 104*b*, 104*c* and 104*d* for forming toner images of magenta, cyan, yellow and black colors, and a transfer belt 125 disposed below the photosensitive drum 104*a*–104*d*. The photosensitive drums 104*a*, 104*b*, 104*c* and 104*d* are rotated by ultrasonic motors ((unshown), and around them, there are provided primary chargers 203*a*, 203*b*, 203*c* and 203*d*, developing devices 204*a*, 204*b*, 204*c* and 204*d*, and transfer chargers 111*a*, 111*b*, 111*c* and 111*d*, respectively. Above the photosensitive drums 104*a* through 104*d*, there are disposed exposure devices 103*a*, 103*b*, 103*c* and 103*d* constituted by LED or the like, respectively.

The photosensitive drums 104*a*, 104*b*, 104*c*, 104*d* are charged by the chargers 203*a*, 203*b*, 203*c*, 203*d*, respectively. They are exposed then to color-separated yellow, magenta, cyan, black light images by the exposure devices 103*a*, 103*b*, 103*c* and 103*d*, respectively. By this, electrostatic latent images for yellow color, magenta color, cyan color and black color toner images are formed on the photosensitive drums 104*a*, 104*b*, 104*c* and 104*d*, respectively. Then, the latent images are developed by the developing devices 204*a*, 204*b*, 204*c* and 204D, respectively. Thus, yellow color, magenta color, cyan color and black color toner images are formed on the photosensitive drums 104*a*, 104*b*, 104*c* and 104*d* sequentially.

A sheet P is fed out of a cassette 105 or 106 by a pick-up roller 105A or 106A one by one. It is fed to a registration roller 110 by a feeding portion 109 including a feeding roller and a paper guide. It is timed by the roller 110, is electrostatically attracted on the transfer belt 125, and is fed in the direction indicated by an arrow A. The sheet P attracted on the transfer belt 125 is fed sequentially to the transfer portions faced to the photosensitive drums 104*a*, 104*b*, 104*c*, 104*d* by the rotation of the transfer belt 125. The toner images on the photosensitive drums 104*a*, 104*b*, 104*c* and 104*d* are superimposedly transferred onto the sheet P by the transfer chargers (transfer blades) 111*a*, 111*b*, 111*c* and 111*d*. By doing so, a full-color toner image is formed.

The sheet P now having the toner images thus transferred, is fed to the fixing portion 114 from the transfer belt 125 portion. The toner image is fixed on the sheet P by the heat and pressure. Thus, a full-color printed image is formed on the sheet P. Then, it is discharged to outside of the main assembly of the apparatus by sheet discharge feeding means 126 provided downstream of the fixing portion 114.

The belt feeding portion 127 comprises a transfer belt 125, a driving roller 129 which receives a driving force from a pulse motor 128 and plurality of supporting rollers 131, 132 and 133, around which the transfer belt 125 is trained.

A transfer belt cleaner 134 is provided to remove the toner deposited on the transfer belt 125. It is contacted to or disengaged from the transfer belt 125 by a mechanism (unshown), upon necessity. The toner is removed from the transfer belt 125 by rotation of a cleaner brush.

The toners are supplied from toner supplying apparatuses 100*a*, 100*b*, 100*c*, 100*d* into the developing devices 204*a*, 204*b*, 204*c*, 204*d*.

When the toner is used up, the operator opens toward himself a front door (unshown) of the main assembly 124A of the apparatus. The toner supply containers loaded in the toner supplying apparatuses 100*a*, 100*b*, 100*c* and 100*d* are exchanged. Then, the front door is closed, in response to which the main switch is actuated. By this, the toner feeding member or toner feeding members of the exchanged new toner supply container or containers 1*a*, 1*b*, 1*c* and/or 1*d* are rotated by driving force from the main assembly 124A, so that toner is supplied into the toner supplying apparatus or appratuses 100*a*, 100*b*, 100*c* and/or 100*d*.

Structure of Toner Supply Container

The toner supply containers 1*a*, 1*b*, 1*c*, 1*d* of this embodiment are mounted to the toner supplying apparatus 100*a*, 100*b*, 100*c*, 100*d* provided in the main assembly 124A of the color copying machine shown in FIG. 22. They are left in the apparatus, and supply the toner into the toner supplying apparatuses 100*a*, 100*b*, 100*c*, 100*d* gradually, until the toner is used up. So, it is a so-called leaving type toner supply container.

The toner supply container 100*a*, 100*b*, 100*c* and 100*d* have the same structures. As shown in FIG. 23, it has a toner container 11 including a first flange 12 and a second flange 13 which are welded to each other into an integral member. It has a cap 14 fitted into one end of the toner container 11. It further comprises a handle 15 rotatably engaged into one end of the toner container 11. It further comprises a toner feeding member (unshown) in the toner container 11, and a coupling (unshown) for supporting the toner feeding member and for transmitting driving force. There are further provided a shutter 16 for opening and closing the toner discharging opening 11*a* of the toner container 11, and a seal member 35 for sealing between the shutter 16 and the toner discharging opening 11*a*.

Toner Container

The toner container 11, as shown in FIG. 27, has a cross-section (taken along a line perpendicular to the longitudinal direction of the container) of an arcuated portion which is close to a semicircle and a rectangular portion 11*h* connected thereto. The inside thereof is a single elongated hollow space. The outer surface of the arcuated portion 11*g* is provided with a toner discharging opening 11*a*. A shutter supporting member 11*e* is provided at longitudinal ends of the toner discharging opening 11*a*. The shutter 16 is supported by a supporting member 11*e* so as to be movable between a close position (FIG. 27(*a*)) for closing the toner discharging opening 11*a*, and an opening position (FIG. 27(*b*)) for opening the toner discharging opening 11*a*, the opening position being retracted from the close position. Depending on the size of the toner discharging opening 11*a* in a direction crossing with the longitudinal direction of the container 11, the sliding movement distance of the shutter 16 is required to be long. Therefore, as shown in FIG. 24, the arcuated portion is extended, and the projection 32 may have an arcuated configuration having the angleθ of 270° as seen from the center of the container 1*a*.

The projection 32 is provided in the second flange 13. The projection 32 is used for positioning, after the container 1*a* is mounted to the toner supplying apparatus 100*a*, 100*b*, 100*c* or 100*d* of the main assembly 124A of the apparatus. The projections 32 may be provided at different positions corresponding the colors of the toners contained in the containers, so that erroneous mounting of a toner supply container at a position for a different color can be avoided. In other words, the projection 32 has a color discrimination function. The projections 32 are provided on the outer surfaces of the containers 11 accommodating different color toners, preferably, at different positions on the outer surface of a free end portions or leading end portions (downstream) of the toner supply container in the inserting direction into the toner supplying apparatus. By doing so, the user can quickly position the container, and can quickly recognize erroneous mounting of the toner supply container, if it occurs.

At a rear end (upstream) in the container inserting direction, an opening 12*a* (toner filling opening) for filling the toner is provided. In the filling port 12*a*, a cross-shaped rib 12*c* is provided. It is provided at a center thereof with an axial bore 12*d* for supporting the toner feeding member. Around the filling port 12*a*, there is provided a circular wall portion 12*e* for engagement with a handle which will be described hereinafter. The filling port 12*a* is sealed by mounting of a cap 14 after the toner filling. The first flange 12 is connected with the toner container 11 into an integral member.

An end surface of the second flange 13 is provided with a hole 13*c* into which the driving force receiving portion (e.g. coupling) for supporting the toner feeding member at the outside of the container 11 and for transmitting driving force, is inserted. Around the hole 13*c*, a wall portion 13*d* for supporting the outer surface of the coupling is provided (FIGS. 23, 31).

The configuration of the toner container may be square prism, hexagonal prism, cylindrical or the like.

Handle

The handle 15 is cylindrical in shape. One end thereof is provided with a straight grip 15*e*. The other end is in the form of a hollow cylindrical shape and is open. The handle 15 is manually rotatable relative to the wall portion 12*e* provided at one end of the container 11. An engaging portion 15*a* for transmitting the driving force is provided. The engaging portion 15*a* is provided on the outer surface of the handle 15. And, it has teeth.

The engaging portion 15*a* is provided with a segment gear configuration engageable with an engaging portion 21*a* of a driving force transmission member 21 provided in the supplying apparatus when the container 1*a*, 1*b*, 1*c* or 1*d* is inserted into a proper one of the supplying apparatuses 100*a*, 100*b*, 100*c* and 100*d*. It is engageable with the engaging portion 21*a* in the series of the container 1 inserting operations.

The driving force transmission member 21 is provided with an engaging portion 21*a* and an engaging portion 21*b* at each of the opposite ends of the shaft 21*s* rotatably supported on the supplying apparatus. The engaging portions 21*a*, 21*b* are in the form of gears having teeth. In this embodiment, the engaging portion 21*a* has one gear teeth. However, the structure or the number of the driving force reception mechanism is not limited to this embodiment, if it functions to receive the driving force. In this embodiment, the engaging portion 21*b* is in meshing engagement with the gear 16*d* (segment gear) through an idler gear as the driving force transmission side engaging portion 21*g*. In this embodiment, the transmission member 21, the engaging portions 21*a* and 21*b* and the engaging portion 21*g* are provided in the main assembly of the apparatus.

Toner Feeding Member

A feeding shaft 27 for supporting the toner feeding member 29 is rotatably supported in the axial bore 12*d* (FIG. 23) at on the end. At the other end, it is supported so as to transmit the rotating force by a coupling 26*a* (FIG. 26). The feeding member 29 is provided with a feeding blade 28 of flexible material fixed to the shaft 27. The coupling 26*a* is rotatably supported on the container 11.

The feeding blade 28 rubs the inner surface of the arcuation shape portion 11*g* (FIGS. 23 and 27). The blade 28 is in the form of a plurality of blades having claw portion 28*a* with an inclined portion 28*b* projected in the rotational direction at the free end side edge relative to the toner discharging opening 11*a*. Therefore, it can feed the toner in the container 11 toward the opening 11*a*. The opening 11*a* is disposed at a front side (upstream) as seen in the inserting direction of the container 1*a* into the main assembly of the apparatus. Thus, all of the claw portions 28*a* are directed in the same direction. When the container 1*a* is mounted to the supplying apparatus 100*a*, the coupling 26*a* is engaged with the driving side coupling (unshown) provided in the supplying apparatus, and receives the driving force to rotate the feeding member 29.

If the toner in the container 11 can be fed to the toner discharging opening, the toner feeding member is not inevitable. However, by the provision of the toner feeding member, the toner can be assuredly supplied.

FIG. 31 shows an end at the side receiving the driving force for the toner supply container. A coupling 26*a* functioning as a driving force receiving member is rotatably supported on the end surface of the container 11. The opposite axial ends of the coupling 26*a* are in the form of axial coupling. It is coupled with an end of the feeding shaft 27 of the feeding member 29 in the container 11. Outside the container 11, there is provided a rotating force receiving portion. The rotating force receiving portion is connected with a driving member, provided in each of the supplying apparatus, for transmitting the rotating force when the container 1*a* is mounted to the main assembly 124A of the apparatus. The rotating force receiving portion is in the form of projections 26*a*1 extended in the radial direction, as shown in FIG. 31. The recess 26*a* formed by the projections 26*a*1 therebetween is engaged with the projection (unshown) of the driving member, so that they are coupled.

Shutter

The shutter 16 shown in FIG. 23 is provided with a sliding portion 16*f* at each of the opposite longitudinal ends of the shutter 16. The sliding portion 16*f* is engaged with a shutter supporting member 11*e* functioning as a guiding member provided at each of the opposite longitudinal ends of the opening 11*a*. The shutter 16 slides in a circumferential direction of the container 11 to close and open the opening 11*a*. A section taken along a plane perpendicular to the longitudinal direction of each of the containers 1*a*, 1*b*, 1*c*, 1*d* of the shutter 16 is arcuated so as to extend along the outer surface of the container 11. The sliding portion 16*f* and the supporting member 11*e* have a hook-shaped section taken along a plane perpendicular to the longitudinal direction.

The shutter 16, as shown in FIG. 25, is provided with a driving force reception side engaging portion 16*d* functioning as a rotating force receiving portion engageable with a gear functioning as the engaging portion 21*g* when any of the containers la, 1*b*, 1*c*, 1*d* is mounted to the associated one of the supplying apparatuses 100*a*, 100*b*, 100*c*, 100*d*. The engaging portion 16*d* is provided with a plurality of tooth. The engaging portion 16*d* is engageable with the engaging portion 21*g* by a series of inserting operation of the container to the associated supplying apparatus. It is preferable that engaging portion 16*d* is disposed on the outer surface of the shutter 16. Further preferably, the diameter of an addedendum circle of a segment gear configuration of the engaging portion 16*d* has substantially the same outer diameter of the shutter 16 except for the engaging portion 16*d*. By this, the space in the direction of height is saved. Therefore, said engaging portion 16*d* is provided on the outer surface adjacent an edge of the shutter 16 closer to the coupling 26*a*. Thus, when the shutter 16 is at a closing position, it is engaged with or disengaged from the engaging portion 21*g*. Through a series of inserting operations into the container, the engaging portion 21*g* provided in the supplying apparatus 100*a* and the engaging portion 16*d* are engaged. Therefore, the sliding portion 16*f*(16*f*1) adjacent the side of the shutter 16 having the coupling 26*a* has a length shorter than the engaging portion 16*d* (A in FIGS. 23 and 25). Thus, it is preferable that sliding portion 16*f*1 is disposed such that when the container is inserted into the supplying apparatus, the end surface 16h adjacent the shutter 16 directly faced to the engaging portion 21*g* functions as the engaging portion 16*d*. In this embodiment, therefore, a cut-away portion 16*g* is provided to shorten the sliding portion 16*f*1. Therefore, the engaging portion 21*g* and the shutter 16 are not interfered.

When the thickness of the shutter 16 is large, the sliding portion 16*f*1 is provided to cover the total arcuated length of the shutter 16. The portion corresponding to the cut-away portion 16*g* may be a recess through which the engaging portion 21*g* is passed.

The shutter 16 is engaged with a main assembly shutter 34 for closing and opening the toner supply opening 33 provided in the supplying apparatus 100*a* as shown in FIG. 28. In interrelation with the sliding movement of the shutter 16 provided in the container 1*a*, the main assembly shutter 34 can be slid.

The engaging portions 21*b*, 21*g* in this embodiment, are constituted by two gears. However, it the drive transmission mechanism is provided, the structure or the number of the gears is not limited.

The toner supplying apparatus 100*a* comprises a supply container receiving portion having a semi-cylindrical lower portion 54*a* and a rectangular upper portion 54*b* to be complementary with the outer shape of the container 11, in the cross-section, as shown in FIGS. 28 and 29, and comprises a supplying apparatus main assembly 54 integral with a frame of the developing device 204*a* therebelow. On the inner surface, there is provided a guiding rail 55 extended in the circumferential direction at a lower portion 54*a*. The guiding rail 55 is engaged with the guide 34*a* of the main assembly shutter 34. The guiding rail 55 and the guide 34*a* have the hook-shaped cross-section, which are nested. Two leads of rail 55 and the guide 34*a* are extended parallel with each other. Therefore, the main assembly shutter 34 is supported on the main assembly 54 of the supplying apparatus. An inner surface of the main assembly shutter 34 has a radius which is the same as that of the outer periphery of the shutter 16. The main assembly shutter 34 has abutment edges 34*b* extended in the longitudinal direction, at the opposite sides perpendicular to the moving direction. The length between the abutment edges 34*b* along the inner surface of the main assembly shutter 34 is equal to the length of the outer arcuation of the shutter 16. Therefore, when the container 1*a* is inserted into the supplying apparatus 100*a*, the edges of the shutter 16 are engaged in the space between the surfaces 34*b*1 radially projected from the abutment edge 34*b* of the main assembly shutter 34. Therefore, the main assembly shutter 34 is interrelatedly moved by the opening and closing of the shutter 16. Therefore, by facing the toner discharging opening 11*a* and the toner supply opening 33 to each other, the shutter 16 is opened to permit the toner to be supplied into the developing device 204*a*.

Seal Member

The sealing member in the form of a seal member 35 is of elastic material (FIG. 23). It functions to seal between the shutter 16 and the discharging opening 11*a*. It therefore prevents leakage of the toner from the inside of the container 11 upon falling shock or the like. To accomplish this, the seal member 35 is stuck on the outer surface of the container 11 so as to enclose the discharging opening 11*a*. More particularly, the material of the seal member 35 may be rubber such as silicon, urethane, polyethylene foam or the like, sponge. Preferably, it is low polyurethane foam having a hardness of 20°–70°, a compression set not more than 10%, a cell size of 60–300 $\mu$m, a density of 0.15–0.50 g/cm$^2$, and it is used with compression of 5–50%.

The seal member 35 may be stuck on a surface faced to the discharging opening 11*a* of the shutter 16 rather than around the discharging opening 11*a*.

Referring to FIG. 30, the description will be made as to another embodiment wherein a seal member is used to seal the toner discharging opening.

In this embodiment, the function of opening and closing the main assembly shutter provided in the main assembly of the apparatus and the function of sealing the toner discharging opening are separated.

In this embodiment, the seal member 35 is in the form of a flexible welded film 35*a*. The seal member 35 is welded on a seat 11*i* enclosing the discharging opening 11*a*. It sealing the opening 11*a*. Seal member 35 is folded back adjacent one side of the opening 11*a*. When the container 1*a* is mounted to the main assembly of the apparatus, the opening 11*a* is unsealed by the operator pulling the other end 35*a*2 of the seal member 35*a*. This type in which the film 35*a* is peeled off the edge portion of the toner discharging opening 11*a*, is not limiting, but it may by a type wherein the film may be torn, upon the toner supply.

The shutter 16 does not have the sealing function for the discharging opening 11*a*. The shutter 16 is provided with an elongated hole 16. The shutter 16 opens and closes a main assembly shutter 34 provided in the main assembly of the apparatus. The mechanism is the same as the foregoing embodiment.

According to this embodiment, there is provided a toner supply container for supplying toner into a main assembly of an electrophotographic image forming apparatus, comprising:

A toner accommodating portion (toner container 11) for accommodating toner to be supplied into a main assembly (124A, 124B) of the electrophotographic image forming apparatus;

A toner discharging opening (11*a*) for discharging the toner accommodated in the toner accommodating portion, said toner discharging opening being provided in said toner accommodating portion;

a sealing member(seal member 35) for openably sealing said toner discharging opening (11*a*);

A rotatable member (handle 15) which is rotatable relative to said toner accommodating portion;

A rotating force receiving portion (driving force reception side engaging portion 16*d*) for receiving rotating force produced by rotation of said rotatable member through a rotating force transmission member (driving force transmission member 21) provided in the main assembly of said electrophotographic image forming apparatus to unseal a main assembly openable member (main assembly shutter 34) which seals a toner reception opening(toner supply opening 33) provided in the main assembly of said electrophotographic image forming apparatus by rotation of said rotatable member, when said toner supply container (1) is mounted to the main assembly of said electrophotographic image forming apparatus.

Toner Supply Operation

The description will be made as to a toner supplying operation using the toner supply container 1*a* according to this embodiment of the present invention.

(1) Mounting of the Toner Supply Container 1*a*

The front door (unshown) provided in the main assembly 124A of the apparatus is opened toward the operator by 90°, then the projection 32*a* of the container 1*a* is engaged with the groove portion 24*a* (FIG. 28) of the supplying apparatus 100*a*. The container 1*a* is inserted into the supplying apparatus 100*a* with the side having the coupling 26*a* at the leading end. Then, the shutter 16 of the container 1*a* and the main assembly shutter 34 in the supplying apparatus 100*a* are engaged with each other (FIG. 28). The engaging portion 21*g* and the engaging portion 16*d* of the shutter 16 are brought into engagement with each other. Finally, the engaging portion 21*a* is engaged with the engaging portion 15*a* of the handle 15.

(2) Placing of Toner Supply Container and Toner Supply

With the container 1*a* mounted to the supplying apparatus 100*a*, the operator rotates the handle 15 manually by 90° in the clockwise direction. By this, driving force of the rotation is transmitted to the transmission member 21 through the engaging portion 21*a* from the engaging portion 15*a*. Furthermore, it is transmitted to the engaging portion 16*d* of the shutter 16 from the engaging portion 21*g*. By the driving force thus transmitted, the shutter 16 is slid in the circumferential direction while engaging with the supporting member 11*e* of the container 11. At this time, the main assembly shutter 34 is interrelatedly slid with the sliding movement of the shutter 16. Therefore, the discharging opening 11*a* of the container 1*a* and the supply opening 33 of the supplying apparatus 100*a* are simultaneously opened. And, by rotating the toner feeding member 29 by the coupling 26*a* receiving the driving force from the main assembly 124A of the apparatus, the toner supply is started.

During this operation, the container 11 does not rotate. Therefore, the container 1*a* is not interrelated with the rotation of the handle 15, and is fixed in the supply container 100*a*.

(3) Dismounting of the Toner Supply Container

The operator rotates the handle 15 in the counterclockwise direction by 90°. By this, the driving force in the opposite direction is transmitted in the opposite order. The shutter 16 closes the discharging opening 11*a*, and the main assembly shutter 34 closes the supply opening 33. Thus, the series of toner supplying operations is completed.

In the mounting of the container 1*a* to the supplying apparatus 100*a*, the coupling 26*a* side takes a first position. Therefore, the engaging portion 16*d* passes through the engaging portion 21*a* and is brought into engagement with the engaging portion 21*g*. To accomplish this, the diameter of the addedendum circle of the segment gear-like engaging portion 16*d* is preferably smaller than the diameter of the dedendum circle of the segment gear-like engaging portion 15*a*.

With such a structure, the container is stationary (not moved) during the series of toner supplying operations. Therefore, the configuration of the container is not limited. Thus, a container configuration having a higher space efficiency can be used. Since the shutter and the handle are separate members, the position of the toner discharging opening may be adjacent the handle. Therefore, the latitude of the design of the toner supply container may be high.

The toner supply container of this embodiment, rotation of the handle is transmitted to the driving force receiving portion of the shutter through a plurality of engaging portions, namely, the engaging portion of the handle, engaging portion of the drive transmission member and the engaging portion of the shutter. Therefore, it is possible to freely use the engagement ratios (gear ratios) in the design of the engaging portions.

When the sliding movement distance for opening and closing the shutter is long, the engagement ratio of the handle 15 (gear ratio) is made large, so that operation (rotation) distance of the handle can be shortened. When the opening and closing torque of the shutter is large, the engagement ratio (gear ratio) of the handle is made small, so that torque required for the operation (rotation) of the handle can be decreased.

For example, the angle of rotation of the handle for opening and closing the shutter is made 90°. When the toner supply container is inserted to the supplying apparatus, grip 15*e* is positioned in the perpendicular direction. The grip 15*e* takes the horizontal position when the handle is rotated in the clockwise direction by 90° to discharge the toner. By doing so, the operator can easily operate, and the operator can easily recognize the state of the container 1*a*. The angle of rotation of the handle 15*e* for the shutter is preferably in the range of 60°–120° from the standpoint of operativity.

Embodiment 5

The Embodiment 5 will be described in detail. In this embodiment, when the toner supply container is mounted to the main assembly of the apparatus, it is mounting in the direction crossing with the longitudinal direction of the container. The shutter is slid in interrelation with opening and closing of a door of a main assembly of the apparatus.

FIG. 32 is a perspective view of a toner supplying apparatus 100A and a developing device 201. The supplying apparatus 100A comprises a toner supply container 1A and a supply container receiving portion 41. The supply container receiving portion 41 comprises a buffer portion 42 for temporarily storing the toner supplied from the container 1A, a feeding screw 43 for feeding the toner from the buffer portion 42 to the developing device 201, a buffer shutter (unshown) for covering a toner reception opening of the buffer portion 42.

When the toner in the supplying apparatus 100A is used up, the front door 44 (FIG. 39) of the main assembly 124A of the apparatus is opened, the toner supply container 1A and the supply container receiving portion 41 are exposed.

The container 1A is inserted into the supply container receiving portion 41 in the direction perpendicular to the longitudinal direction (arrow A in FIGS. 32 and 39).

Structure of Toner Supply Container

The toner supply container 1A of this embodiment is a so-called leaving type toner supply container.

As shown in FIG. 33, the container 1A is provided with a toner container 11 having a flange 45 at the opening 11*g*. It comprises a cap 14 at one end of the toner container 11, a handle 15A rotatably engaged to an end of the toner container 11, and a toner feeding member 29 provided in the toner container 11. One end of the toner feeding member 29 is supported from outside of the container 11. The container 1A further comprises a coupling 46 functioning as a driving force receiving member, shutter 16 for opening and closing the toner discharging opening 11*a*, and a seal member 35.

Toner Container

The toner container 11 is in the form of a hollow cylindrical member. The section taken along a plane in the longitudinal direction of the toner discharging opening 11*a* of the container 11, as shown in FIGS. 34 and 35, includes an arcuated portion 11*i* having an angle θ of 270° as seen from the center, and a rectangular portion 11*j*. In the outer surface of the arcuated portion 11*i*, there is provided a toner discharging opening 11*a*. Around the toner discharging opening 11*a*, there is provided a shutter supporting member 11*e* for supporting a shutter 16 which is movable between a closed position for closing the toner discharging opening 11*a* and an opening position (retracted from the close position) for opening it. With such a structure, a size of the toner discharging opening 11*a* can be increased in the circumferential direction of the toner container 11, and the sliding distance of the shutter 16 can be expanded. The configuration of the toner container 11 may be the same as in Embodiments 1–4.

A rib 11*f* is provided extending in the inserting direction of the container 1A on the outer surface of the arcuated portion 11*i* of the container 11, so that toner supply container containing wrong toner is prevented from being mounted when the container 1A is inserted into the toner supplying apparatus 100A provided in the main assembly 124B of the apparatus. (FIG. 32). The discrimination rib 11*f* is engageable with a groove portion 151 formed in a back side of the front door 44. The positions of the ribs 11*f* are different in the positions in the longitudinal direction of the container 11, so that properness of the toner is discriminated. The receiving portion 41 may be provided with a groove portion 152 for engagement with the rib 11*f* (FIG. 32).

One of the end surfaces is provided with an opening 12*a* functioning as a filling port for filling the toner. The inside of the filling port is provided with a cross-rib 12*c*. The center thereof is provided with an axial bore 12*d* for supporting the toner feeding member 29. The filling port 12*a* is sealed by a cap 14 after toner filling. The opening 11*g* at the other end surface is provided with an engaging portion 45*b*. To the engaging portion 45*b*, a flange 45 including a hole 45*a* for supporting the toner feeding member on the container and for rotatably supporting a coupling 46 for transmitting driving force, is fixed; and around the hole 45*a*, there are provided a wall portion 45*a*1 for the hole 45*a* for supporting the outer surface 46*a* of the coupling 46 and a wall portion 45*d* for engagement with the handle 15A which will be described hereinafter. In this embodiment, the handle 15A is engaged with the coupling 46 side, but it may be engaged with the side having the opening 12*a*.

Handle

The handle 15 is cylindrical in shape. One end thereof has a wall surface 15*g* with an opening 15*f* opposed to the coupling 46 at the center portion thereof. The other end is in the form of a hollow cylinder. The outer surface 15*k* of the handle 15A is provided with a grip 15*e*. The handle 15A is rotatably engaged manually with the wall portion 45*d* provided at the end of the container 11. The handle 15A has an engaging portion 15*a* (gear) for transmitting the driving force. In place of the grip 15*e*, a projection interrelated with the opening and closing of the front door 44 may be provided on the wall surface 15*g*, as will be described hereinafter, by which the rotation of the handle can be interrelated with the opening and closing of the front door.

The engaging portion 15*a* has a segment gear configuration which is engageable with the driving force reception side engaging portion 21*a* of the driving force transmission member 21 provided in the supplying apparatus 100A when the container 1A is inserted into the supplying apparatus 10A. It is disposed on the outer surface 15*k* of the handle 15A to permit engagement with the engaging portion 21*a* in the series of operations.

As shown in FIGS. 36, 37, a transmission member 21 which is partly hidden as indicated by phantom line, has a driving force reception side engaging portion 21*a* at one end of the shaft 21*s* rotatably supported on the supplying apparatus 100A and has an engaging portions 21*a* at the other end.

The description will be made as to a shutter 16 (openable member) and an engaging portion with the main assembly shutter 34. As shown in FIG. 38, the engaging portions 21*b*, 21*i* in the form of gears fixed d to the other end of the shaft 21*s* are in meshing engagement with the engaging portions 21*g*, 21*j* in the form of gears, respectively. The engaging portion 21*g* can be brought into engagement with the engaging portion 16*a* in the form of a segment gear in the radial direction. The engaging portion 21*i* is fixed to the rotation shaft 21*u* rotatably supported on the supply container receiving portion 41. The engaging portion 21*k* which is a gear fixed to the rotation shaft 21*u* is engaged normally with the engaging portion 34*c* in the form of a segment gear provided on the outer periphery of the main assembly shutter 34.

The main assembly shutter 34 opens and closes the toner supply opening 33 provided in the shutter disposition portion 41*e* of the supply container receiving portion 41. Therefore, it is provided so as to open in the direction in the direction of an arrow Y on the outer periphery of the shutter disposition portion 41*e*. A guiding member of the shutter 34 is in the form of a rail similarly to the shutter 16.

The transmission member 21 is disposed on the outside of the receiving portion 41. The teeth portion of the engaging portions such as the engaging portion 21*a*, engaging portion 21*g* or the like, which are brought into engagement with the container 1A in the radial direction, is positioned in the receiving portion 41. Therefore, the receiving portion 41 may be provided with an opening. In this example, there is provided an opening 41*d* so that engaging portions 21*b*, 21*g*, 21*i*, 21*j* are positioned in the receiving portion 41. In order to position the engaging portion 21*a* in the receiving portion 41, there is provided an opening 41*c* (FIG. 39).

Toner Feeding Member

A feeding shaft 27 has an end rotatably supported in an axial bore 12*d* of the cross-shape rib 12*c* provided in the opening 12*a* of the container 11. The other end is engaged with a male shaft 46*a* of a coupling 46. The toner feeding member 29 includes a feeding blade 28 of flexible member fixed to the feeding shaft 27.

The feeding blade 29 rubs the inner surface of the container 11. It has a plurality of claw portions 28*a* inclined in the longitudinal direction. Therefore, it can feed the toner toward the discharging opening 11*a* in the container 11.

The coupling 46 is engaged with the coupling provided in the supplying apparatus 100A to receive the driving force when the supply container 1A is mounted to the supplying apparatus 100A.

Shutter

The shutter 16 functioning as an openable member is engaged with the supporting member 11*e* provided around the discharging opening 11*a*. It is slidable in the circumferential direction to open and close the discharging opening 11*a*.

The shutter 16 includes an engaging portion 16*d* (FIG. 36) in the form of a segment gear engageable with an engaging portion 21*g* provided in the supplying apparatus 100A when the container 1A is mounted to the supplying apparatus 100A. The engaging portion 16*d* is engageable with the engaging portion 21*g* by a series of operations of mounting the container 1A to the supplying apparatus 100A. It is preferable that engaging portion 16*d* is disposed on the outer surface of the shutter 16.

Toner Supply Operation

The description will be made as to a toner supplying operation using the toner supply container 1A of the present invention.

(1) Mounting of the Toner Supply Container

As shown in FIG. 39, the front door 44 is opened toward the operator. The container 1A is inserted in the direction of the arrow A, while the rib 11*f* of the container 11 is engaged with the groove portion 151 provided in the back side of the front door 44. The engaging portion 21*g* is engaged with the engaging portion 16*d*, and the engaging portion 21*a* is engaged with the engaging portion 15*a*, respectively.

(2) Toner Supply

With the container 1A mounted in the supplying apparatus 100A, the operator manually rotates the grip 15*e* toward the rear side. The driving force of the rotation is transmitted to the transmission member 21 through the engaging portion 21*a* from the engaging portion 15*a*. Further, it is transmitted to the engaging portion 16*d* from the engaging portion 21*g*. By the driving force thus transmitted, the shutter 16 slides along the supporting member 11*e*. At this time, the engaging portion 34*c* of the main assembly shutter 34 receives the driving force from the engaging portion 21*k* interrelated with the engaging portion 21*b*. Therefore, the discharging opening 11*a* and the supply opening 33 are simultaneously opened (FIG. 42). The toner feeding member 29 is rotated through the coupling 46 which receives the driving force from the main assembly 124B of the apparatus. By this, the supply of the toner is started. The main assembly shutter 34 may be such that it opens in interrelation with the movement of the shutter 16 of the container 1A.

The angle of rotation of the handle 15A required for opening and closing of the shutter 16 is preferably 60°–120°.

The wall surface 41*a* of the receiving portion 41 is provided with a handle holding portion 47 (FIGS. 32, 40 and 41) interrelated with opening and closing of the front door 44; and when the container 1A is mounted to the supplying apparatus 100A, the projection 15*h* (FIG. 43) is engaged with the holding portion 47. By this, the rotation of the handle 15A can be interrelated with the opening and closing of the front door 44. More particularly, after the loading of the container 1A into the supplying apparatus 100A, the handle 15A is rotated by closing the front door 44. In the same order as described in the foregoing, the driving force is transmitted to the shutters 16, 34. Therefore, the discharging opening 11*a* and the supply opening 33 can be simultaneously opened. Thus, the grip 15*e* is unnecessary.

During the operation, the toner container 11 is fixed in the supplying apparatus 100A.

The projection 15*h* is provided on the end surface of the handle 15A, and is provided with a projection 15*h*1.

(3) Dismounting of the Toner Supply Container

By rotation of the handle 15A toward the operator, or by opening the front door 44 of the main assembly 124B, driving force in the opposite direction is transmitted in the order similar to (2). The shutter 16 closes the discharging opening 11*a*, and the main assembly shutter 34 closes the supply opening 33, thus completing the series of the toner supplying operations.

With such a structure, the toner container is not moved during the series of the toner supplying operation. Therefore, the configuration of the toner container is not limited. The toner container configuration can be selected so as to provide a high space efficiency. Since the shutter handle is a separate member, the position of the toner discharging opening is not limited to the neighborhood of the handle. By the interrelation of the handle with the opening and closing of the front door, the number of steps included in the toner supply operation is reduced.

Each of the engaging portions 15*a*, 16*a*, 16*d*, 21*a*, 21*b*, 21*g*, 22*a* is provided with a plurality of tooth 15*a*1, 16*a*1, 16*d*1, 21*a*1, 21*b*1, 21*g*1, 22*a*1.

Other Modifications

In Embodiment 5, the toner supply container is mounted to or dismounted from the main assembly of the image forming apparatus in the direction crossing with the longitudinal direction of the toner supply container. The shutter of the toner supply container is opened and closed in interrelation with the opening and closing of the door. Further, it opens and closes the main assembly shutter.

Other modifications will be described.

As shown in FIG. 43, similarly to Embodiments 1 through 4, when the toner supply container is mounted to or dismounted from the main assembly 124, 124A of the apparatus in the longitudinal direction, the door 124*f* and the toner supply container 1 are interrelated with each other. FIG. 44 shows a further embodiment. In the embodiment, the main assembly of the apparatus opens and closes the upper frame 124*c* relative to the lower frame 124*d* about the hinge 124*e*. In the case that toner supply container 1*a*, 1*b*, 1*c*, 1*d* is mounted or demounted in the longitudinal direction or in the direction perpendicular thereto, relative to the upper frame 124*c* (or lower frame 124*d*), the opening and closing of the upper frame 124*c* and the opening and closing of the shutter of the toner supply container 1*a* through 1*d* may be interrelation with each other.

The mechanism for locking the handle may be used in the other embodiments. The toner supply container of this embodiment can be used with the main assembly of this embodiment.

Accordingly, the embodiments described in the foregoing provide:

A toner supply container (1, 1A, 1*a* through 1*d*) for supplying the toner to the main assembly (124A, 124B) of the electrophotographic image forming apparatus, comprising:

- a toner accommodating portion(toner container 11) for accommodating toner (t) to be supplied into a main assembly of the electrophotographic image forming apparatus;
- a toner discharging opening (11*a*) for discharging the toner accommodated in the toner accommodating portion, wherein the toner discharging opening is provided in the toner accommodating portion;
- an openable member (shutter 16) for openably sealing the toner discharging opening;
- a rotatable member (handle 15) rotatable relative to the toner accommodating portion;
- a rotating force receiving portion (driving force reception side engaging portion 16*a*, 16*d*, contact portion 16*n*) for receiving rotating force produced by rotation of the rotatable member through a rotating force transmission member (driving force transmission member) provided in the main assembly of the electrophotographic image forming apparatus to unseal the toner discharging opening by the rotation of said rotatable member when the toner supply container is mounted to the main assembly of the electrophotographic image forming apparatus.

The rotatable member includes a grip portion (grip 15*e*) and a plurality of teeth (15*a*1) integral with the grip portion, wherein the rotating force produced by rotation of the grip portion by an operator is transmitted to the rotating force receiving portion through the teeth and the driving force transmission member (21) when the toner supply container is mounted to the main assembly of the electrophotographic image forming apparatus, and wherein by the transmission, said openable member is moved from a sealing position to an opening position to unseal the toner discharging opening.

The rotatable member (handle 15A) includes a plurality of teeth (15*a*1), and the rotatable member rotates in interrelation with opening and closing of a door (44), and wherein rotating force produced by rotation of the rotatable member in interrelation with a closing operation of the door after the toner supply container is mounted to the main assembly of said electrophotographic image forming apparatus, is transmitted to the rotating force receiving portion (engaging portion 16*d*) through the teeth and the driving force transmission member (link 49, shaft 21S or the like), by which the openable member is moved from a sealing position to an open position to unseal the toner discharging opening, wherein the door is openable relative to the main assembly of the electrophotographic image forming apparatus and is opened and closed to mount the toner supply container to the main assembly of the electrophotographic image forming apparatus (FIGS. 32 to 42).

The rotating force receiving portion (engaging portion 16*a*, 16*d*) includes a plurality of teeth (16*a*1) provided integrally with the openable member (shutter 16), and when the toner supply container is mounted to the main assembly of the electrophotographic image forming apparatus, the teeth an engaged with a main assembly gear portion (21*b*, 21*g*) of the driving force transmission member to receive a driving force for moving the openable member to the opening position from the sealing position from the main assembly gear portion, wherein the openable member is a curved plate member slidable along an outer surface of the toner accommodating portion ((container 11) (FIGS. 9 through 29 and 31 through 42).

The plate member (shutter 16) is slidable in a direction crossing with a longitudinal direction of the toner accommodating portion.

The teeth are disposed at a side opposite from a side having a grip portion (15*e*) relative to the toner discharging opening (11*a*) in longitudinal direction of the toner accommodating portion, and wherein the teeth are arranged in the direction crossing with the longitudinal direction of the toner accommodating portion along one end of the toner discharging opening.

The container further comprises an elastic sealing member (35) provided around a toner discharging opening on an outer surface of the toner accommodating portion, and the elastic sealing member is positioned between the toner accommodating portion and the plate member.

The toner discharging opening (11*a*) is disposed adjacent to the grip portion (15*c*) in the longitudinal direction of the toner accommodating portion (container 11), wherein the toner supply container is inserted into the main assembly (124A, 124B) of the electrophotographic image forming apparatus in the longitudinal direction of the toner accommodating portion, the container further comprising a driving force receiving portion (coupling 26*a*) on an end opposite from the end having the grip portion in the longitudinal direction of the toner accommodating portion, wherein when the toner supply container is mounted to the main assembly of the electrophotographic image forming apparatus, the driving force receiving a portion receives driving force for rotating a toner feeding member (screw 25, feeding blade 28, toner feeding member 29) provided in the toner accommodating portion ((FIG. 19).

The rotatable member (handle 15) is rotated through 60°–120° when the toner supply container (1) is mounted to the main assembly (124A, 124B) of the electrophotographic image forming apparatus.

The toner supply container (1) is mounted to the main assembly of said electrophotographic image forming apparatus while the toner discharging opening (11*a*) is faced down and while the toner accommodating portion (container 11) is prevented from rotating in a direction substantially perpendicular to the longitudinal direction thereof.

The rotatable member (handle 15) is an integrally-molded product of resin material provided at one longitudinal end of the toner accommodating portion (container 11), and the one end is at an upstream side in a mounting direction of the toner supply container relative to the main assembly of the electrophotographic image forming apparatus, the mounting direction being along the longitudinal direction of the toner supply container.

The container further comprises a toner filling opening (12*a*), at one longitudinal end of the toner accommodating portion (container 11), for filling toner into the toner accommodating portion, wherein the toner filling opening is sealed by a cap (14), and the toner filling opening and cap are covered with said rotatable member.

A projection height of the rotating force receiving portion is smaller than a projection height of a driving force transmitting portion provided on the rotatable member so as to avoid interference between a rotating force receiving portion of the openable member and the drive transmission member when the toner supply container is inserted into the main assembly of the apparatus.

A rotating force receiving portion of the openable member and a driving force transmitting portion of the rotatable member are provided at positions different from each other in a direction crossing with the longitudinal direction of the toner accommodating portion.

The driving force transmitting portion is provided with a plurality of teeth, which are engaged with a gear provided in the main assembly of the apparatus when toner supply container is mounted to the main assembly of the apparatus.

There is further provided:

A toner supply container for supplying toner into a main assembly of electrophotographic image forming apparatus, comprising:

a toner accommodating portion (container 11) for accommodating the toner;

a toner discharging opening (11*a*), provided in the toner accommodating portion, for discharging toner accommodated in the toner accommodating portion;

an openable member (shutter 16) for openably sealing the toner discharging opening;

a driving force receiving portion (engaging portion 16*a*, contact portion 16*h*) for receiving driving force to move the openable member to open the toner discharging opening when said container is mounted to the main assembly of the electrophotographic image forming apparatus.

There is further provided:

A toner supply container for supplying toner to a main assembly of electrophotographic image forming apparatus, comprising:

a toner accommodating portion (container 11) for accommodating the toner;

a toner discharging opening (11*a*), provided in the toner accommodating portion, for discharging the toner accommodated in the toner accommodating portion;

an openable member (shutter 16) for openably sealing the toner discharging opening, a rotatable member (handle 15) rotatable relative to the toner accommodating portion wherein when the container is mounted to the main assembly of said electrophotographic image forming apparatus, a toner receiving opening provided in the main assembly of the apparatus can be opened by rotating the rotatable member.

There is further provided:

A toner supply container for supplying toner to the main assembly of electrophotographic image forming apparatus, comprising:

a toner accommodating portion (container 11) for accommodating the toner;

a toner discharging opening (11*a*), provided in the toner accommodating portion, for discharging the toner accommodated in the toner accommodating portion;

an openable member (shutter 16) for openably sealing the toner discharging opening, a rotatable member (handle 15) rotatable relative to the toner accommodating portion wherein when the container is mounted to the main assembly of said electrophotographic image forming apparatus, rotating force of said rotatable member is transmitted to the openable member through a rotating force transmission member provided in the main assembly of the apparatus.

There is further provided:

A toner supply container (1) for supplying toner (t) to a main assembly (124A, 124B) of an electrophotographic image forming apparatus, wherein the main assembly of the apparatus includes a first main assembly engaging portion (driving force reception side engaging portion 21*a*), a second main assembly engaging portion (driving force transmission side engaging portion 21*a* engaging portion 22*b*), and a driving force transmitting portion (shaft 21*s*) for transmitting to the second main assembly engaging portion driving force received by said first main assembly engaging portion;

a toner accommodating portion (container 11) for accommodating the toner;

a toner discharging opening (11*a*) for discharging the toner accommodated in said toner accommodating portion;

an openable member (shutter 16) for openably sealing said toner discharging opening, a first container engaging portion (driving force transmission side engaging portion 15*a*) for transmitting the driving force to said first main assembly engaging portion when said toner supply container is mounted to the main assembly of said apparatus;

a second container engaging portion for. receiving driving force from said second main assembly engaging portion when said toner supply container is mounted to the main assembly of said apparatus;

wherein when said toner supply container is mounted to the main assembly of said apparatus, the driving force transmitted to the main assembly of said apparatus by said first container engaging portion is received from the main assembly of apparatus by the second container engaging portion, and the openable member is moved by the driving force to unseal said toner discharging opening.

The first main assembly engaging portion and the second main assembly engaging portion are not limited to the gear disclosure in the foregoing. For example, they may be a friction wheel, pin wheel or the like. Similarly, the first container engaging portion and the second container engaging portion are not limited to the gears disclosed in the foregoing. If the transmission of the driving force is possible relative to the first main assembly engaging portion and the second main assembly engaging portion, a friction wheel, pin wheel or the like are usable. When a gear is used, the tooth may be formed on the entire circle, or only on a part thereof, or they are not limited to tooth. For example, the configuration or number of the tooth are properly selected by one skilled in the art. The driving force transmitting portion is not limited to the shaft. It may be any if the transmission of the driving force is possible, such as a gear train.

As described in the foregoing, according to the present invention, the toner supply operativity can be improved.

While the invention has been described with reference to the structures disclosed herein, it is not confined to the details set forth and this application is intended to cover such modifications or changes as may come within the purposes of the improvements or the scope of the following claims.

What is claimed is:

1. A toner supply container for supplying toner into a main assembly of an electrophotographic image forming apparatus, wherein said toner supply container is detachably mountable to the main assembly of the electrophotographic image forming apparatus, said toner supply container comprising:

a toner accommodating portion for accommodating toner to be supplied into the main assembly;

a toner discharging opening for discharging the toner accommodated in said toner accommodating portion, said toner discharging opening being provided in said toner accommodating portion;

an openable member for openably sealing said toner discharging opening;

a rotatable member, which is rotatable relative to said toner accommodating portion, for imparting a rotating force to a rotating force transmission member provided in the main assembly when said toner supply container is mounted to the main assembly; and a rotating force receiving portion for receiving a rotating force from the rotating force transmission member when said toner supply container is mounted to the main assembly to move said openable member relative to said toner accommodating portion so as to open said toner discharging opening.

2. A container according to claim 1, wherein said rotatable member includes a grip portion and a plurality of teeth integral with said grip portion, wherein a rotating force produced by rotation of said grip portion by an operator is transmitted to said rotating force receiving portion through said teeth and the rotating force transmission member when said toner supply container is mounted to the main assembly and wherein said openable member is moved from a sealing position to an opening position to unseal the toner discharging opening by the rotating force transmission member.

3. A container according to claim 2, wherein said toner discharging opening is disposed at an end of said toner accommodating portion closer to said grip portion than an end of said toner accommodating portion opposed from the end provided with said grip portion, in the longitudinal direction of said toner accommodating portion, wherein said toner supply container is inserted into the main assembly in the longitudinal direction of said toner accommodating portion, said container further comprising a driving force receiving portion on the end opposite from the end having the grip portion in the longitudinal direction of said toner accommodating portion, wherein when said toner supply container is mounted to the main assembly, said driving force receiving portion receiving a driving force for rotating a toner feeding member provided in said toner accommodating portion.

4. A container according to claim 1, wherein said rotatable member includes a plurality of teeth, and said rotatable member rotates in interrelation with opening and closing of a door, and wherein the rotating force produced by rotation of said rotatable member in interrelation with a closing operation of said door after said toner supply container is mounted to the main assembly, is transmitted to said rotating force receiving portion through said teeth the rotating driving force transmission member, by which said openable member is moved from a sealing position to an open position to unseal said toner discharging opening, wherein said door is openable relative to the main assembly and is opened and closed to mount said toner supply container to the main assembly.

5. A container according to claim 2, wherein said rotating force receiving portion includes a plurality of teeth provided integrally with said openable member, and when said toner supply container is mounted to the main assembly, said teeth of said openable member are engaged with a main assembly gear portion of the rotating force transmission member to receive the rotating force for moving said openable member to the opening position from the sealing position from the main assembly gear portion, wherein said openable member is a curved plate member slidable along an outer surface of said toner accommodating portion.

6. A container according to claim 5, wherein said curved plate member is slidable in a direction crossing with a longitudinal direction of said toner accommodating portion.

7. A container according to claim 6, wherein, said toner discharging opening is disposed between said teeth of said openable member and said grip portion in a longitudinal direction of said toner accommodating portion, and wherein said teeth of said openable member are arranged in a direction crossing with the longitudinal direction of said toner accommodating portion.

8. A container according to claim 7, further comprising an elastic sealing member provided around a toner discharging opening on an outer surface of said toner accommodating portion, and said elastic sealing member is positioned between said toner accommodating portion and said curved plate member.

9. A container according to claim 7, wherein said rotatable member is an integrally-molded product of resin material provided at one longitudinal end of said toner accommodating portion, and said one end is at an upstream side in a mounting direction of said toner supply container relative to the main assembly, the mounting direction being along the longitudinal direction of said toner supply container.

10. A container according to claim 9, further comprising a toner filling opening, at one longitudinal end of said toner accommodating portion, for filling said toner accommodating portion with toner, wherein said toner filling opening is sealed by a cap, and said toner filling opening and cap are covered by said rotatable member.

11. A container according to claim 5, wherein said toner supply container is mounted to the main assembly while said toner discharging opening is faced down and while said toner accommodating portion is prevented from rotating in a direction substantially perpendicular to a longitudinal direction of said toner accommodating portion.

12. A container according to claim 2 or 4, wherein said rotatable member is rotated through 60°–12° when said toner supply container is mounted to the main assembly.

13. A container according to claim 5, wherein a projection height of said rotating force receiving portion is smaller than a projection height of a driving force transmitting portion provided on the rotatable member so as to avoid interference between said rotating force receiving portion of said openable member and said drive rotating force transmission member when said toner supply container is inserted into the main assembly.

14. A container according to claim 5, wherein said rotating force receiving portion of said openable member and a driving force transmitting portion of said rotatable member are provided at positions different from each other in a direction crossing with a longitudinal direction of said toner accommodating portion.

15. An apparatus according to claim 13 or 14, wherein said rotating force receiving portion is provided with a plurality of teeth, which are engaged with a gear provided in the main assembly when toner supply container is mounted to the main assembly.

16. A toner supply container for supplying toner into a main assembly of an electrophotographic image forming apparatus, comprising:

a toner accommodating portion for accommodating toner to be supplied into a main assembly;

a toner discharging opening for discharging the toner accommodated in said toner accommodating portion, said toner discharging opening being provided in said toner accommodating portion;

an openable member, slidable along an outer surface of said toner accommodating portion, for openably sealing said toner discharging opening, said openable member being slidable in a direction crossing with a longitudinal direction of said toner accommodating portion;

a rotatable member, rotatable relative to said toner accommodating portion and provided at one longitudinal end of said toner accommodating portion, wherein said rotatable member is provided with a plurality of teeth and engageable with a main assembly gear portion of a rotating force treansmission member provided in the main assembly when said toner supply container is mounted to the main assembly; and a plurality of teeth as a rotating force receiving portion for receiving a rotating force produced by rotation of said rotatable member and said teeth provided on said rotatable member and the main assembly gear portion to unseal said toner discharging opening by the rotation of said rotatable member when said toner supply container is mounted to the main assembly, wherein said teeth as the rotating force receiving portion are integral with said openable member.

17. A container according to claim 16, wherein the main assembly gear portion includes a first main assembly gear portion and a second main assembly gear portion rotatable integrally with the first main assembly gear portion, and said teeth of said rotatable member are engageable with the first main assembly gear portion, and said teeth of said openable member are engageable with the second main assembly gear portion when said toner supply container is mounted to the main assembly.

18. A container according to claim 16, wherein said rotatable member includes a grip portion for gripping, which is integral with said teeth of said rotatable member, wherein a rotating force produced by rotation of said grip portion by an operator is transmitted to said rotating force receiving portion through said teeth of said rotatable member and said rotating force transmission member when said toner supply container is mounted to the main assembly, and wherein said openable member is moved from a sealing position to an opening position to unseal the toner discharging opening by the rotating force transmission member.

19. A container according to claim 18, wherein said toner discharging opening is disposed at an end of said toner accommodating portion closer to said grip portion than an end of said toner accommodating portion opposed to the end provided with said grip portion in the longitudinal direction of said toner accommodating portion, wherein said toner supply container is inserted into the main assembly in the longitudinal direction of said toner accommodating portion, said container further comprising a driving force receiving portion of the end opposite from the end having the grip portion in the longitudinal direction of said toner accommodating portion, wherein when said toner supply container is mounted to the main assembly, said driving force receiving portion receiving a driving force for rotating a toner feeding member provided in said toner accommodating portion.

20. A container according to claim 16, wherein said rotatable member rotates in interrelation with opening and closing of a door, and wherein a rotating force produced by rotation of said rotatable member in interrelation with a closing operation of said door after said toner supply container is mounted to the main assembly, is transmitted to said teeth as the rotating force receiving portion through said teeth of said rotatable member and said rotating force transmission member, by which said openable member is moved from a sealing position to an open position to unseal said toner discharging opening, wherein said door is openable relative to the main assembly and is opened and closed to mount said toner supply container to the main assembly.

21. A container according to claim 18, wherein when said toner supply container is mounted to the main assembly, said teeth as said rotating force receiving portion being engaged with a main assembly gear portion of said rotating force transmission member to receive a driving force for moving said openable member to an opening position from a sealing position from the main assembly gear portion, wherein said openable member is a curved plate member slidable along an outer surface of said toner accommodating portion.

22. A container according to claim 21, wherein said curved plate member is slidable in a direction crossing with a longitudinal direction of said toner accommodating portion.

23. A container according to claim 22, wherein said toner discharging opening is disposed between said teeth of said openable member and said grip portion in a longitudinal direction of said toner accommodating portion, and wherein said teeth of said openable member are arranged in a direction crossing with the longitudinal direction of said toner accommodating portion.

24. A container according to claim 23, wherein said rotatable member is an integrally-molded product of resin material provided at one longitudinal end of said toner accommodating portion, and said one end is at an upstream side in a mounting direction of said toner supply container relative to the main assembly, the mounting direction being along the longitudinal direction of said toner accommodating portion.

25. A container according to claim 24, further comprising a toner filling opening, at one longitudinal end of said toner accommodating portion, for filling said toner accommodating portion with toner, wherein said toner filling opening is sealed by a cap, and said toner filling opening and cap are covered by said rotatable member.

26. A container according to claim 22, further comprising an elastic sealing member provided around a toner discharging opening on an outer surface of said toner accommodating portion, and said elastic sealing member is positioned between said toner accommodating portion and said curved plate member.

27. A container according to claim 21, wherein said toner supply container is mounted to the main assembly while said toner discharging opening is faced down and while said toner accommodating portion is prevented from rotating in a direction substantially perpendicular to the longitudinal direction of said toner accommodating portion.

28. A container according to claim 18 or 20, wherein said rotatable member is rotated through 60°–120° when said toner supply container is mounted to the main assembly.

29. A toner supply container for supplying toner into a main assembly of an electrophotographic image forming apparatus, comprising:

a toner accommodating portion for accommodating toner to be supplied to the main assembly of said electrophotographic image forming apparatus;

a grip member provided at one longitudinal end of said toner accommodating portion, said grip member being provided for being gripped by an operator and being rotatable relative to said toner accommodating portion;

a plurality of first teeth provided integrally with said grip member, said first teeth being arranged in a direction substantially perpendicular to a longitudinal direction of said toner accommodating portion, wherein said first teeth are engageable with a first gear of a main assembly gear portion provided in the main assembly when said toner supply container is mounted to the main assembly;

a toner discharging opening for discharging the toner accommodated in said toner accommodating portion, said toner discharging opening being provided in said toner accommodating portion, wherein said toner discharging opening is disposed at an end of said toner accommodating portion closer to said grip portion opposed to an end of said toner accommodating portion, which is not provided with said grip portion, in a longitudinal direction of said toner accommodation portion;

a plate member, slidable along an outer surface of said toner accommodating portion, for openably sealing said toner discharging opening, said plate member being slidable in a direction substantially perpendicular to the longitudinal direction of said toner accommodating portion and being curved along the outer surface of said toner accommodating portion;

a plurality of second teeth for receiving a rotating force produced by rotation of said grip member to unseal said toner discharging opening by the rotation of said grip member when said toner supply container is mounted to the main assembly, said second teeth being arranged in a direction substantially perpendicular to the longitudinal direction of said toner accommodating portion, wherein said second teeth are integral with said plate member, and are engageable with a second gear of the main assembly gear portion provided in the main assembly when said toner supply container is mounted to the main assembly to receive a rotating force produced by rotation of said grip member through the first gear and the second gear;

a toner feeding member, provided in said toner accommodating portion, for feeding the toner accommodated in said toner accommodating portion toward said toner discharging opening;

a driving force receiving member for receiving driving force to rotate said toner feeding member by the main assembly when said toner supply container is mounted to the main assembly, said driving force receiving member being provided at a side opposite from a side having said grip member in a longitudinal direction of said toner accommodating portion; and a toner filling opening for filling said toner accommodating portion with toner, said toner filling opening being provided at a portion side opposite from a side having said driving force receiving member in the longitudinal direction of said toner accommodating portion, wherein said toner filling opening is sealed by a cap, and wherein said toner filling opening and said cap are covered with said grip member.

30. A container according to claim 29, further comprising an elastic sealing member provided around a toner discharging opening on an outer surface of said toner accommodating portion, and said elastic sealing member is positioned between said toner accommodating portion and said curved plate member.

31. A container according to claim 29 or 30, wherein said toner supply container is inserted into the main assembly along the longitudinal direction of said toner accommodating portion.

32. A container according to claim 29, wherein said rotatable member is rotated through 60°–120° by an operator when said toner supply container is mounted to the main assembly.

33. A container according to claim 29, wherein said toner supply container is mounted to the main assembly while said toner discharging opening is faced down and while said toner accommodating portion is prevented from rotating in a direction substantially perpendicular to the longitudinal direction of said toner accommodating portion.

34. A container according to claim 29, wherein said rotatable member is integrally molded with said first teeth from a resin material, and the side having said grip member is at an upstream side in a mounting direction of said toner supply container relative to the main assembly, the mounting direction being along the longitudinal direction of said toner supply container.

35. A toner supply container for supplying toner into a main assembly of electrophotographic image forming apparatus, comprising:

a toner accommodating portion for accommodating toner to be supplied into main assembly;

a toner discharging opening for discharging the toner accommodated in the toner accommodating portion, said toner discharging opening being provided in said toner accommodating portion;

a sealing member for openably sealing said toner discharging opening;

a rotatable member which is rotatable relative to said toner accommodating portion; and a rotating force receiving portion for receiving rotating force produced by rotation of said rotatable member through a rotating force transmission member provided in the main assembly to unseal a main assembly openable member which seals a toner receiving opening provided in the main assembly by rotation of said rotatable member, when said toner supply container is mounted to the main assembly.

36. A container according to claim 35, wherein said rotatable member includes a grip portion and a plurality of tooth integral with said grip portion, wherein a rotating force produced by rotation of said grip portion by an operator is transmitted to said rotating force receiving portion through said teeth and rotating force transmission member when said toner supply container is mounted to the main assembly, and wherein by the transmission said main assembly openable member is moved from a sealing position to an opening position to unseal the toner receiving opening.

37. A container according to claim 36, wherein said toner discharging opening is disposed at an end closer to said grip portion than an end of said toner accommodating portion as is not provided with said grip portion in a longitudinal direction of said toner accommodating portion, wherein said toner supply container is inserted into the main assembly in the longitudinal direction of said toner accommodating portion, said container further comprising a driving force receiving portion at the end opposed to the side having said grip portion in the longitudinal direction of said toner accommodating portion, wherein when said toner supply container is mounted to the main assembly, said driving force receiving portion receives a driving force for rotating a toner feeding member provided in said toner accommodating portion.

38. A container according to claim 35, wherein said rotatable member includes a plurality of teeth, and said rotatable member rotates in interrelation with opening and closing of a door, and wherein a rotating force produced by rotation of said rotatable member in interrelation with a closing operation of said door after said toner supply container is mounted to the main assembly, is transmitted to said rotating force receiving portion through said teeth and the rotating force transmission member, by which said main assembly openable member is moved from a sealing position to an open position to unseal said toner receiving opening, wherein said door is openable relative to the main assembly and is opened and closed to mount said toner supply container to the main assembly.

39. A container according to claim 38, wherein said toner supply container is mounted to the main assembly while said toner discharging opening is faced down and while said toner accommodating portion is prevented from rotating in a direction substantially perpendicular to the longitudinal direction of said toner accommodating portion.

40. A container according to claim 36 or 38, wherein said rotating force receiving portion includes a plurality of teeth, and when said toner supply container is mounted to the main assembly, said teeth are engaged with a main assembly gear portion of the rotating force transmission member to receive a rotating force for moving said main assembly openable member to said opening position from said sealing position from the main assembly gear portion, wherein said main assembly openable member is a curved plate member slidable along an outer surface of said toner accommodating portion.

41. A container according to claim 40, wherein said curved plate member is slidable in a direction crossing with a longitudinal direction of said toner accommodating portion.

42. A container according to claim 41, wherein said toner discharging opening is disposed between said teeth of said openable member and said grip portion in a longitudinal direction of said toner accommodating portion, and wherein said teeth are arranged in the direction crossing with the longitudinal direction of said toner accommodating portion along one end of said toner discharging opening.

43. A container according to claim 42, wherein said rotatable member is an integrally-molded product of resin material provided at one longitudinal end of said toner accommodating portion, and said one end is at an upstream side in a mounting direction of said toner supply container relative to the main assembly, the mounting direction being along the longitudinal direction of said toner accommodating portion.

44. A container according to claim 36 or 38, wherein said rotatable member is rotated through 60°–120° when said toner supply container is mounted to the main assembly.

45. A container according to claim 35, further comprising a second sealing member for openably sealing said toner discharging opening, wherein said second sealing member is a flexible seal and is unsealed by being peeled off a surface of said toner accommodating portion by an operator, wherein the seal is peeled after said toner supply container is mounted to the main assembly.

46. An electrophotographic image forming apparatus for forming an image on a recording material with toner, which electrophotographic image forming apparatus is supplied with the toner from a toner supply container, comprising:

(a) a rotating force transmission member;

(b) a toner container mounting portion for detachably mounting said toner supply container, said toner supply container including:

- a toner accommodating portion for accommodating toner to be supplied into a main assembly of said electrophotographic image forming apparatus;
- a toner discharging opening for discharging the toner accommodating in the toner accommodating portion, said toner discharging opening being provided in said toner accommodating portion;
- a container openable member for openably sealing said toner discharging opening;
- a rotatable member, which is rotatable relative to said toner accommodating portion, for imparting a rotating force to the rotating force transmission member provided in said main assembly when said toner supply container is mounted to the main assembly;
- a rotating force receiving portion for receiving the rotating force from said rotating force transmission member when said toner supply container is mounted to said main assembly to move said openable member relative to said toner accommodating portion so as to open said toner discharging opening;

(c) a feeding member for feeding the recording material.

47. An apparatus according to claim 46, wherein said rotating force transmission member includes a main assembly gear portion, and said main assembly gear portion includes a first gear and a second gear, wherein said first gear and second gear are rotated integrally through a shaft, wherein when said toner supply container is mounted to said assembly said first gear is engaged with a first plurality of teeth provided on said rotatable member, and said second gear is engaged with a second plurality of teeth provided on said rotating force receiving portion.

48. An apparatus according to claim 46, further comprising a toner reception opening for receiving the toner to be supplied from said toner supply container, and a main assembly openable member for openably sealing said toner reception opening, wherein when said toner supply container is mounted to said main assembly said container openable member and main assembly openable member are moved in interrelation with each other.

49. An apparatus according to claim 46, wherein said main assembly gear portion includes a first gear and a second gear, wherein said first gear and second gear are rotated integrally through a shaft, wherein when said toner supply container is mounted to said main assembly said first gear is engaged with a first plurality of teeth provided on said rotatable member, and said second gear is engaged with a second plurality of teeth provided on said rotating force receiving portion.

50. An apparatus according to claim 46, further comprising a toner reception opening for receiving the toner to be supplied from said toner supply container, and a main assembly openable member for openably sealing said toner reception opening, wherein when said toner supply container is mounted to said main assembly said container openable member and main assembly openable member are moved in interrelation with each other.

51. An electrophotographic image forming apparatus for forming an image on a recording material with toner, which electrophotographic image forming apparatus is supplied with the toner from a toner supply container, comprising:

(a) a main assembly gear portion;

(b) a toner container mounting portion for mounting said toner container, said toner container including:

a toner accommodating portion for accommodating toner to be supplied into a main assembly;

a toner discharging opening for discharging the toner accommodated in the toner accommodating portion, said toner discharging opening being provided in said toner accommodating portion;

a container openable member, slidable along an outer surface of said toner accommodating portion, for openably sealing said toner discharging opening, said container openable member being slidable in a direction crossing with a longitudinal direction of said toner accommodating portion;

a rotatable member which is rotatable relative to said toner accommodating portion and which is provided at one longitudinal end of said toner accommodating portion, said rotatable member being provided with a first plurality of teeth arranged and engageable with said main assembly gear portion when said toner supply container is mounted to the main assembly, a second plurality of teeth as a rotating force receiving portion for receiving rotating force produced by rotation of said rotatable member through said teeth provided on said rotatable member and said main assembly gear portion to unseal said toner discharging opening by the rotation of said rotatable member when said toner supply container is mounted to the main assembly of said electrophotographic image forming apparatus, wherein the teeth as said rotating force receiving portion are integral with said container openable member;

(c) a feeding member for feeding the recording material.

52. An electrophotographic image forming apparatus for forming an image on a recording material with toner supplied from a toner supply container, comprising:

(a) a main assembly gear portion including a first gear and a second gear;

(b) a toner container mounting portion for mounting said toner container, said toner container including:

a toner accommodating portion for accommodating toner to be supplied to the main assembly;

a grip member provided at one longitudinal end of said toner accommodating portion, said grip member provided for being gripped by an operator and being rotatable relative to said toner accommodating portion;

a plurality of first teeth provided integrally with said grip member, said teeth being arranged in a direction substantially perpendicular to a longitudinal direction of said toner accommodating portion, wherein said first teeth are engageable with the first gear when said toner supply container is mounted to the main assembly;

a toner discharging opening for discharging the toner accommodated in said toner accommodating portion, said toner discharging opening being provided in said toner accommodating portion, wherein said toner discharging opening is disposed at an end closer to said grip portion than an end of said toner accommodating portion, which is not provided with said grip portion, in the longitudinal direction of said toner accommodating portion;

a plate member, slidable along an outer surface of said toner accommodating portion, for openably sealing said toner discharging opening, said plate member being slidable in a direction substantially perpendicular to the longitudinal direction of said accommodating portion and being curved along the outer surface of said toner accommodating portion;

a plurality of second teeth for receiving a rotating force produced by rotation of said grip member to unseal said toner discharging opening by rotating said grip member when said toner supply container is mounted to the main assembly, said second teeth being arranged in a direction substantially perpendicular to the longitudinal direction of said toner accommodating portion wherein said second teeth are integral with said plate member, and are engageable with the second gear when said toner supply container is mounted to the main assembly to receive a rotating force produced by rotating said grip member through the first gear and the second gear;

a toner feeding member, provided in said toner accommodating portion, for feeding the toner accommodated in said toner accommodating portion toward said toner discharging opening;

a driving force receiving member for receiving a driving force to rotate said toner feeding member by the main assembly when said toner supply container is mounted to the main assembly, said driving force receiving member being provided at a portion opposite from a portion having said grip member in the longitudinal direction of said toner accommodating portion;

a toner filling opening for filling said toner accommodating portion with toner, said toner filling opening being provided at an end opposed to an end having said driving force receiving member in the longitudinal direction of said toner accommodating portion, wherein said toner filling opening is sealed by a cap, and wherein said toner filling opening is sealed by a cap, and wherein said toner filling opening and said cap are covered with said grip member;

(c) a feeding member for feeding the recording material.

53. An apparatus according to claim 52, further comprising a toner reception opening for receiving the toner to be supplied from said toner supply container, and a main assembly openable member for openably sealing said toner reception opening, wherein when said toner supply container is mounted to said main assembly said plate member and main assembly openable member are moved in interrelation with each other.

54. An electrophotographic image forming apparatus for forming an image on a recording material with toner supplied from a toner supply container, comprising:

(a) rotating force transmission member;

(b) a toner container mounting portion for mounting said toner container, said toner container including:

a toner accommodating portion for accommodating toner to be supplied into a main assembly;

a toner discharging opening for discharging the toner accommodated in the toner accommodating portion, said toner discharging opening being provided in said toner accommodating portion;

a sealing member for openably sealing said toner discharging opening;

a rotatable member, which is rotatable relative to said toner accommodating portion; and a rotating force receiving portion for receiving a rotating force produced by rotating of said rotatable member through said rotating force transmission member provided in the main assembly to unseal a main assembly openable member, which seals a toner reception opening provided in the main assembly by rotating said rotatable member, when said toner supply container is mounted to the main assembly; and (c) a feeding member for feeding the feeding member.

55. An apparatus according to claim 54, wherein said rotating force transmission member includes a main assembly gear portion, and said main assembly gear portion includes a first gear and a second gear, wherein said first gear and second gear are rotated integrally through a shaft, wherein when said toner supply container is mounted to said main assembly said first gear is engaged with a first plurality of teeth provided on said rotatable member, and said second gear is engaged with a second plurality of teeth provided on said rotating force receiving portion.

56. An apparatus according to claim 54, further comprising a toner reception opening for receiving the toner to be supplied from said toner supply container, and a main assembly openable member for openably sealing said toner reception opening, wherein when said toner supply container is mounted to said main assembly said container openable member and main assembly openable member are moved in interrelation with each other.

57. A toner supply container for supplying toner to a main assembly of an electrophotographic image forming apparatus, wherein the main assembly including a first main assembly engaging portion, a second main assembly engaging portion and a driving force transmitting portion for transmitting to said second main assembly engaging portion driving force received by said first main assembly engaging portion, said container comprising:

a toner accommodating portion for accommodating the toner;

a toner discharging opening for discharging the toner accommodated in said toner accommodating portion;

an openable member for openably sealing said toner discharging opening a first container engaging portion for transmitting driving force to said first main assembly engaging portion when said toner supply container is mounted to the main assembly; and a second container engaging portion for receiving driving force from said second main assembly engaging portion when said toner supply container is mounted to the main assembly, wherein when said toner supply container is mounted to the main assembly, the driving force transmitted to the main assembly by said first container engaging portion is received by said second container engaging portion from the main assembly, and said openable member is moved by the driving force to open said toner discharging opening.

58. A toner supply container for supplying toner to a main assembly of an image forming apparatus, wherein said toner supply container is detachably mountable to the main assembly, said toner supply container comprising:

a toner accommodating portion for accommodating the toner, said toner accommodating portion being provided with a toner discharging opening for discharging the toner from said toner accommodating portion;

an openable member for openably closing said toner discharging opening;

a movable member, which is movable relative to said toner accommodating portion, for imparting a driving force to a driving force transmission member provided in the main assembly;

a driving force receiving portion for receiving the driving force from said driving force transmission member when said toner supply container is mounted to the main assembly to move said openable member relative to said toner accommodating portion so as to open said toner discharging opening.

* * * * *

UNITED STATES PATENT AND TRADEMARK OFFICE

CERTIFICATE OF CORRECTION

PATENT NO. : 6,185,401 B1
DATED : February 6, 2001
INVENTOR(S) : Akihito Kanamori et al.

It is certified that error appears in the above-identified patent and that said Letters Patent is hereby corrected as shown below:

Column 3,
Lines 25 and 26, should be deleted;
Line 46, "rotating" should read -- a rotating --; and
Line 62, "portion;" should read -- portion; and --.

Column 4,
Line 2, "apparatus;" should read -- apparatus; and --;
Line 14, "1:" should read -- 1. --; and
Line 22, "in (a)," should read -- in 4(a), --.

Column 5,
Line 25, "view" should read -- views --.

Column 6,
Line 23, "toner" should read -- a toner --;
Line 27, "and;" should read -- ; and --; and
Line 40, "A · light" should read -- A light --.

Column 8,
Line 23, "a" should read -- are --.

Column 9,
Line 34, "teeth" should read -- tooth --;
Line 38, "7, 8)" should read -- 7, 8(a) and 8(b)) --; and
Line 43, "cylindrical" should read -- cylinder --.

Column 10,
Line 18, "a, b," should read -- a and b, --;
Line 49, "16." should read -- 16 --; and
Line 65, "(1) mounting of the toner supply container 1" should read -- (1) Mounting of the Toner Supply Container 1 --.

Column 12,
Line 21, "shown in FIG. 9" should read -- , shown in FIG. 9, --;
Line 62, "of" should be deleted.

Column 14,
Line 19, "((unshown)," should read -- (unshown), --;
Line 26, "104c, 104d" should read -- 104c and 104d --;
Line 27, "203c, 203d," should read -- 203c and 203d, -- and
Line 47, "104, 104d" should read -- 104c and 104d --.

UNITED STATES PATENT AND TRADEMARK OFFICE

CERTIFICATE OF CORRECTION

PATENT NO. : 6,185,401 B1
DATED : February 6, 2001
INVENTOR(S) : Akihito Kanamori et al.

It is certified that error appears in the above-identified patent and that said Letters Patent is hereby corrected as shown below:

Column 15,
Line 65, "the" (first occurrence) should read -- to the --.

Column 16,
Line 53, "teeth." should read -- tooth. --.

Column 17,
Line 60, "tooth." should read -- teeth. --.

Column 18,
Line 32, "it" should read -- if --.

Column 19,
Lines 46, 50, and 56, "A" should read -- a --;
Line 57, "portion;" should read -- portion; and --; and
Line 58, "A" should read -- a -- and "addedendum" should read -- addendum --.

Column 22,
Line 22, "apparatus." should read -- apparatus --; and
Line 65, "10A." should read -- 100A. --.

Column 23,
Line 1, "36, 37" should read -- 36 and 37, --;
Line 5, "portions" should read -- portion --;
Line 10, "d" should be deleted;
Line 25, "in the direction" should be deleted; and
Line 42, "cross-shape" should read -- cross-shaped --.

Column 25,
Line 6, "tooth" should read -- teeth --;
Line 31, "relation" should read -- related --;
Line 53, "portion;" should read -- portion; and --; and
Line 62, "said" should read -- the --.

Column 26,
Line 6, "said" should read -- the --;
Line 29, "an" should read -- are --;
Line 35, ((container)" should read -- (container --;
Line 64, "a portion receives" should read -- portion receives a --; and
Line 67, "((Fig. 19)." should read -- (FIG. 19). --.

UNITED STATES PATENT AND TRADEMARK OFFICE

CERTIFICATE OF CORRECTION

PATENT NO. : 6,185,401 B1
DATED : February 6, 2001
INVENTOR(S) : Akihito Kanamori et al.

It is certified that error appears in the above-identified patent and that said Letters Patent is hereby corrected as shown below:

Column 27,
Line 51, "opening;" should read -- opening; and --; and
Line 55, "said" should read -- the --.

Column 28,
Lines 2 and 20,"opening," should read -- opening; and --;
Lines 4 and 22, "portion" should read -- portion, --;
Line 40, "portion;" should read -- portion, comprising: --;
Line 52, "apparatus;" should read -- apparatus; and --;
Line 53, "for." should read -- for --; and
Line 56, "apparatus;" insert -- apparatus, --.

Column 29,
Line 10, "tooth." should read -- teeth. --; and
Line 11, "tooth" should read -- teeth --.

Column 30,
Line 14, "driv-" should be deleted; and
Line 15, "ing" should be deleted.

Column 31,
Line 2, "60°-12°" should read -- 60°-120° --;
Line 9, "drive" should be deleted;
Line 18, "An apparatus" should read -- A container --; and
Line 21, "when" should read -- when said --.

Column 33,
Line 46, "accommodation" should read -- accommodating --.

Column 34,
Line 16, "portion" should be deleted.

Column 35,
Line 6, "tooth" should read -- teeth --; and
Line 47, "the" should read -- a --.

Column 36,
Line 33, "accommodating" (first occurrence) should read -- accommodated --;
Line 35, "portion; should read -- portion; ¶ a sealing member for openably sealing said toner discharging opening --;
Line 38, "member," should read -- member --;

UNITED STATES PATENT AND TRADEMARK OFFICE

CERTIFICATE OF CORRECTION

PATENT NO. : 6,185,401 B1
DATED : February 6, 2001
INVENTOR(S) : Akihito Kanamori et al.

It is certified that error appears in the above-identified patent and that said Letters Patent is hereby corrected as shown below:

Column 36,
Line 41, "assembly;" should read -- assembly; and --;
Line 48, "opening" should read -- opening; and --; and
Line 55, "said" (second occurrence) should read -- said main --.

Column 37,
Line 43, "assembly," should read -- assembly; and --; and
Line 54, "member;" should read -- member; and --.

Column 38,
Line 51, "portion;" should read -- portion; and --;
Line 58, should be deleted;
Line 59, "cap" should be deleted; and
Line 60, "member;" should read -- member; and --.

Column 39,
Line 6, "rotating" should read -- a rotating --.

Column 40,
Line 11, "opening" should read -- opening; --; and
Line 41, "assembly;" should read -- assembly; and --.

Signed and Sealed this

Twenty-second Day of January, 2002

*Attest:*

*Attesting Officer*

JAMES E. ROGAN
*Director of the United States Patent and Trademark Office*